US010084257B2

(12) United States Patent
Peloza et al.

(10) Patent No.: US 10,084,257 B2
(45) Date of Patent: Sep. 25, 2018

(54) ELECTRICAL CONNECTOR

(71) Applicant: Molex, LLC, Lisle, IL (US)

(72) Inventors: Kirk B. Peloza, Naperville, IL (US); Michael Rowlands, Naperville, IL (US); Daniel Tillotson, Wheaton, IL (US); Eric Scharping, Naperville, IL (US); Jeanine Madison, Romeoville, IL (US); Adam Stanczak, Oak Park, IL (US)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/577,829

(22) PCT Filed: Jun. 1, 2016

(86) PCT No.: PCT/US2016/035294

§ 371 (c)(1),
(2) Date: Nov. 29, 2017

(87) PCT Pub. No.: WO2016/196649

PCT Pub. Date: Dec. 8, 2016

(65) Prior Publication Data

US 2018/0166820 A1 Jun. 14, 2018

Related U.S. Application Data

(60) Provisional application No. 62/170,208, filed on Jun. 3, 2015.

(51) Int. Cl.
*H01R 24/00* (2011.01)
*H01R 13/422* (2006.01)
(Continued)

(52) U.S. Cl.
CPC ..... *H01R 13/4223* (2013.01); *H01R 12/716* (2013.01); *H01R 12/73* (2013.01);
(Continued)

(58) Field of Classification Search
CPC .. H01R 13/422; H01R 13/4223; H01R 13/28; H01R 13/428; H01R 13/4367; H01R 12/716; H01R 12/73
(Continued)

(56) References Cited

U.S. PATENT DOCUMENTS 7,172,461 B2 * 2/2007 Davis ..... H01R 13/514 439/607.11
7,492,600 B2 * 2/2009 Kane ..... H05K 5/0069 361/752
(Continued)

FOREIGN PATENT DOCUMENTS

JP 2015-088357 A 5/2015

*Primary Examiner* — Khiem Nguyen
(74) *Attorney, Agent, or Firm* — Jeffrey K. Jacobs

(57) ABSTRACT

A connector includes a housing with a plurality of electrically conductive terminals therein. Some terminals may include a terminal support projection that engages the housing to maintain the position of a contact section of the terminals relative to the housing. Other terminals may have a tool engaging shoulder configured to be engaged by a tool to force press-fit tails of all of the terminals into a circuit member. The housing may include a locking structure for certain the terminals that permits the terminals to be inserted into the housing with little or no force and then securely lock the terminals in the housing. One or more ground plates may be included for electrically connecting a plurality of the terminals. The ground plates may have resilient tabs that contact at least some of the terminals and the tabs may be thinner than a body portion of the ground plate.

20 Claims, 53 Drawing Sheets

(51) Int. Cl.

| | |
|---|---|
| ***H01R 13/28*** | (2006.01) |
| ***H01R 12/71*** | (2011.01) |
| ***H01R 13/436*** | (2006.01) |
| ***H01R 12/73*** | (2011.01) |
| ***H01R 13/428*** | (2006.01) |

(52) U.S. Cl.
CPC ..... *H01R 13/28* (2013.01); *H01R 13/428* (2013.01); *H01R 13/4367* (2013.01)

(58) Field of Classification Search
USPC ..... 439/65, 78, 709–712, 660
See application file for complete search history.

(56) References Cited

U.S. PATENT DOCUMENTS

| | | | | |
|---|---|---|---|---|
| 7,789,716 | B2 * | 9/2010 | Fedder ..... | H01R 12/585 439/607.07 |
| 8,292,639 | B2 * | 10/2012 | Achammer ..... | H01R 12/585 29/832 |
| 2005/0122694 | A1 | 6/2005 | Kane | |
| 2006/0019538 | A1 | 1/2006 | Davis et al. | |
| 2009/0221192 | A1 | 9/2009 | Fedder et al. | |
| 2010/0317239 | A1 | 12/2010 | Achammer et al. | |

* cited by examiner

ELECTRICAL CONNECTOR

RELATED CASES

This Application is a national stage of International Application No. PCT/US2016/035294, filed Jun. 1, 2016, which claims priority to U.S. Provisional Appln. No. 62/170,208, filed Jun. 3, 2015, both of which are incorporated herein by reference in their entireties.

TECHNICAL FIELD

This disclosure relates generally to electrical connectors and, more particularly, to a high performance electrical connector with improved manufacturability and performance.

BACKGROUND

Electrical connector systems are commonly used to interconnect two or more circuit boards or members. When the circuit boards are parallel, the connector system is sometimes referred to as a mezzanine-style connector system. Circuit boards may also be configured in other orientations such as perpendicular to each other.

It is desirable to manufacture high-speed electrical connectors in a cost-effective manner while maintaining the desired mechanical and electrical characteristics of the connector system. Relatively small changes in the components may improve the mechanical aspects of a connector while degrading the electrical performance. Similarly, other relatively small changes may improve the electrical aspects of a connector while degrading the mechanical performance. Accordingly, achieving a high-speed connector design that may be manufactured in a cost-effective manner may be a significant challenge.

The foregoing background discussion is intended solely to aid the reader. It is not intended to limit the innovations described herein, nor to limit or expand the prior art discussed. Thus, the foregoing discussion should not be taken to indicate that any particular element of a prior system is unsuitable for use with the innovations described herein, nor is it intended to indicate that any element is essential in implementing the innovations described herein. The implementations and application of the innovations described herein are defined by the appended claims.

SUMMARY

In one aspect, a connector includes a housing having a mating face for mating with a mating component and a mounting face for interconnection to a circuit member. The housing has a plurality of terminal receiving cavities extending through an upper surface and a terminal support projection associated with each terminal receiving cavity and extending from the upper surface towards the mating face. Each terminal support projection includes a support surface and a contact positioning slot offset laterally from the support surface. A plurality of terminals are provided with each mounted in one of the terminal receiving cavities. Each terminal includes a contact section generally adjacent a first end for engaging a mating terminal and a tail section at a second end, opposite the first end, for interconnection to a circuit member. The contact section is positioned along the support surface of the terminal support projection, and a contact positioning projection extends from the contact section and is positioned within the contact positioning slot of the housing to retain the contact section adjacent the support surface.

In another aspect, a connector includes a housing having a mating face for mating with a mating component and a mounting face for interconnection to a circuit member. The housing includes a plurality of terminal receiving cavities with each terminal receiving cavity being configured to receive a terminal in an insertion direction extending generally from the mating face towards the mounting face. Each terminal receiving cavity has a terminal locking section including a locking wall and a locking projection. The locking projection has a locking surface facing towards the mounting face and generally transverse to the insertion direction. The terminal locking section has an insertion opening with a transverse width partially defined by the locking projection. A plurality of electrically conductive terminals are provided with each terminal being positioned in one of the terminal receiving cavities. Each terminal has a contact section for engaging a mating terminal of the mating component, a tail section for engaging the circuit member, and a locking section. The locking section includes a locking shoulder extending generally perpendicularly to the insertion direction and the locking shoulder engages the locking surface of the locking projection to retain the locking section of the terminal within the terminal locking section of the terminal receiving cavity. The locking section has a thickness less than the transverse width of the insertion opening of the terminal locking section. A plurality of locking members are provided with each locking member being positioned within the terminal locking section of a terminal receiving cavity. The locking member is generally parallel to and spaced from the locking wall and the locking section of each terminal is positioned between the locking wall of the terminal locking section and the locking member.

In still another aspect, a connector includes a housing having a mating face for mating with a mating component and a mounting face for interconnection to a circuit member. The housing including a plurality of first terminal receiving cavities and a plurality of second terminal receiving cavities with the second terminal receiving cavities configured differently from the first terminal receiving cavities. Each first terminal receiving cavity is configured to receive a first terminal in an insertion direction extending generally from the mating face towards the mounting face and has a terminal engagement section and a tail receiving slot. The terminal engagement section includes a terminal engagement shoulder facing the mating face and the tail receiving slot is adjacent the terminal engagement shoulder. A plurality of electrically conductive first terminals are provided with each first terminal being positioned in one of the first terminal receiving cavities. Each first terminal has a first contact section for engaging a mating terminal of the mating component, a first press-fit tail section configured to be press-fit into the circuit member, an engagement shoulder, and a tool shoulder. The first contact section is positioned generally adjacent the mating face and the first press-fit tail section is positioned adjacent the mounting face. The engagement shoulder is positioned adjacent the terminal engagement shoulder of the housing and the tool shoulder is positioned adjacent the mating face of the housing. A plurality of electrically conductive second terminals are provide with each second terminal being positioned in one of the second terminal receiving cavities and each second terminal is configured differently than the first terminals. Each second terminal has a second contact section for engaging a mating terminal of the mating component and a second press-fit tail section configured to be press-fit into the circuit member.

In a further aspect, a connector includes a housing having a mating face for mating with a mating component and a mounting face for interconnection to a circuit member. The housing includes a plurality of terminal receiving cavities with a plurality of ground terminals mounted in at least some of the terminal receiving cavities. A wound plate is associated with the housing and includes a plurality of spaced apart openings with one of the ground terminals extending through each opening. Each opening has at least one resilient tab engaging the ground terminal extending through the opening. The ground plate has a first thickness and the resilient tabs having a second thickness less than the first thickness.

DETAILED DESCRIPTION

Figure 1:
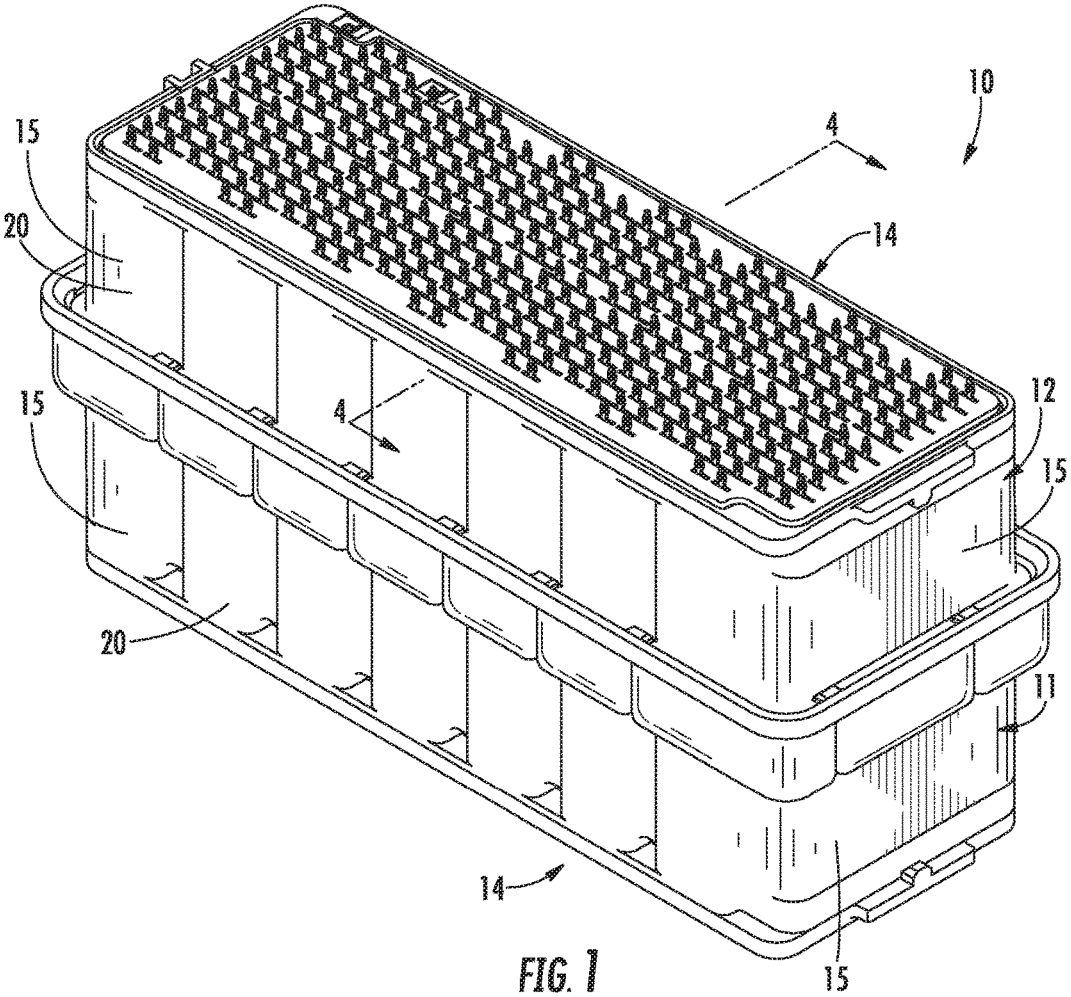
FIG. 1 illustrates a perspective view of an embodiment of a connector system.
Figure 2:
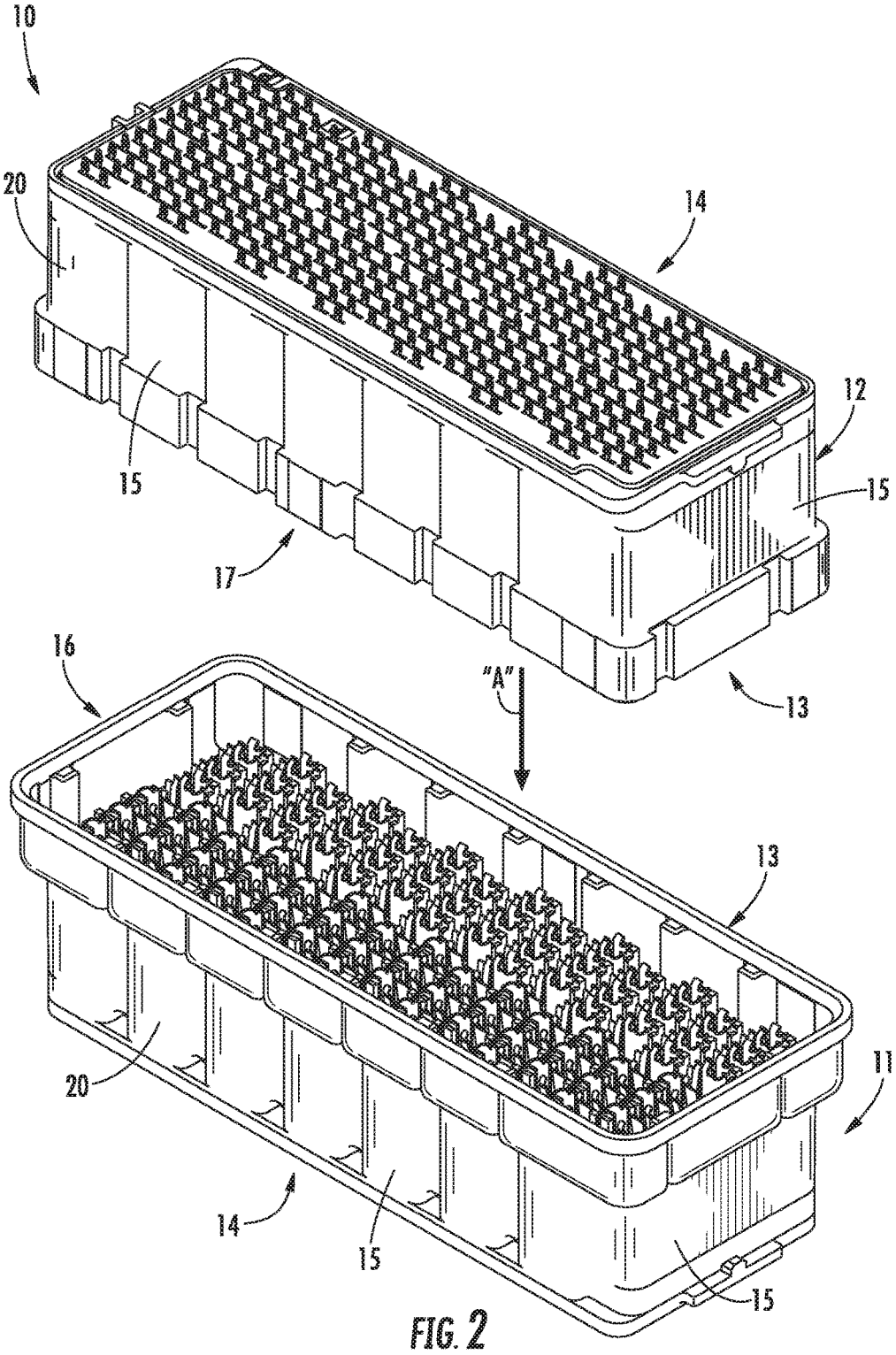
FIG. 2 illustrates a unmated perspective view of the connector system of FIG. 1.

The detailed description that follows describes exemplary embodiments and is not intended to be limited to the expressly disclosed combination(s). Therefore, unless otherwise noted, features disclosed herein may be combined together to form additional combinations that were not otherwise shown for purposes of brevity.

Referring to FIGS. 1-4, a connector system 10 includes a pair of mating connectors in the form of a first connector 11 and a mating second connector 12 that may be mated along axis "A" to provide a mezzanine-style board-to-board connection. More specifically, first connector 11 may be mounted to a first circuit board or circuit member (not shown) and second connector 12 may be mounted to a second circuit board or circuit member (not shown) with planes of the first and second circuit boards being generally parallel.

Each of the first connector 11 and the second connector 12 is generally rectangular and has a mating face 13 for mating with another connector, a mounting face 14 for interconnection such as by mounting or termination to a circuit member, and a plurality of sidewalls 15 that extend between the mating face and the mounting face. First connector 11 is configured as a receptacle-style connector with an opening or receptacle 16 and second connector 12 is configured as a plug-style connector with a plug portion 17 configured to be received within the receptacle of the first connector. First connector 11 and second connector 12 may otherwise be identical except to the extent necessary to permit the two connectors to be mated together. Accordingly, the details of only one of the first and second connectors 11, 12 are described herein.

Figure 3:
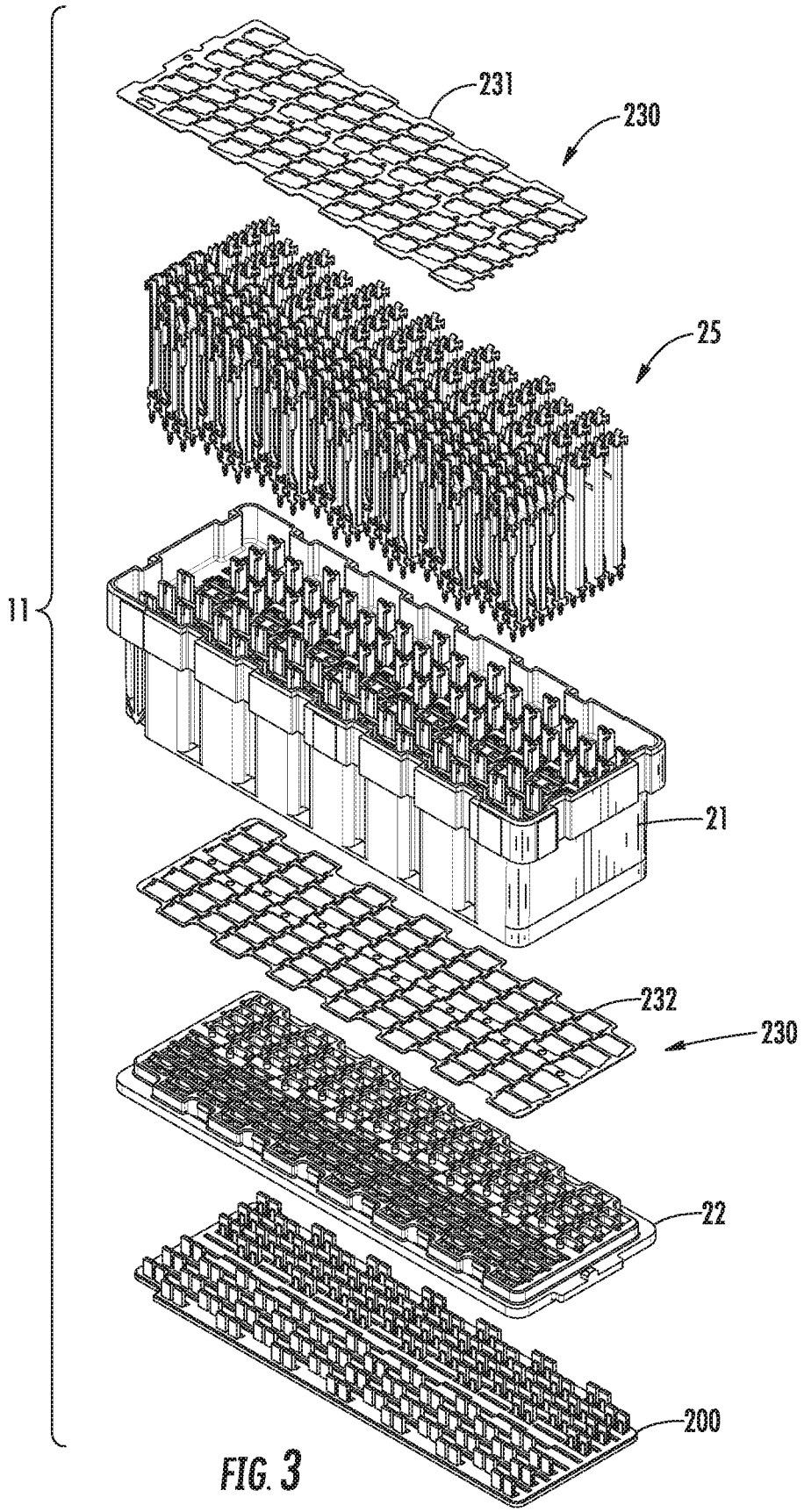
FIG. 3 illustrates an exploded perspective view of one of the connectors of the connector system of FIG. 1.
Figure 4:
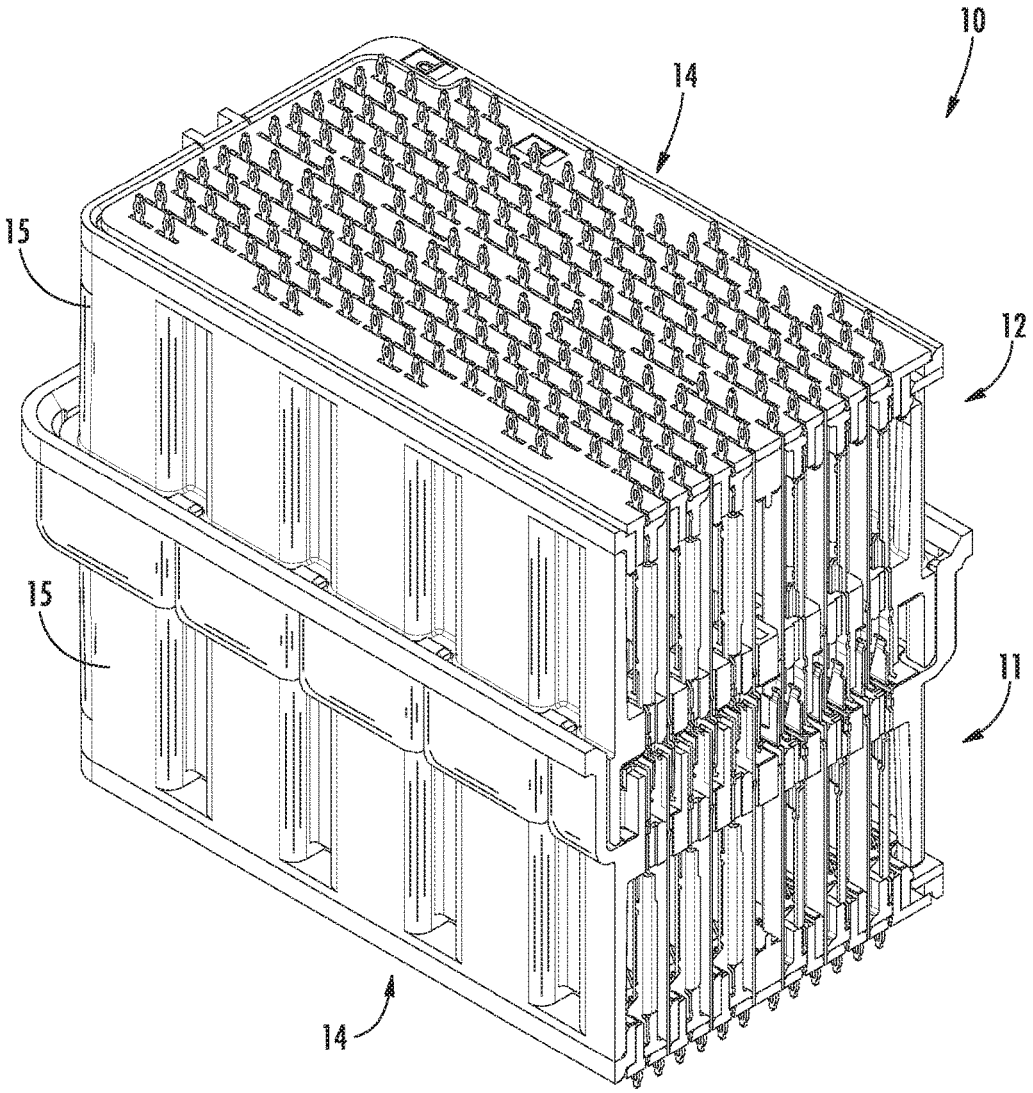
FIG. 4 illustrates a perspective view of a cross-section of the connector system of FIG. 1 taken generally along line 4-4 of FIG. 1.

Referring to FIG. 3, first connector 11 has a housing 20 that may be formed of a dielectric or insulative material having a first or upper housing component 21 and a second or lower housing component 22 that is secured to the upper housing component. As used herein, "upper" and other similar terms refer to the orientation depicted in the drawings for purposes of this description only and thus refer to proximity to the mating face 13 while "lower" and other similar terms refer to proximity to the mounting face 14. It will be appreciated that the connectors and the circuit members to which they are mounted may be positioned in any orientation.

A plurality of terminals 25 are positioned within the housing 20. A lock plate 200 is mounted to the lower housing component 22 and operates to secure or lock at least some of the terminals 25 within the housing 20. First connector 11 may include one or more ground plates 230. For example, an upper ground plate 231 may be positioned generally adjacent an upper or mating portion of the terminals 25. A lower ground plate 232 may be positioned between the upper housing component 21 and the lower housing component 22 and generally adjacent a central or lower portion of the terminals 25.

Figure 5:
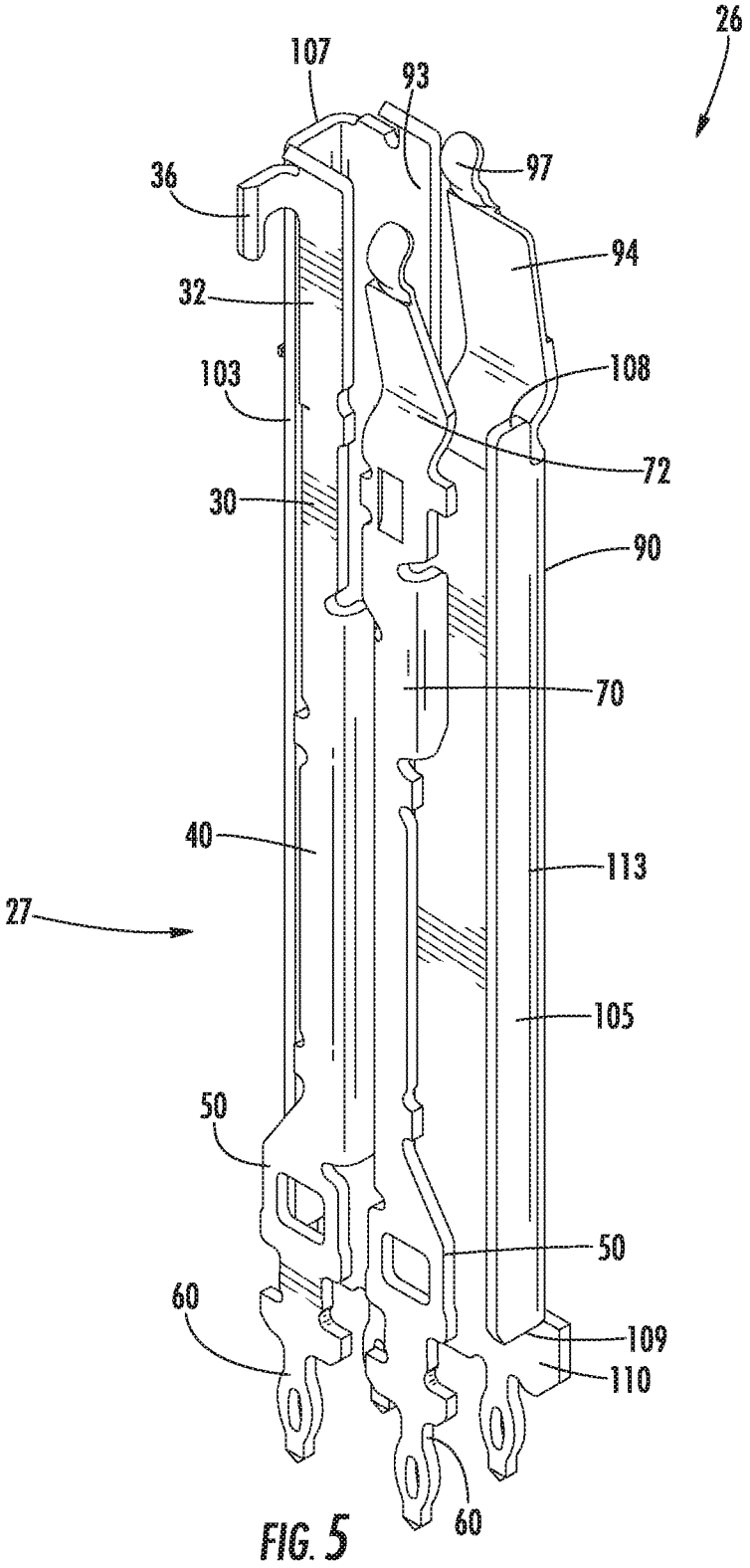
FIG. 5 illustrates a perspective view of an embodiment of a group of terminals.
Figure 6:
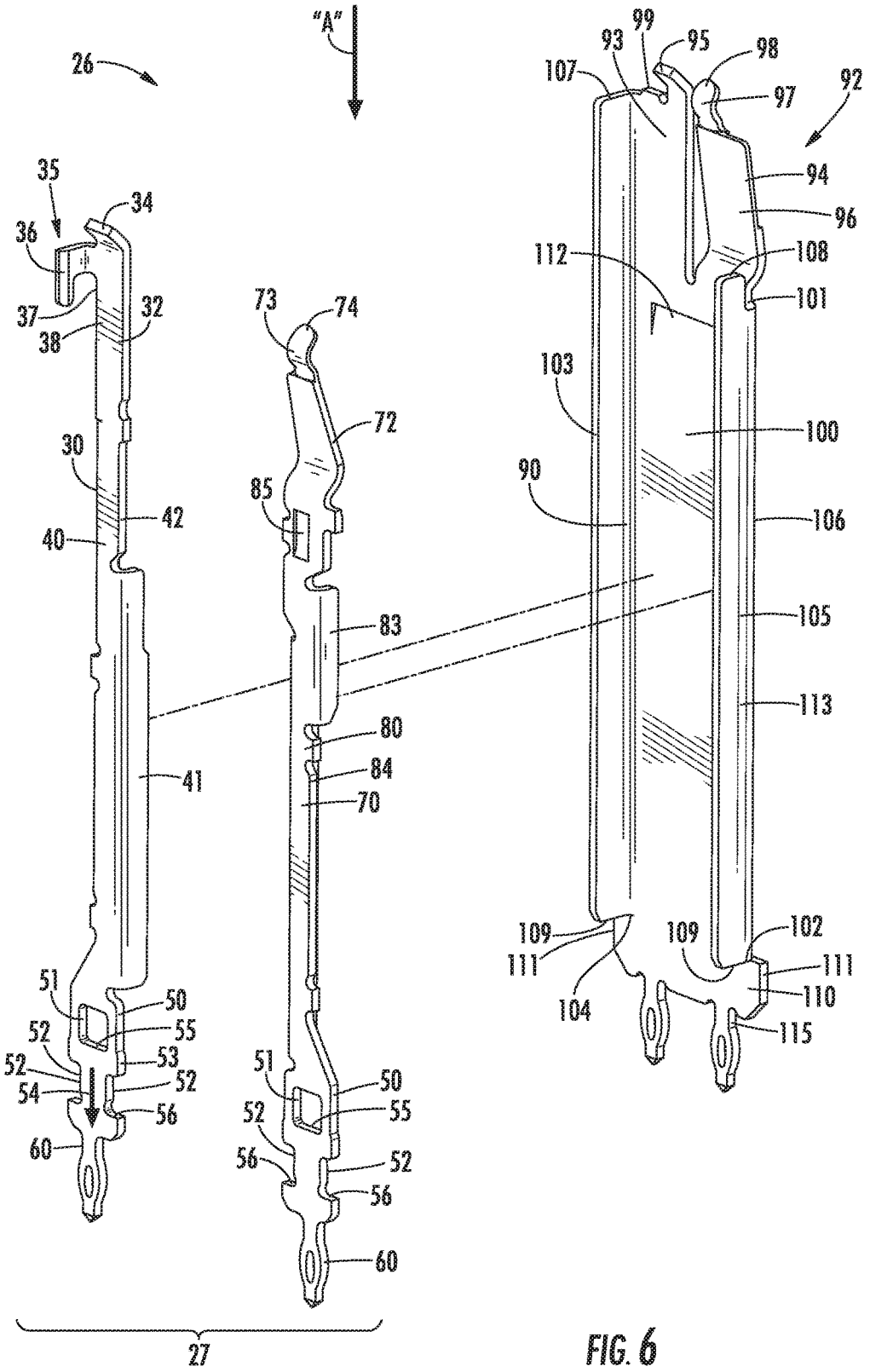
FIG. 6 illustrates an exploded perspective view of the group of terminals of FIG. 5.
Figure 7:
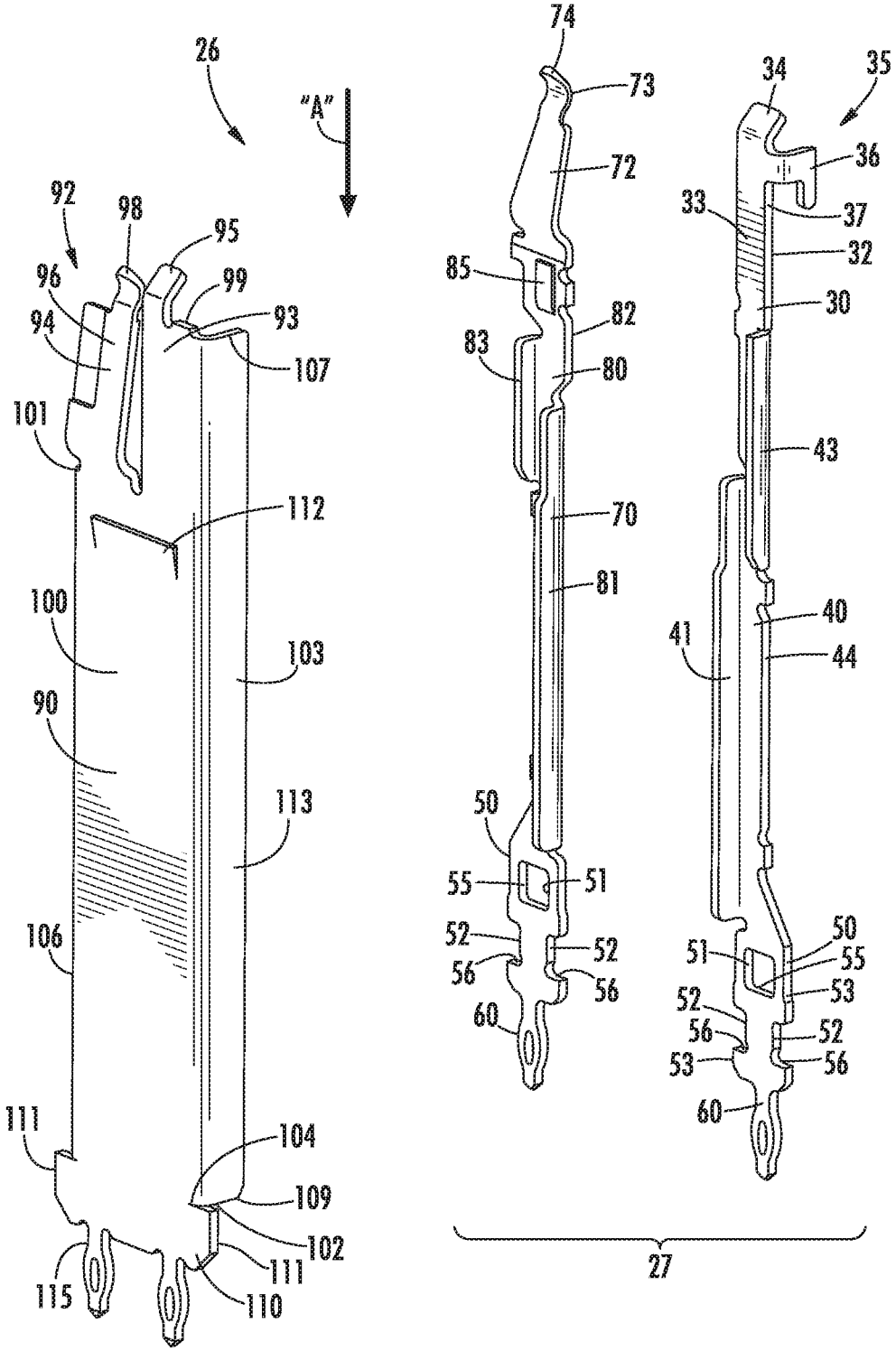
FIG. 7 is similar to FIG. 6 but the group of terminals is rotated 180°.

Referring to FIGS. 5-7, the plurality of terminals 25 are configured as an array whereby the terminals of the first connector 11 are matable with the terminals of the second connector 12. Each array includes a plurality of groups 26 of terminals 25 with each group configured as a pair 27 of signal terminals together with a reference or ground terminal 90 to form a triplet of terminals. Each pair 27 of signal terminals includes a male or blade terminal 30 and a female or receptacle terminal 70.

Figure 8:
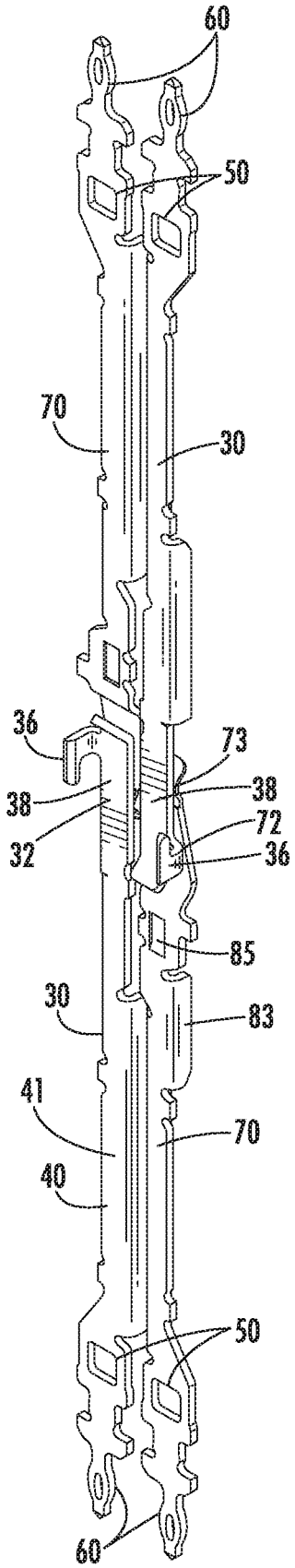
FIG. 8 illustrates a perspective view of two mated pairs of signal terminals of the group of terminals of FIG. 5.
Figure 9:
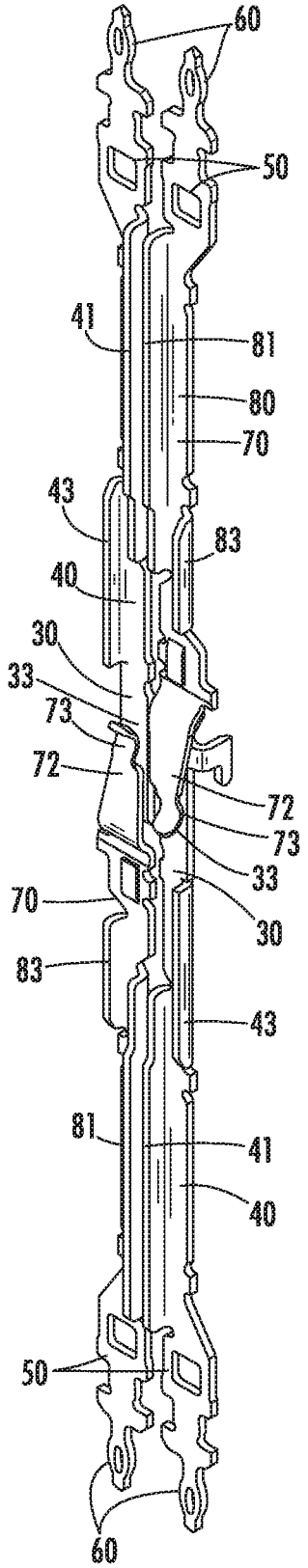
FIG. 9 is similar to FIG. 8 but with the mated pairs of signal terminals rotated 180°.
Figure 10:
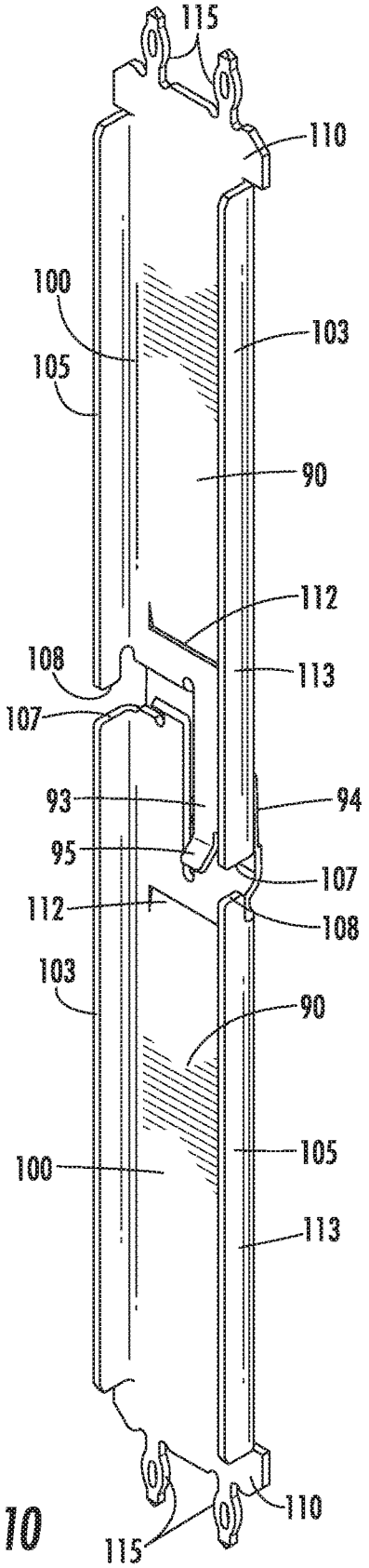
FIG. 10 illustrates a perspective view of a mated pair of ground terminals of the group of terminals of FIG. 5.
Figure 11:
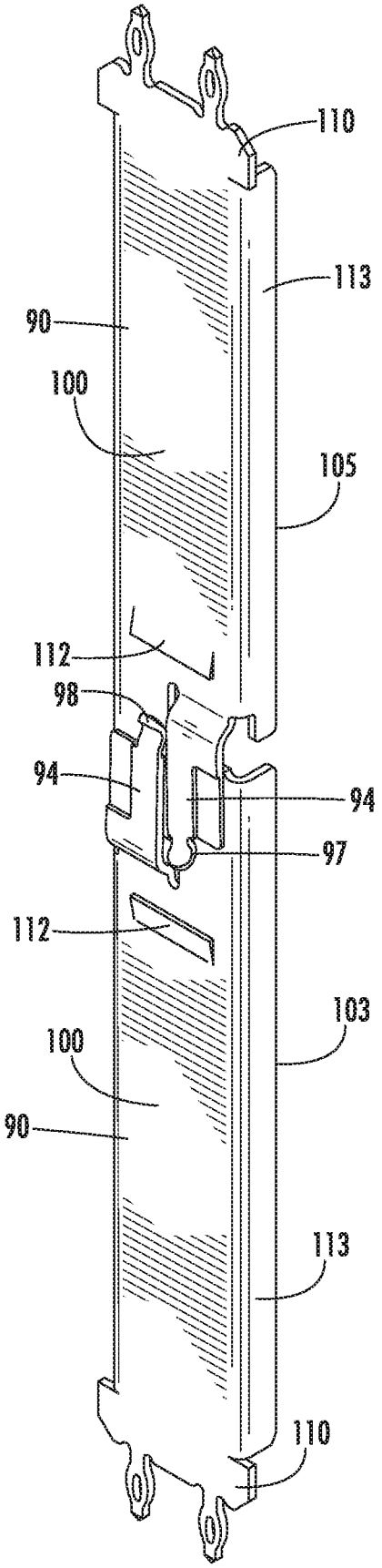
FIG. 11 is similar to FIG. 10 but with the mated pair of ground terminals rotated 180°.
Figure 12:
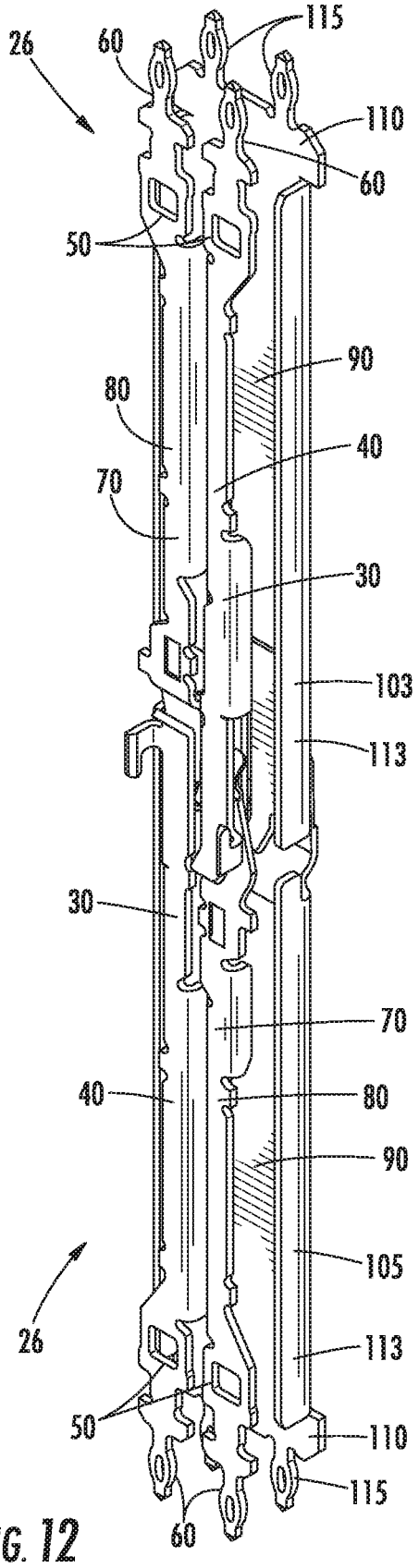
FIG. 12 illustrates a perspective view of two mated groups of terminals.

The male terminal 30 of each group 26 of terminals is configured to mate with a female terminal 70 of a mating group of terminals. Similarly, the female terminal 70 of each group 26 of terminals is configured to mate with a male terminal 30 of a mating group of terminals. FIGS. 8-9 depict a pair of male and female terminals 30, 70 of one group 26 mated with a second pair of male and female terminals from a mating group but with the ground terminals removed for clarity. The ground terminal 90 of each group 26 of terminals is configured to mate with a ground terminal of the mating group of terminals. In FIGS. 10-11, a pair of mated ground terminals 90 is depicted with their associated male and female terminals 30, 70 removed for clarity. FIG. 12 depicts a group 26 of terminals 25 from the first connector 11 mated with a second group of terminals from the second connector 12.

Male Terminals

Referring back to FIGS. 6-7, male terminal 30 is generally elongated and has a contact section 32 at one end with a generally planar contact surface 33 configured for engagement with a mating terminal such as one configured identically or similar to female terminal 70. The contact section 32 may include a tapered lead-in portion 34 to reduce the likelihood of stubbing during the mating process. In addition, a contact positioning projection 35 may extend from the contact section 32 to assist in accurately positioning the contact section while inserting the terminal into housing 20 and to maintain the position of the contact section once the terminal is positioned within the housing. As depicted in the drawings, contact positioning projection 35 may take the form of a generally L-shaped member or leg 36 that extends laterally or is bent from a side edge 37 of the contact section 32. In some instances, it may be desirable to stamp or blank the L-shaped leg 36 to control its tolerances and to increase its rigidity and thus improve the positioning function of the projection 35. In other words, the lateral width of the L-shaped leg 36 is equal to the thickness of the sheet metal material from which male terminal 30 is formed and the plane of the L-shaped leg extends perpendicularly to the plane of the contact section 32.

Body Section

A body section 40 extends from the contact section 32 to a locking section 50. If desired, the length of the body section 40 may be modified as desired based upon the desired height of the first connector 11. The body section 40 may include a first generally planar plate-like projection 41 for increasing the capacitive coupling between the male terminal 30 and the female terminal 70 of a signal terminal pair 27. As depicted, the first plate-like projection 41 extends from a side edge 42 of the body section 40 and is generally perpendicular to the body section. In addition, a second generally planar plate-like projection 43 may extend in a generally perpendicular manner from the opposite side edge 44 of the body section 40 to increase the capacitive coupling between the male terminal 30 and the ground terminal 90 within a group 26 of terminals 25.

Locking Section

Locking section 50 extends from the body section 40 and facilitates locking or securing the male terminal 30 within the housing 20. The locking section 50 may be generally planar and includes a centrally located square aperture or opening 51 and a pair of generally rectangular side recesses or openings 52 along the side edges 53 of the locking section 50. A central path 54 is aligned with the opening 51 and extends between the openings 52. The opening 51 includes a locking shoulder 55 that faces upwardly towards the contact section 32. Both of the side openings 52 also include an upwardly facing locking shoulder 56.

The openings 51, 52 may have other shapes and sizes, if desired. In one example, the size of the openings may be utilized to adjust or change the impedance of the male terminal 30 as desired. Inasmuch as the width of the locking section 50 is wider laterally than the rest of the terminal, without the openings 51, 52, the impedance along the terminal would generally decrease at the locking section. By adding the openings 51, 52 and by setting the size of the openings as desired, impedance discontinuities at the locking section 50 may be controlled or improved upon.

As used herein, the lateral direction such as when referring to the lateral width of a terminal or a portion of the terminal refers to the direction between and perpendicular to the lateral edges (e.g., side edges 42, 44) of the terminal. Similarly, the transverse direction refers to the direction perpendicular to the lateral direction such as a direction perpendicular to the plane of the locking section 50.

Tail Section

The tail section 60 extends from locking section 50 and is operative to electrically and mechanically interconnect the male terminal 30 to the first circuit board. The tail section 60 is depicted as a compliant pin for insertion into an electrically conductive hole (not shown) in the first circuit board but may have any desired configuration.

Female Terminal

Female terminal 70 is generally elongated and has a deflectable contact section 72 at one end with a generally arcuate or curved contact surface 73 for mating with or engaging a mating terminal such as one configured identically or similar to male terminal 30. A tapered lead-in section 74 is provided to assist in guiding the female terminal 70 and to reduce the likelihood of stubbing the female terminal during the mating process.

Body Section

A body section 80 extends from the contact section 72 to a locking section 50. As described above with respect to the male terminal 30, the length of the body section 80 may be modified as desired based upon the desired height of the first connector 11. The body section 80 may include a first generally planar plate-like projection 81 for increasing the capacitive coupling between the male terminal 30 and the female terminal 70 of a signal terminal pair. As depicted, the first plate-like projection 81 extends from a side edge 82 of the body section 80 and is generally perpendicular to the body section. In addition, a second generally planar plate-like projection 83 may extend in a generally perpendicular manner from the opposite side edge 84 of the body section 80 to increase the capacitive coupling between the female terminal 70 and the ground terminal 90 within a group 26 of terminals 25. A locking or positioning projection 85 may extend generally perpendicularly from a planar surface of the body section 80 generally adjacent the contact section 72 to assist in securing the female terminal 70 within housing 20.

Locking Section

Locking section 50 extends from the body section 80 and is configured and operates in the same manner as the locking section of male terminal 30 and thus the description thereof is not repeated. In addition, female terminal 70 includes a tail section 60 that extends from the locking section 50 and is configured and operates in the same manner as the tail section of the male terminal 30 and thus the description thereof is not repeated.

Ground Terminal

Ground terminal 90 is relatively wide and elongated and has a generally U-shaped cross-section. Ground terminal 90 has a hermaphroditic contact section 92 at one end that includes a generally planar male contact section 93 and a deflectable female contact section 94 generally parallel to and positioned alongside or spaced laterally from the male contact section 93 relative to the mating axis "A." The male contact section 93 may include a tapered lead-in section 95 for guiding a mating female contact section 94 and to reduce the likelihood of stubbing during the mating process. The female contact section 94 may include a deflectable beam 96 with a generally arcuate or curved contact surface 97 for engagement with the male contact section 93 of a mating ground terminal 90. A tapered lead-in section 98 may be provided to assist in guiding the female contact section 94 and to reduce the likelihood of stubbing the female contact section during the mating process.

Body Section

Ground terminal 90 includes an elongated generally U-shaped body section 100 with a first end 101 that extends from the contact section 92 and a second end 102 adjacent a locking section 110. As described above with respect to the male terminals 30 and female terminals 70, the length of the body section 100 may be modified as desired based upon the desired height of the first connector 11. A first rail or leg 103 extends along a first edge 104 of the body section 100 from the first end 101 to the second end 102 and further extends from the first end to the end 99 of the male contact section 93. A second rail or leg 105 extends along a second edge 106 of the body section 100 from the first end 101 to the second end 102.

Rails

The first rail 103 includes a first upper surface 107 generally adjacent lead-in section 95 of the male contact section 93 and the second rail 105 includes a second upper surface 108 slightly above (towards the mating end of ground terminal 90) the first end 101 of the body section 100. The first upper surface 107 and the upper surface 108 may be configured with any desired shape (such as the flat shape depicted) and may be engaged by a tool (not shown) during the process of inserting the ground terminals 90 into housing 20 and mounting first connector 11 on a circuit member. With such a configuration, the first upper surface 107 and the second upper surface 108 are positioned a different distance from the mating end of the ground terminal 90 along the mating axis "A." The tool is configured to compensate for the difference in distances so that ground terminal is pushed in a straight manner. The first rail 103 and the second rail 105 include lower surfaces 109 that are aligned along the mating axis "A."

Locking Section

Ground terminal 90 may be secured within the housing 20 in any desired manner. For example, an upper locking projection or barb 112 may extend from the body section 100 to assist in securing the ground terminal 90 within the upper component 21 of housing 20. The upper locking projection 112 is depicted as extending from the body in a direction opposite but generally parallel to the rails 103, 105. In addition, a locking section 110 may extend from the body section 100 and include barbs 111 at opposite sides thereof for engaging or skiving into the lower component 22 of housing 20 to secure the around terminal 90 therein.

Tail Section

A tail section 115 extends from the locking section 110 and is operative to electrically and mechanically interconnect the ground terminal 90 to the first circuit board. The tail section 115 is depicted as a pair of compliant pins for insertion into electrically conductive holes (not shown) in the first circuit board but may have any desired configuration.

Male terminal 30, female terminal 70, ground terminal 90 may be made of any desired conductive material. In one example, the terminals may be stamped and formed from sheet metal.

Housing

Figure 13:
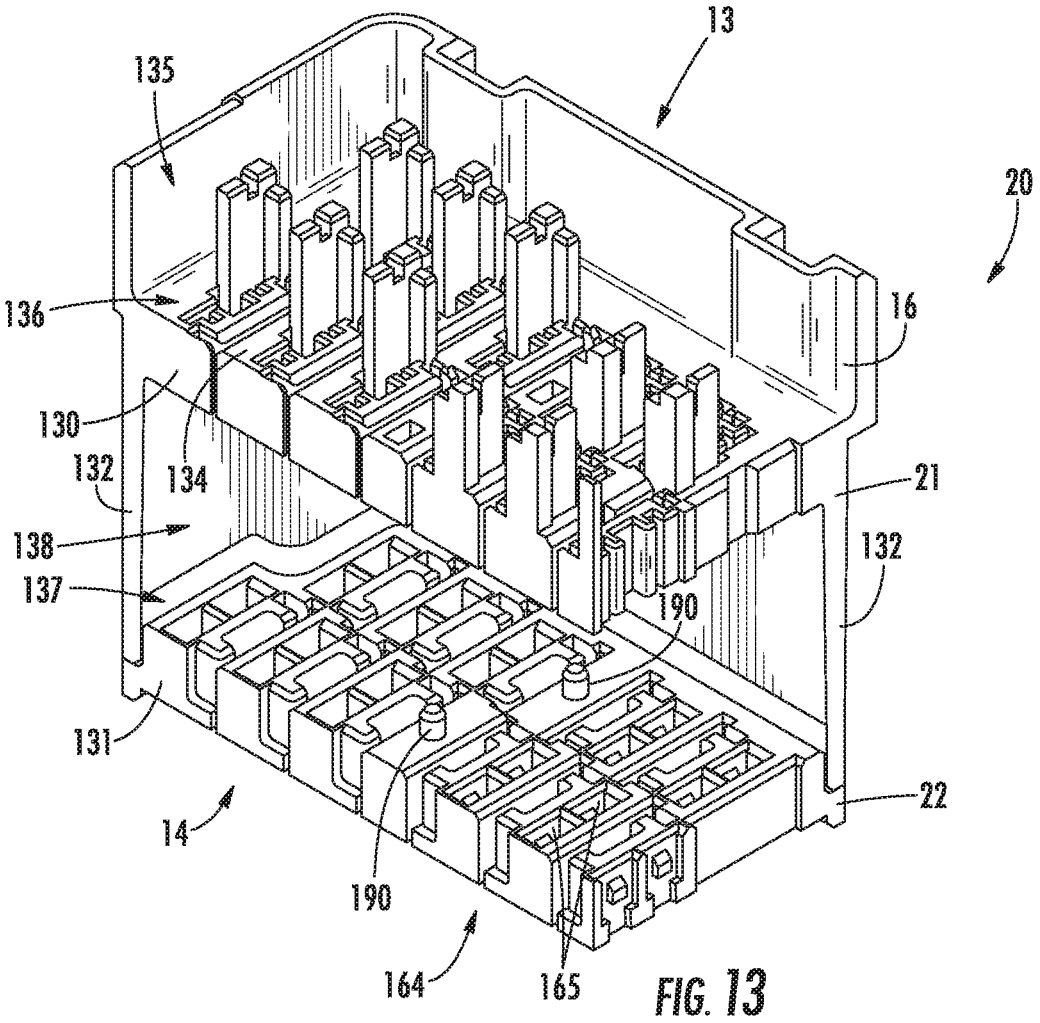
FIG. 13 illustrates a perspective view of a cross-section of a portion of an embodiment of a connector housing.

Referring to FIG. 13, housing 20 has an upper support wall 130 generally adjacent the mating face 13 of the first connector 11 for supporting upper portions of the terminals 25 and a lower support wall 131 generally adjacent the mounting face 14 and spaced from the upper support wall. The housing has sidewalls 132 that extend between and connect the upper support wall 130 and the lower support wall 131 along the outer edges or perimeter of the connector. A mating area at which contact sections 32, 72, 92 of the terminals 30, 70, 90 are located is positioned above or towards the mating face 13 relative to the upper support wall 130. More specifically, the contact sections 32, 72, 92 are positioned between the upper surface 134 of the upper support wall 130 and the mating face 13.

Terminal Receiving Cavities

Housing 20 includes a plurality of terminal receiving openings or cavities 135 that extend through the upper surface 134 of upper support wall 130 and are operative to receive and support the groups 26 of terminals 25. Each terminal receiving cavity 135 may include an upper section 136 within upper support wall 130 for supporting the terminals 25 generally below their contact sections, a lower section 137 within lower support wall 131 for supporting the terminals generally adjacent their locking sections, and a central section 138 between the upper section and the lower section.

As depicted, the housing 20 is formed of the upper housing component 21 and the lower housing component 22 with the upper section 136 and the central section 138 of each cavity 135 located in the upper housing component and the lower section 137 of each cavity 135 located in the lower housing component. Other configurations are contemplated. For example, the central section 138 may be located in the lower housing component 22 or within a separate component.

Figure 14:
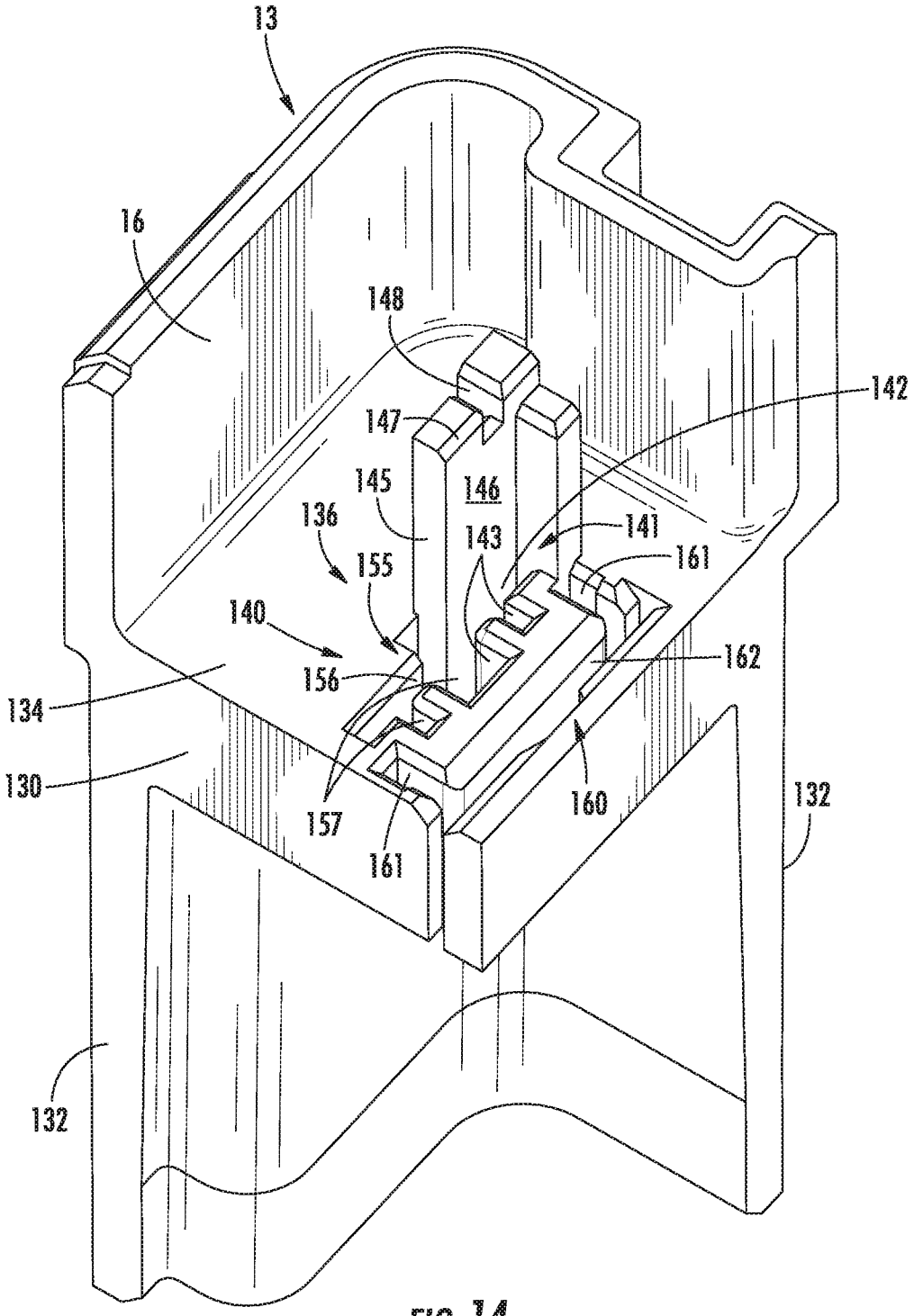
FIG. 14 illustrates an enlarged perspective view of a cross-section of an upper portion of the connector housing of FIG. 13.
Figure 15:
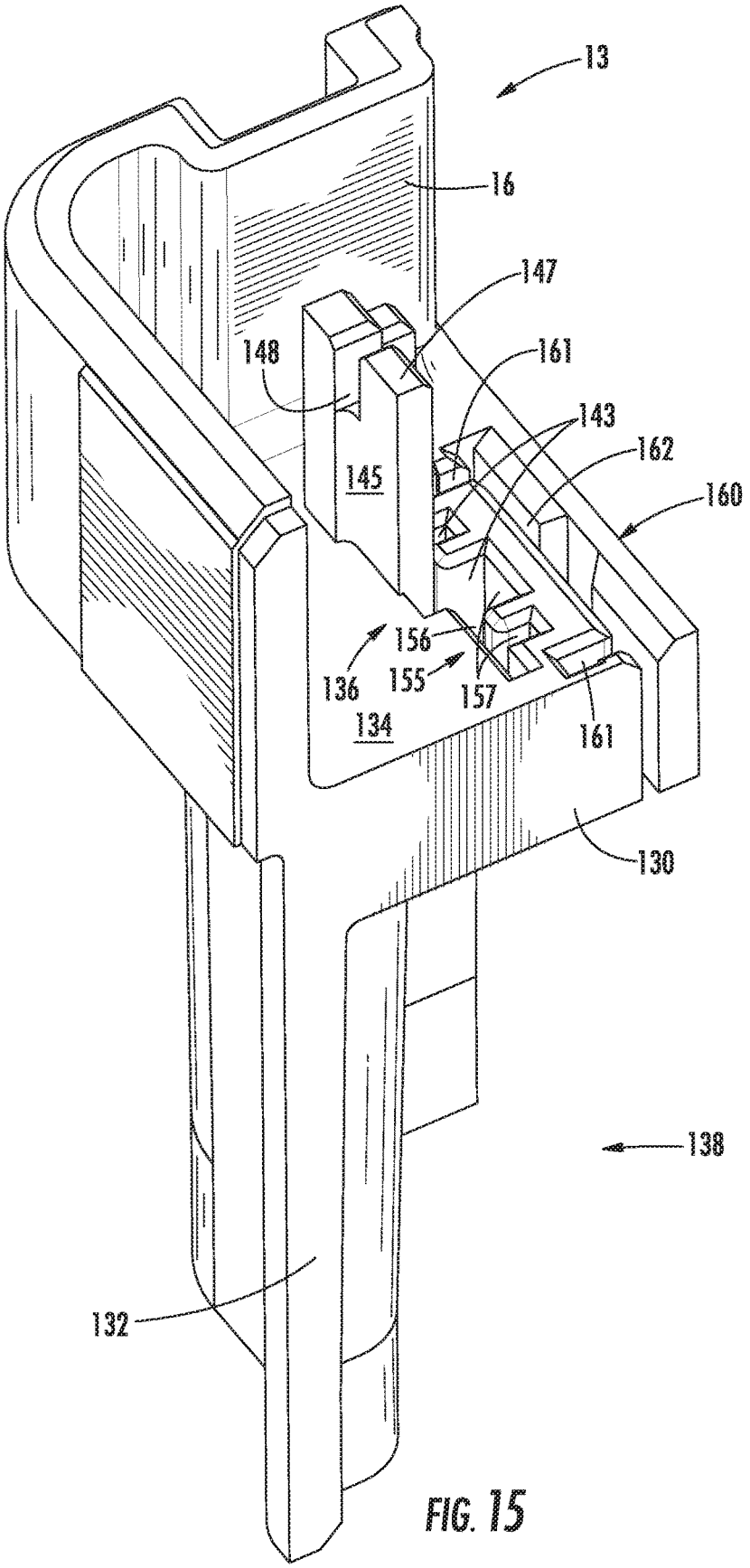
FIG. 15 illustrates an enlarged perspective view of a cross-section of the upper portion of the connector housing of FIG. 14 but with the housing rotated 90°.
Figure 16:
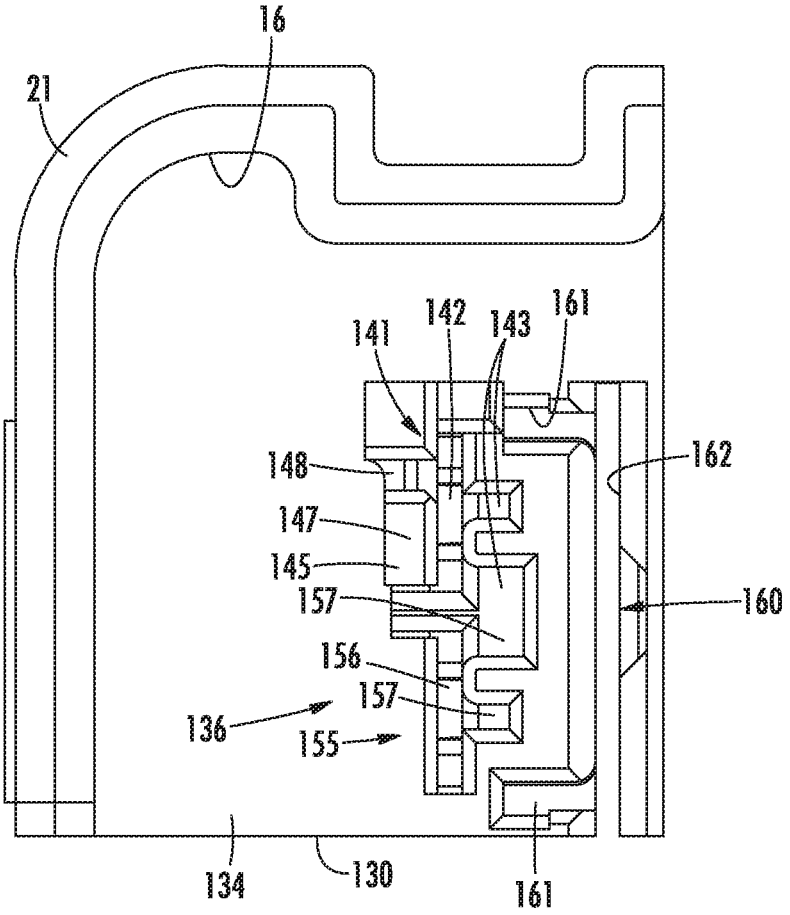
FIG. 16 illustrates a plan view of the upper portion of the connector housing of FIG. 14.

Referring to FIGS. 14-16, the upper section 136 of cavity 135 includes groups 140 of three openings for receiving each group 26 of terminals 25. UPPER MALE. A first opening is configured as a male terminal receiving opening 141 having a cross-section configured to generally match the cross-section of the body section 40 of the male terminal 30 and to permit a portion of the body section, the locking section 50, and the tail section 60 of the male terminal to pass through the opening. More specifically, the opening 141 includes a generally straight section or slot 142 through which the locking section 50 and the tail section 60 may pass and a pair of spaced apart slots 143 that intersect with and are generally perpendicular to the slot 142 and are dimensioned to permit the plate-like projections 41, 43 to pass therethrough. Since the locking section 50 may be wider than the body section 40 of male terminals 30, the spaced apart slots 143 are not positioned at the ends of the slot 142. If the body section 40 were wider, the distance between and the position of the spaced apart slots 143 would be adjusted.

Male Support Projection

The housing 20 may also include a male terminal support projection 145 that extends along or adjacent the slot 142 and has a generally planar support surface 146 configured so that the surface 38 of the contact section 32 opposite the contact surface 33 engages and is supported by surface 146 of the support projection. The support projection 145 extends away from the slot 142 (and upper surface 134 of upper support wall 130) a sufficient distance (i.e., has a length) so that the side of the lead-in portion 34 of male terminal 30 opposite the surface that engages a mating terminal may engage and be supported by the end surface 147 of the support projection.

Figure 17:
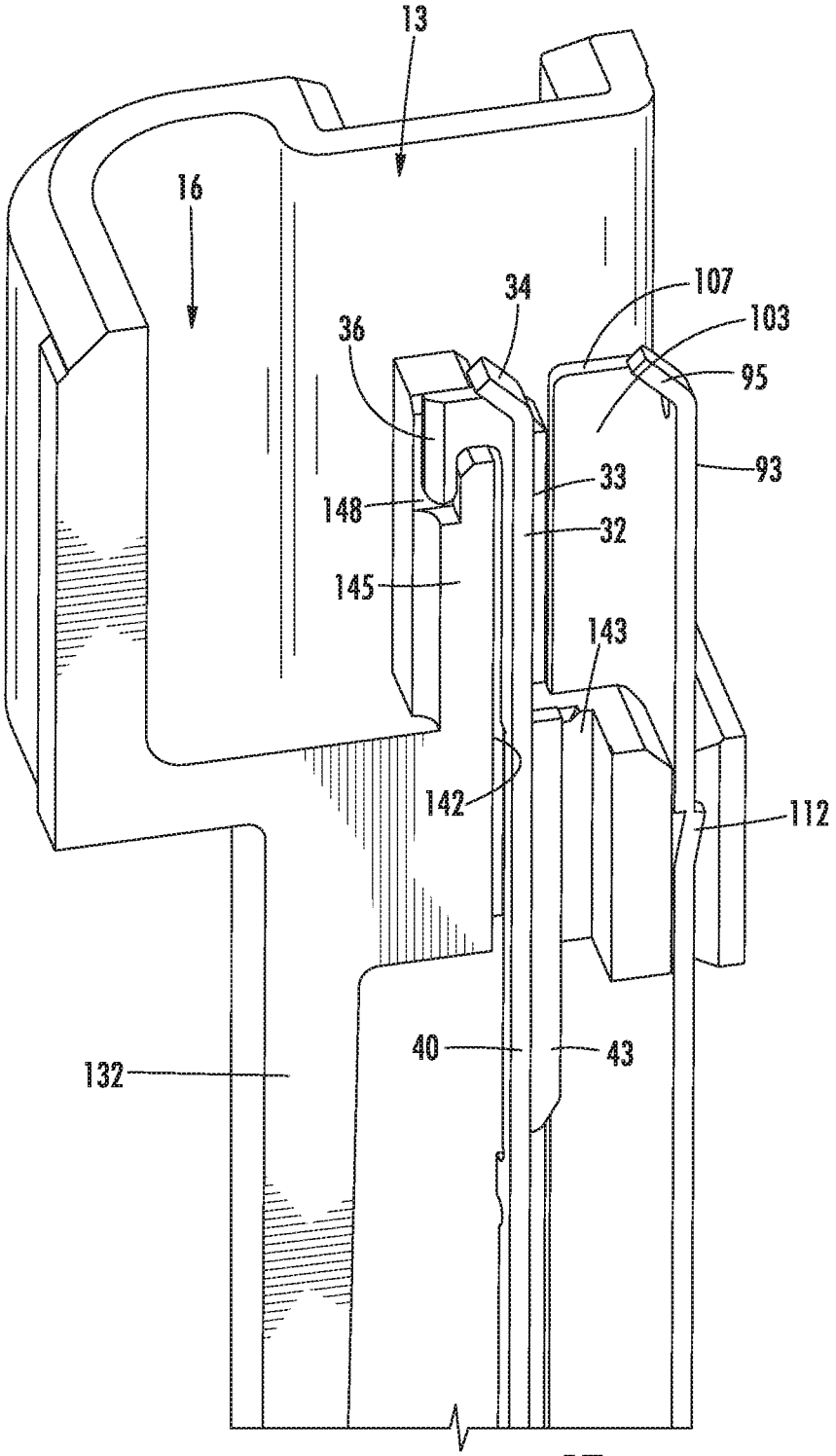
FIG. 17 illustrates an enlarged perspective view of a cross-section similar to FIG. 15 but with the cross-section at a different location and a male terminal and a ground terminal inserted into the housing.

The terminal support projection 145 may be wider than the lateral width of the contact section 32 of the male terminal 30 and may be L-shaped for additional strength. In addition, the terminal support projection 145 may include a contact positioning recess or slot 148 that extends a predetermined distance into the end surface 147. The contact positioning slot 148 may be dimensioned to receive the L-shaped leg 36 that functions as the contact positioning projection 35 to precisely position and retain the contact section 32 of the male terminal 30 (FIG. 17).

The interaction of the male terminal support projection 145 with the contact section 32 and the contact positioning slot 148 with the L-shaped leg 36 permits the male terminal 30 to be formed of relatively thin material (e.g., approximately 0.005 inches thick) while maintaining the desired operating characteristics and positioning tolerances of the contact section of the male terminal. For example, by securing the L-shaped leg 36 within the contact positioning slot 148, movement of the contact section 32 is reduced or prevented along six directions or degrees of movement. More specifically, movement along x, y, z axes as well as rotation about those axes is reduced or prevented, where x is a direction along the plane of the contact section 32, y is a direction generally perpendicular to the plane of the contact section 32, and z is a direction along the axis of the male terminal 30 or parallel to mating axis "A." Although described in the context of a terminal formed of sheet metal material having a thickness of approximately 0.005 inches thick, the male terminals 30 may be other thicknesses. In another example, the male terminals 30 may have a thickness of less than approximately 0.010 inches thick.

Upper Female

The upper section 136 of the cavity 135 further includes a female terminal receiving opening 155 adjacent the male terminal receiving opening 141 of each group 140 of openings. The female terminal receiving opening 155 may have a cross-section configured to generally match the cross-section of the body section 80 of the female terminal 70 and to permit a portion of the body section, the locking section 50, and the tail section 60 of the female terminal to pass through the opening.

More specifically, the opening 155 includes a generally straight section or slot 156 through which the locking section 50 and the tail section 60 may pass while establishing an interference fit with the projection 85 of female terminal 70. A pair of spaced apart slots 157 intersect with and are generally perpendicular to the slot 156 and are dimensioned to permit the plate-like projections 81, 83 to pass therethrough. As with the spaced apart slots 143 of the male terminal receiving opening 141, the spaced apart slots 157 of the female terminal receiving opening 155 may not be positioned at the ends of the slot 156 and the positions of the slots may be adjusted depending upon the configuration of the female terminals 70.

The slot 157 adjacent the slot 143 of the male terminal receiving opening 141 may be combined as a single, relatively large slot that permits the insertion of both the projection 41 of male terminal 30 and the projection 81 of female terminal 70. In addition, the male terminal receiving opening 141 and the female terminal receiving opening 155 of each group 140 of openings may be aligned so that the slot 142 of opening 141 is generally co-planar with slot 156 of opening 155.

Upper Ground

The third opening of each group 140 of three openings is configured as a generally U-shaped opening 160 that generally matches the cross-section of the body section 100 of ground terminal 90 and permits a portion of the body section, the locking section 110, and the tail section 115 of ground terminal 90 to pass through the opening. More specifically, the opening 160 includes a pair of spaced apart slots 161 connected by a generally elongated slot 162 at one edge of each of the pair of slots to form a U-shaped cross-section. The elongated slot 162 may be slightly longer than the length of the body section 100 of the ground terminal 90 to permit the barbs 111 of the locking section 110 to pass through the slot. In addition, the length of slot 162 of opening 160 may be at least as long as an axial distance from the outer edge of slot 142 of opening 141 to the opposite outer edge of opening 155. The transverse width or distance across the elongated slot 162 generally perpendicular to the lateral width may be set to establish an interference fit with the projection 112 of ground terminal 90.

Figure 19:
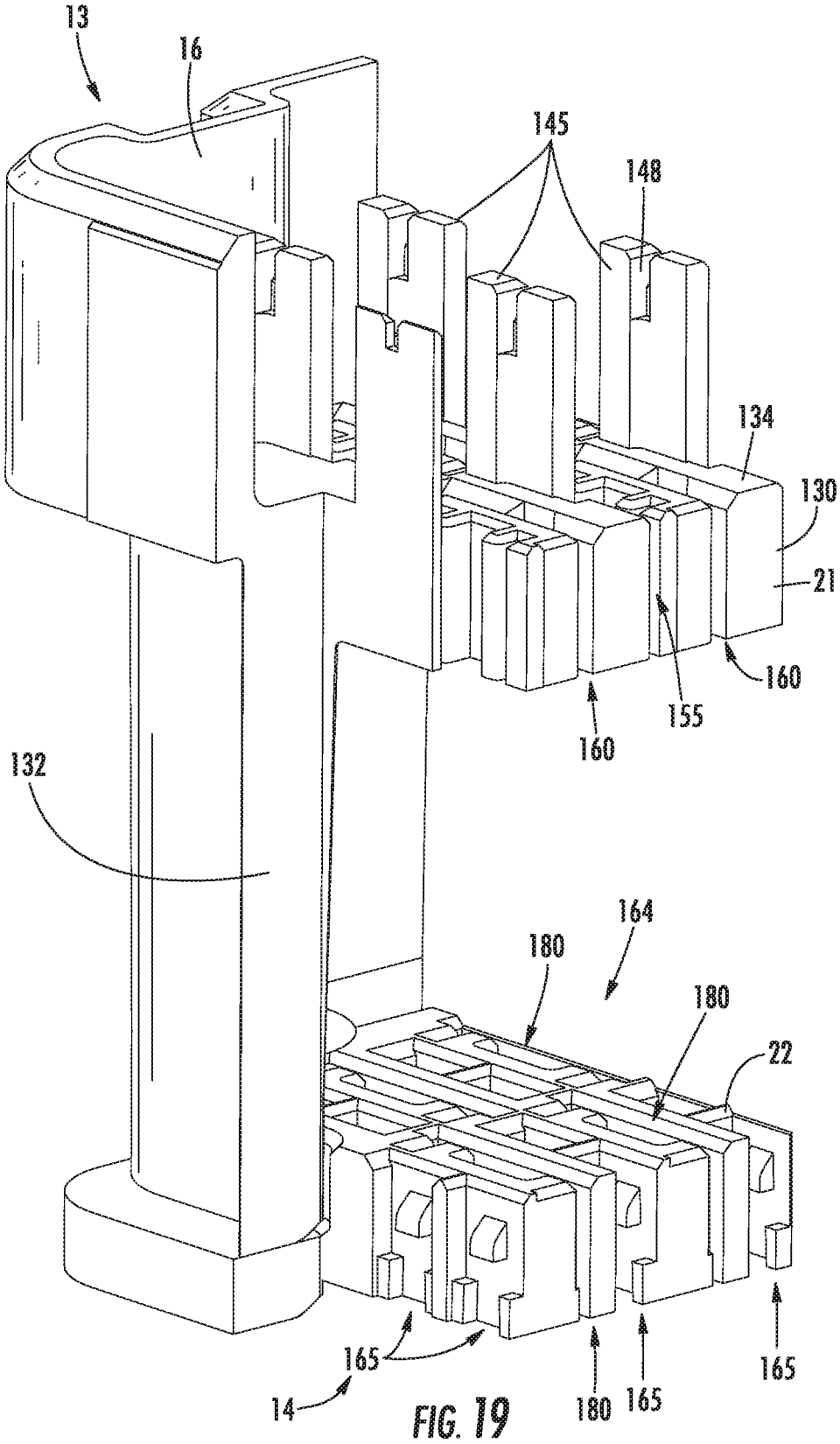
FIG. 19 illustrates a perspective view of a cross-section of a portion of an embodiment of a connector housing.
Figure 20:
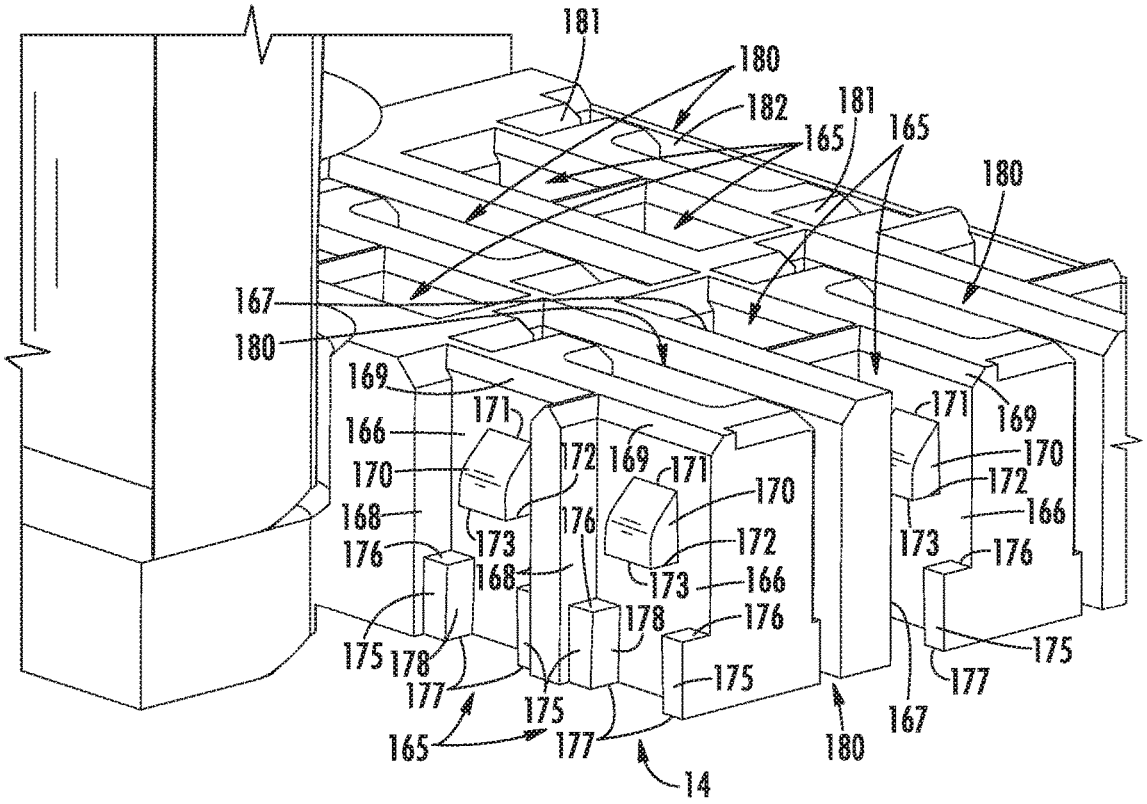
FIG. 20 illustrates an enlarged perspective view of a cross-section of the lower portion of the connector housing of FIG. 19.
Figure 21:
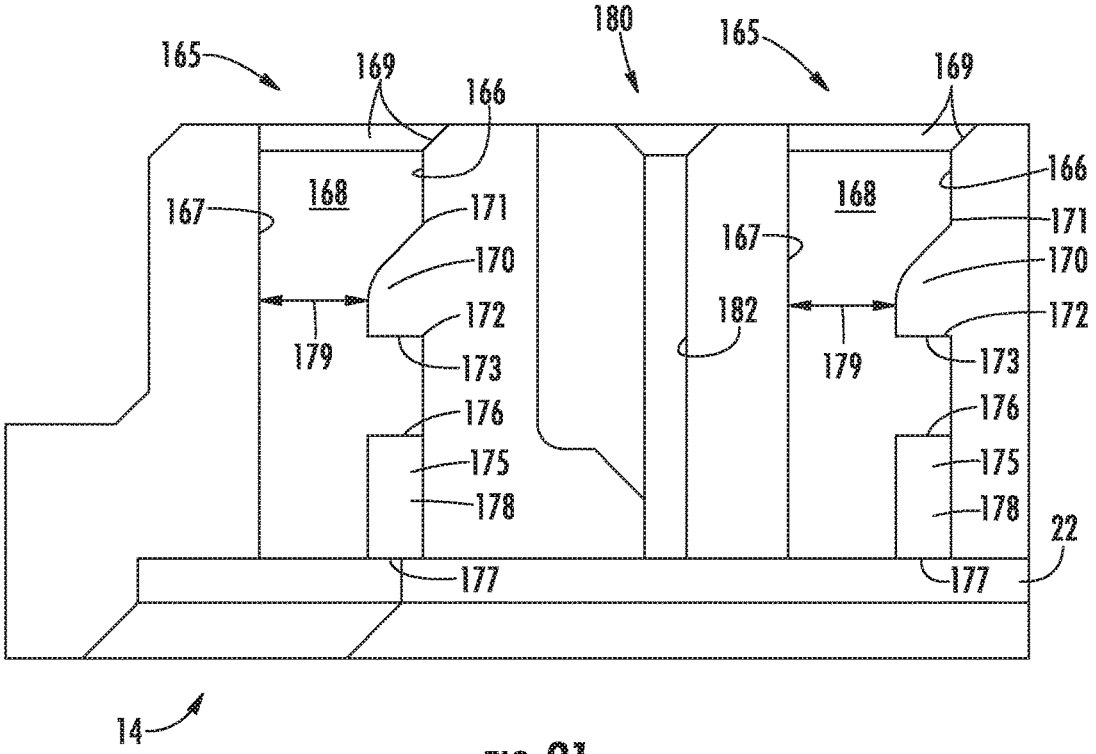
FIG. 21 illustrates a side view of the enlarged cross-section of FIG. 20.

Referring to FIGS. 19-21, the lower section 137 of each terminal receiving cavity 135 includes groups 164 of three openings for engaging each group 26 of terminals 25. LOWER SIGNAL Each group 164 of openings includes a pair of adjacent, identical signal terminal receiving openings 165. One of the openings 165 of the pair is used for receiving and securing a male terminal 30 and the other is used for receiving a female terminal 70 of a pair 27 of signal terminals. Each opening 165 is generally rectangular and has a locking surface or wall 166, an opposite end surface or wall 167, and a pair of spaced apart side surfaces or walls 168 that connect the locking wall and the end wall. In FIGS. 19-21, the opposite end wall 167 has been removed from some of the openings 165 for clarity. Each of the locking wall 166, the opposite wall 167, and the side walls 168 may have a tapered or chamfered lead-in surface 169 to guide a terminal being inserted into the opening 165.

Center Projection

A central projection 170 extends laterally from the locking wall 166 towards the opposite wall 167. The central projection 170 has a first end 171 closest to the lead-in surface 169 and a second end 172. The central projection 170 is tapered so that the first end 171 that intersects with the locking wall 166 is relatively thin or narrow while the second end 172 is spaced from the locking wall a greater distance so the projection is thicker or wider to define a lower locking surface 173 that faces the mounting face 14. The central projection 170 is dimensioned to be lockingly received within the centrally located openings 51 of an inserted male terminal 30 or female terminal 70 with the locking surface configured to engage locking shoulder 55 of terminals 30, 70 upon insertion of the terminals into the housing 20.

Side Projections

A side projection 175 extends from the intersection of the locking wall 166 with each of the side walls 168. The side projections 175 are generally rectangular and have an upper surface 176 facing the mating face 13, a lower surface 177 facing the mounting face 14, and a side surface 178 that interconnects the upper surface and the lower surface. The side projections 175 are dimensioned to be lockingly received within the side openings 52 of an inserted male terminal 30 or female terminal 70 with the lower surface 177 engaging the locking shoulder 56 of the terminals.

The shortest distance from the central projection 170 to the opposite wall 167 and from the side projections 175 to the end wall defines an insertion opening 179 (FIG. 21) into or through which the signal terminals may be inserted. The insertion opening may be any desired dimension or have any desired transverse width (i.e., between the opposite wall 167 and the projections 167, 175) provided that the signal terminal being inserted into the cavity 135 is able to pass between the projections and the opposite wall. More specifically, the distance from the central projection 170 to the opposite wall 167 is at least as great as slightly more than the thickness of the signal terminal along the central path 54 of the locking section 50 and the tail section 60 to permit the mounting portion and the tail portion to pass between the central projection and the opposite wall during insertion of the signal terminals. Similarly, the distance from the side projections 175 to the opposite wall 167 is at least as great as slightly more than the thickness of the locking section 50 adjacent the side edges 53 to permit the portion of the locking section along the side edges to pass between the side projections and the opposite wall during insertion of the signal terminals.

Lower Ground

Figure 22:
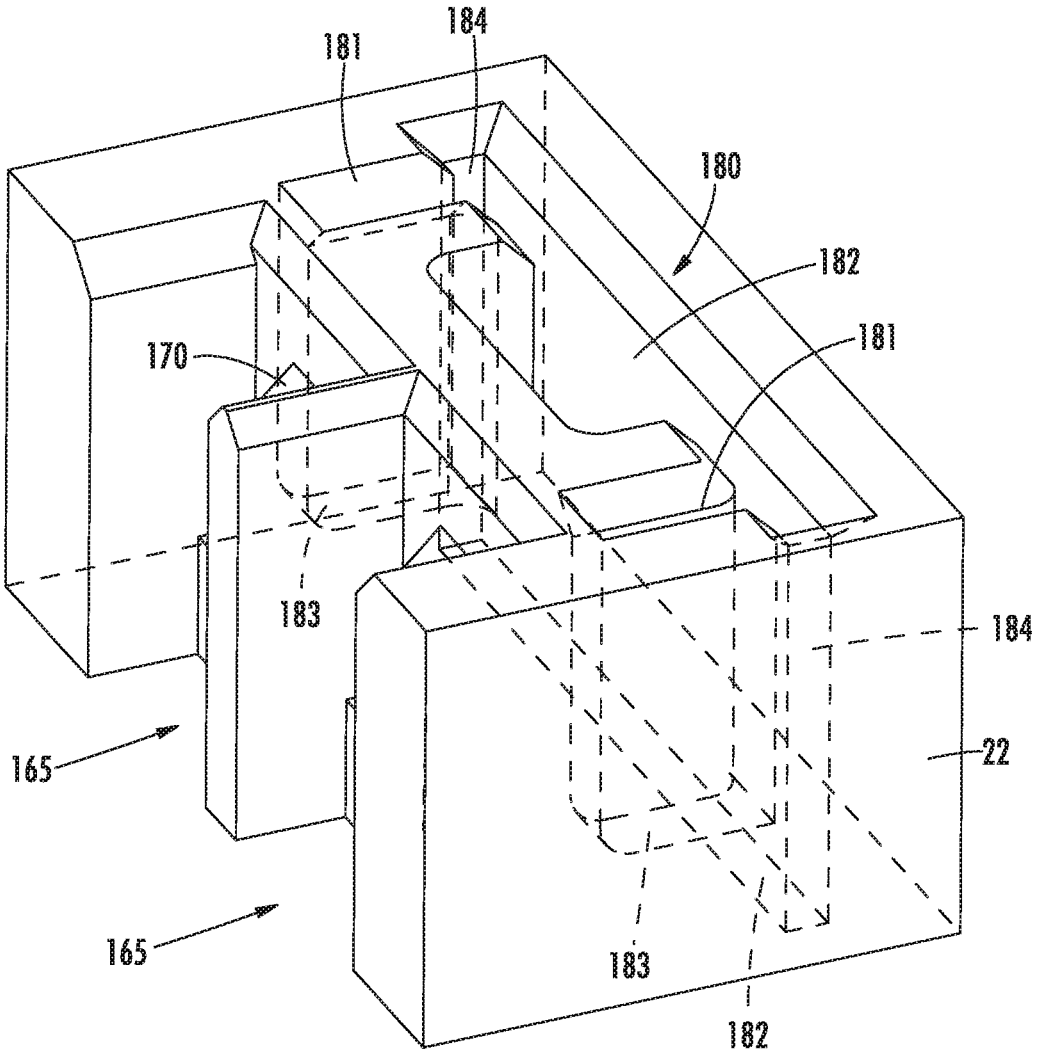
FIG. 22 illustrates an enlarged perspective view of a cross-section of a portion of an embodiment of a lower connector housing.
Figure 23:
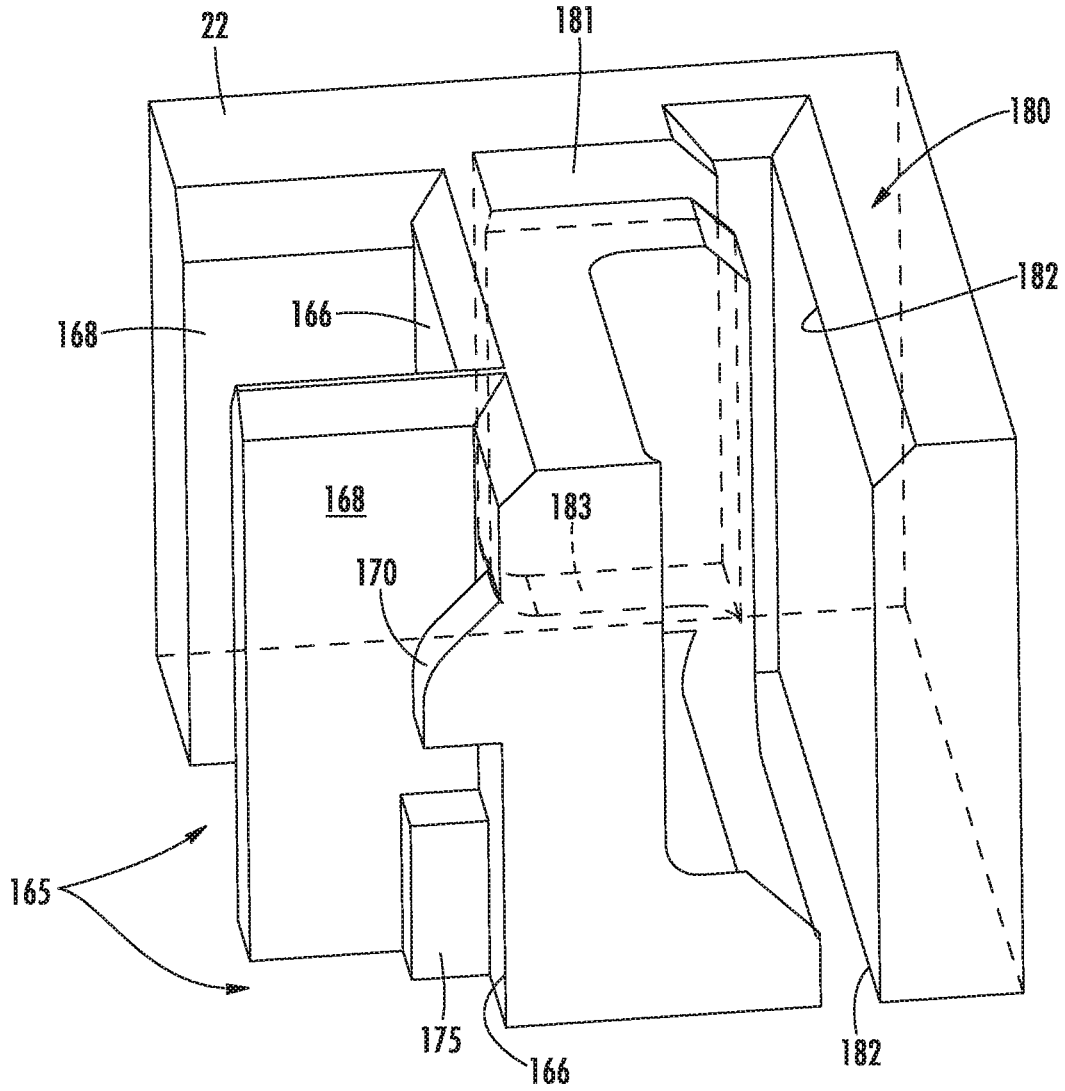
FIG. 23 illustrates an enlarged perspective view of a cross-section of the portion of the lower connector housing of FIG. 22 but taken from a different perspective.
Figure 24:
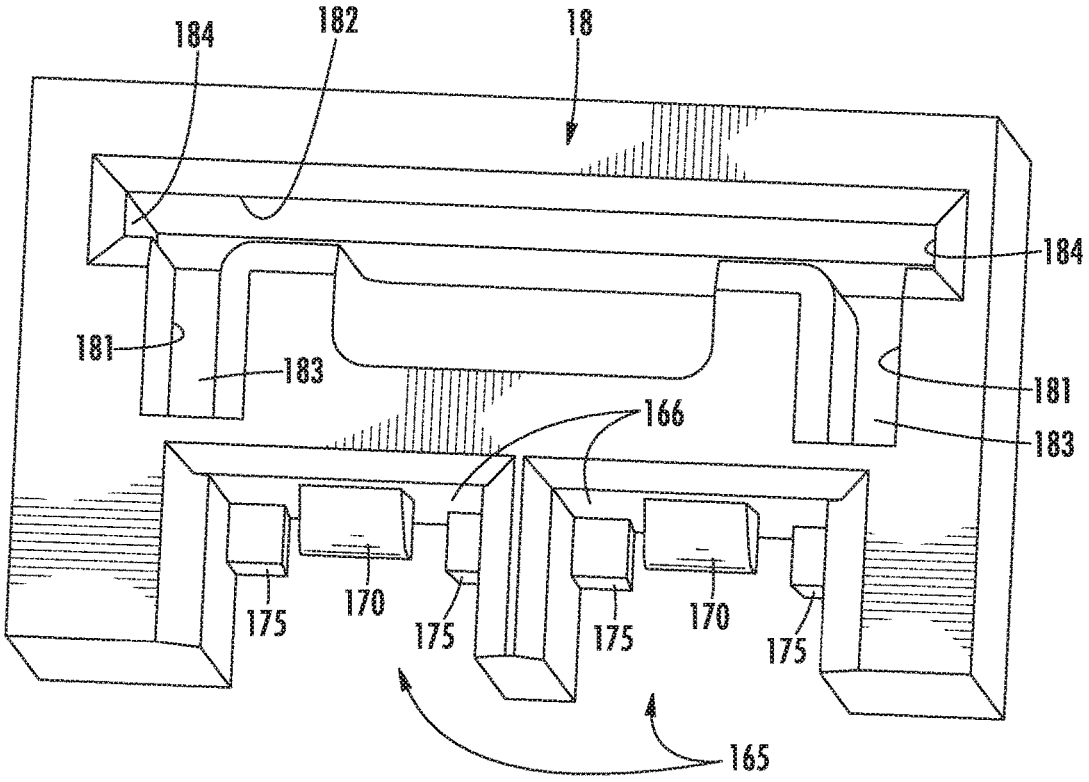
FIG. 24 illustrates an enlarged perspective view of a cross-section of a portion of the lower connector housing of FIG. 22 but taken from still another perspective.

The third opening of each group 164 of three openings is configured as a generally U-shaped opening 180 that generally corresponds to the U-shaped opening 160 within the upper section 136 of cavity 135. More specifically, referring to FIGS. 22-24, the U-shaped opening 180 includes a pair of spaced apart recesses 181 connected by a generally elongated slot 182 at one edge of each of the pair of slots.

It should be noted that the recesses 181 do not extend entirely through the lower housing component 22 and include a lower surface 183 that interacts with the lower surface 109 of the ground terminal 90 when inserting the first connector 11 into a circuit member. The elongated slot 182, however, does extend through the lower housing component 22 and is sufficiently large to permit the tail section 115 of the ground terminal 90 to pass therethrough. The elongated slot 182 may be dimensioned so that the barbs 111 of the locking section 110 engage or skive into the side edges 184 of the slot 182 in an interference fit to retain the ground terminal 90 within the housing 20.

Lock Plate

Figure 25:
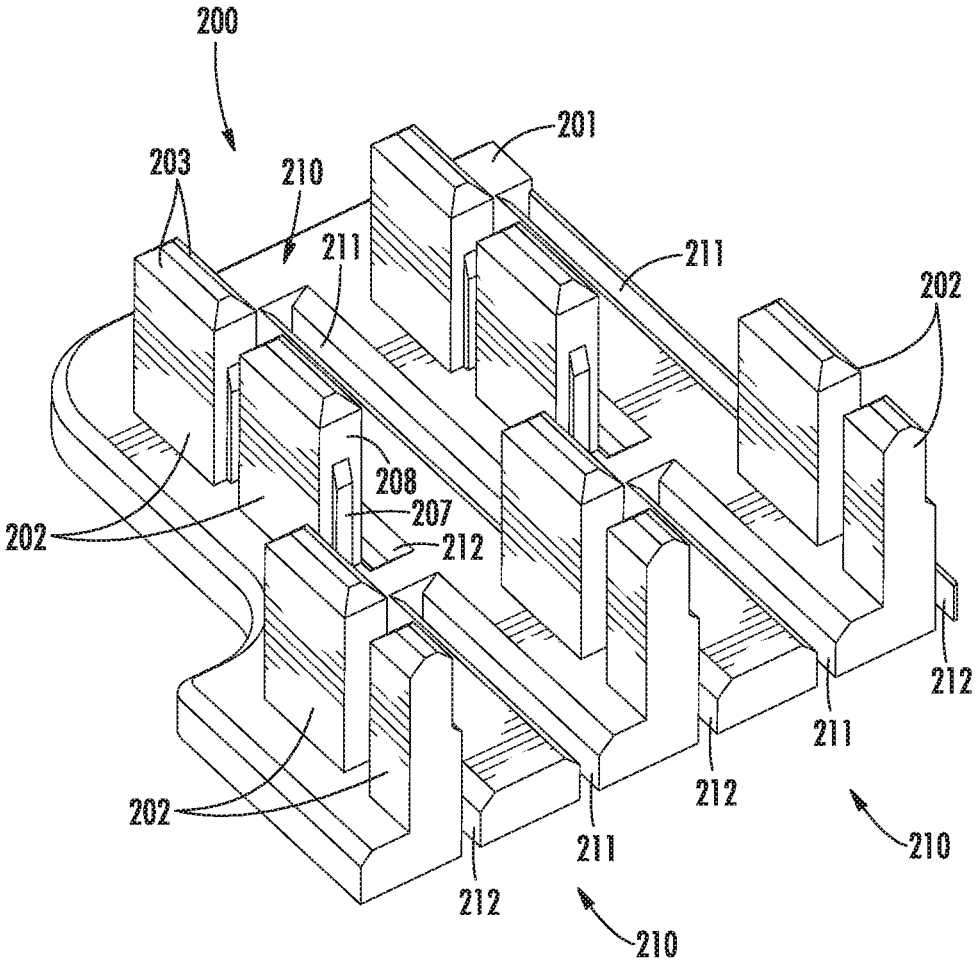
FIG. 25 illustrates an enlarged perspective view of a cross-section of a portion of an embodiment of the lock plate.
Figure 26:
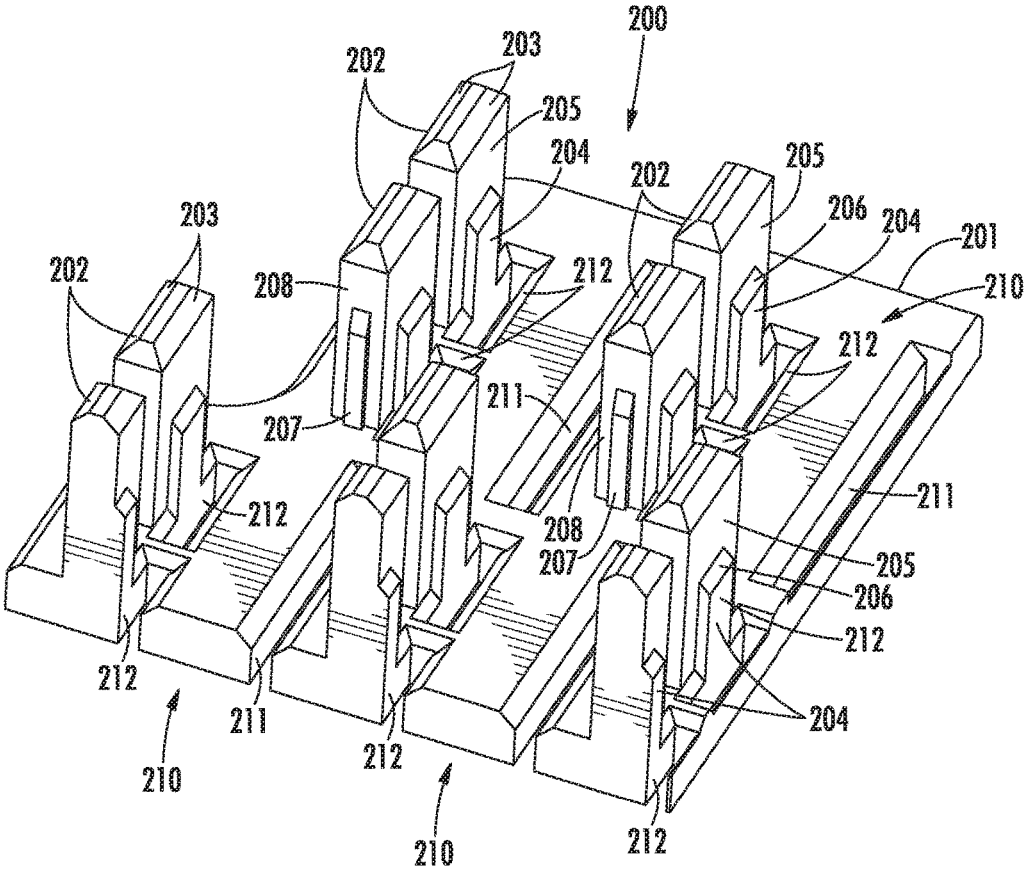
FIG. 26 illustrates an enlarged perspective view of a cross-section of the portion of the lock plate of FIG. 25 but taken from a different perspective.

Referring to FIGS. 3, 25, 26, lock plate 200 includes a generally planar base 201 with a plurality of pairs of signal terminal retention members or posts 202 extending therefrom. The signal terminal retention posts 202 are dimensioned to be received within insertion opening 179 of the lower section 137 of the signal terminal receiving cavities 135 from below the lower housing component 22. The signal terminal retention posts 202 may include a tapered or chamfered lead-in surface 203 to guide or direct a signal terminal towards locking wall 166 and direct the lock plate 200 while mounting the lock plate to the lower housing component 22. A terminal locking rib 204 may be integrally formed with and extend from the locking face 205 of each signal terminal retention post 202. The rib 204 may be dimensioned to extend upward from the base 201 with an upper surface 206 that is positioned slightly below the lower locking surface 173 of the central projection 170 when the lock plate 200 is mounted on the lower housing component 22. If desired, a lock plate locking rib 207 may extend upward from the base 201 and be integrally formed with and extend from side surfaces 208 of some or all of the posts 202.

Slots for Tails

Lock plate 200 also includes a plurality of openings through which the tail sections of the terminals may pass. More specifically, lock plate 200 includes a plurality of groups 210 of elongated slots to accommodate the tail sections of the groups 26 of terminals 25. Each group 210 of slots includes one large slot 211 dimensioned to permit the tail sections 115 of the ground terminal 90 to pass therethrough. If desired, the large slot 211 may be configured as two smaller slots (not shown) with each small slot aligned with one of the compliant pins of the tail section 115.

A pair of aligned or parallel small slots 212 are spaced laterally and parallel to the large slot 211 of a group 210 of slots. Each small slot 212 is dimensioned to permit the tail section 60 of one of the signal terminals to pass therethrough. Each small slot 212 is positioned adjacent one of the signal terminal retention posts 202.

Since the groups 26 of terminals 25 are arranged in a staggered array, the tail sections 60 of the signal terminals and the tail sections 115 of the ground terminals 90 are also arranged in a staggered array. Accordingly, when viewing the entire lock plate 200, the openings in the lock plate 200 are arranged in linear arrays with a repeating pattern of a single large slot 211 and then a pair of small slots 212. It will be understood that if the groups 26 of terminals 25 were arranged in a different configuration, the openings in the lock plate 200 would be modified accordingly.

Ground Plates

Figure 51:
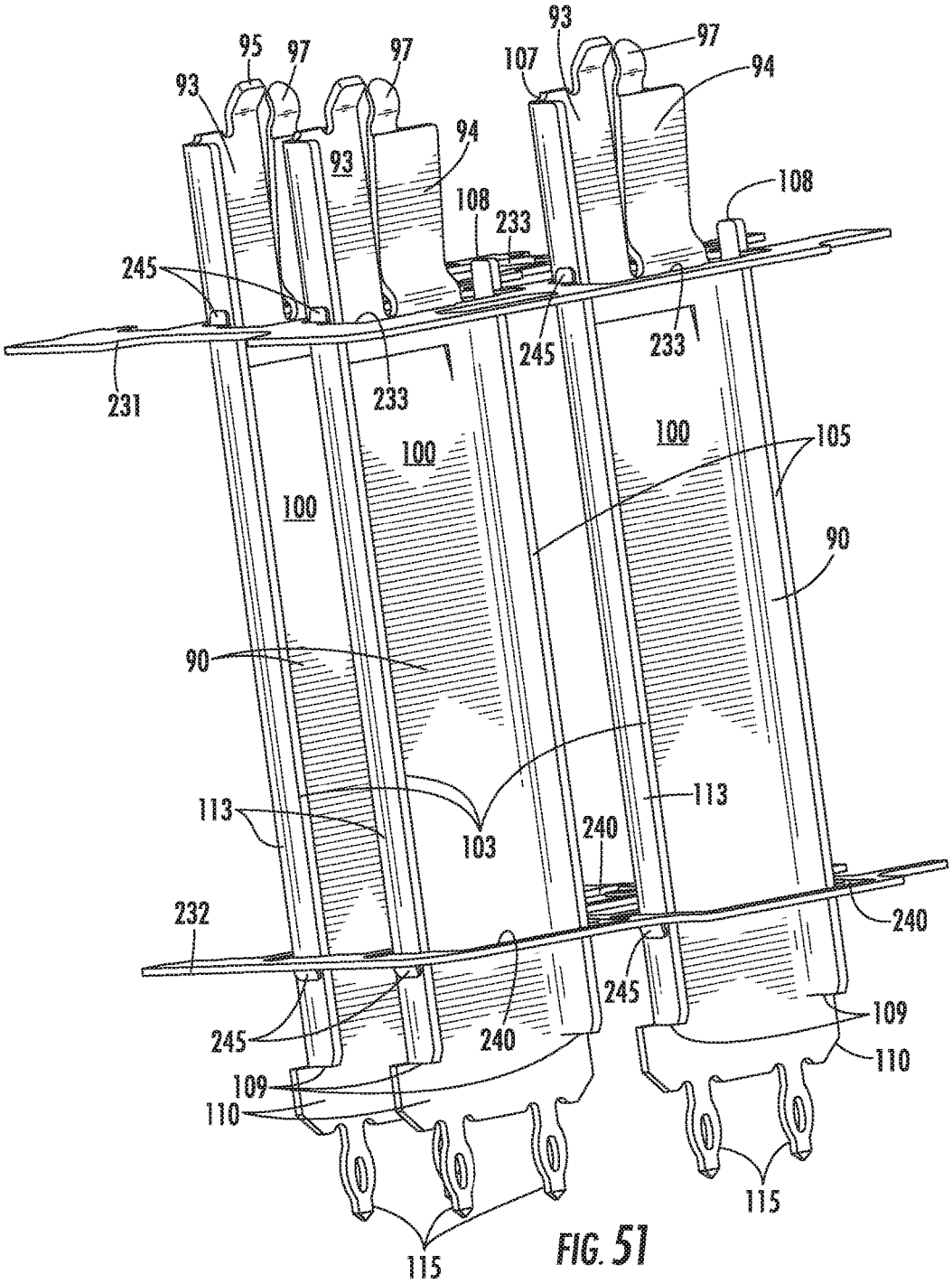
FIG. 51 illustrates an enlarged perspective view of a plurality of ground terminals interconnected to an upper ground plate and a lower ground plate with the housing and other terminals removed.

First connector 11 may include one or more ground plates 230 such as upper ground plate 231 and lower ground plate 232 (FIGS. 3, 51). The ground plates 230 operate to interconnect the ground terminals 90 at multiple locations within the first connector 11 to reduce differences between a reference voltage at the ground terminals.

Upper Ground Plate

Figure 27:
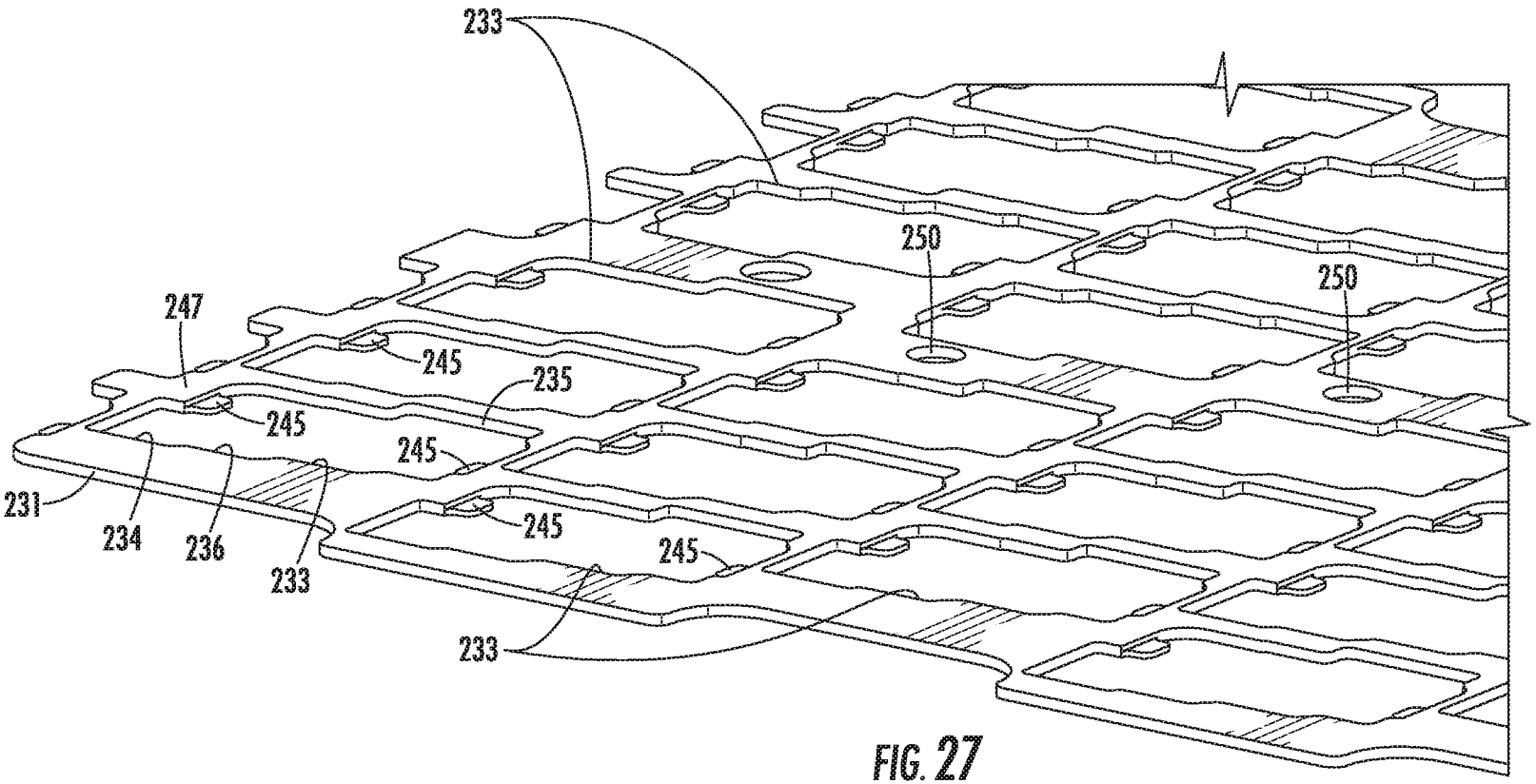
FIG. 27 illustrates an enlarged perspective view of a portion of an embodiment of the upper ground plate.

Each ground plate 230 is generally planar and formed from a conductive material such as sheet metal. Upper ground plate 231 (FIG. 27) has a plurality of generally rectangular openings 233 that include a first generally rectangular recess or notch 234 adjacent one corner and a second generally rectangular recess or notch 235 adjacent a diagonally opposite corner. The openings 233 and recesses 234, 235 are configured so that, during the assembly process, the first recess 234 provides clearance for the contact section 72 of a female terminal 70 and the second recess 235 provides clearance for the contact section 92 of a ground terminal 90. The openings 233 may also include a smaller generally rectangular recess or notch 236 adjacent the first recess 234 to permit the contact section 32 of a male terminal 30 to pass during the assembly process.

Lower Ground Plate

Figure 28:
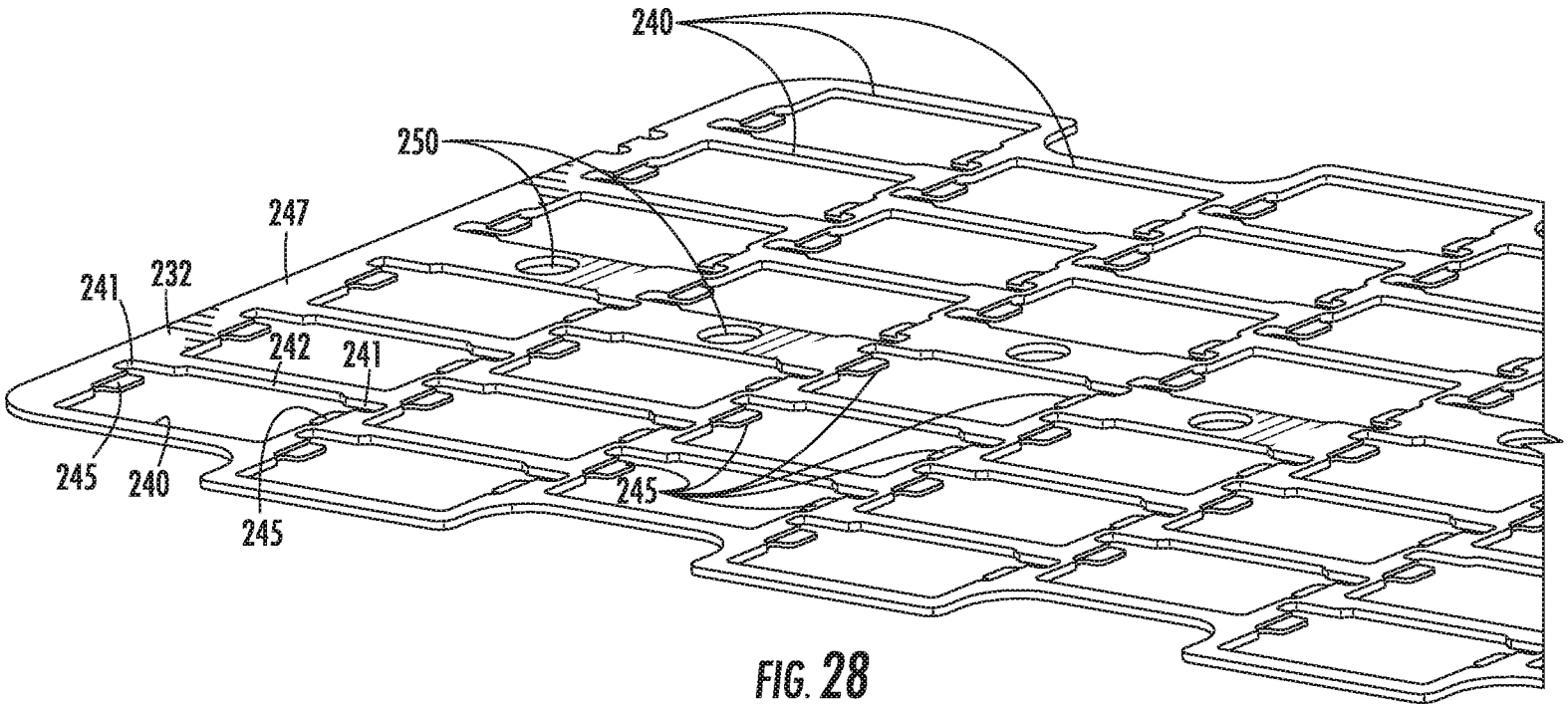
FIG. 28 illustrates an enlarged perspective view of a portion of an embodiment of the lower ground plate.

Lower ground plate 232 (FIG. 28) also has a plurality of generally rectangular openings 240 somewhat similar to the openings 233 of the upper ground plate. Each opening 240 includes a pair of recesses or notches 241 at opposite corners along one side 242 of the opening. During the assembly process, the notches provide clearance for the barbs 111 of the locking section 110 of a ground terminal 90 to pass therethrough.

Ground Tabs

Each ground plate 230 also includes a pair of resilient tabs or beams 245 generally positioned on the longitudinal centerline and at opposite ends 246 of each opening 233, 240. The resilient tabs 245 are configured to engage a ground terminal 90 either as the ground terminals are inserted into the housing 20 or as a ground plate 230 is mounted on the housing. During engagement between the ground terminal 90 and a resilient tab 245, the resilient tab will engage an outer surface 113 of either the first rail 103 or second rail 105.

If desired, the resilient tabs 245 may be eliminated from some of the openings 233, 240 to eliminate the direct electrical connection between certain of the ground terminals 90 and the ground plates 230. In addition, the size of some of the openings 233, 240 may also be enlarged to modify the electrical characteristics of the connector.

While the ground plate 230 may be formed with a body 247 of a material having a first thickness, the tabs 245 may be formed so as to have a second thickness that is less than the first thickness. For example, a ground plate 230 may be formed of sheet metal that is 0.01 inches thick and the tabs 245 may be worked or formed during the manufacturing process (e.g., during a stamping and forming process) so as to be 0.005 inches thick. Other material thicknesses and ratios between the first thickness and the second thickness may be used. In another example, the second thickness may be between 40% and 70% of the first thickness. In still another example, the second thickness may be at least 65% less than the first thickness. Although depicted in the drawings as having an abrupt transition from the first thickness to the second thickness, in practice, the transition is likely to be more gradual due to the nature of the manufacturing process and to reduce stress concentrations.

Manufacturing the body 247 of the ground plates 230 from a material having a first thickness and forming tabs 245 so as to have a second thickness provides advantages over a ground plate having a uniform thickness. The ground plates 230 may have a thickness as desired to meet a first set of performance characteristics (e.g., manufacturing, mechanical and/or electrical) while the thickness of the tabs 245 may be designed or formed based upon a second set of performance characteristics. For example, as discussed below, the lower ground plate 232 may be mounted within the housing 20 and the housing supports, to some extent, the lower ground plate as the ground terminals 90 are inserted into the housing and into contact with the lower ground plate. However, the upper ground plate 231 may be inserted or mounted on the housing 20 after all of the ground terminals are mounted on the housing. Mounting the upper ground plate 231 requires relative movement of the ground plate, the housing 20, and the ground terminals 90. Forming the upper ground plate 231 of relatively thick material provides additional rigidity to the upper ground plate while the relatively thinner tabs 245 are still able to deflect as desired.

Plating

In some instances, ground plate 230 may be plated with a material to increase the strength of the tabs 245. For example, a zinc plating may be applied to the ground plate 230 to increase the strength of the plated portions including the tabs 245. If desired, it may be possible to selectively plate the ground plate 230 to only add the plating in the desired areas such as at the tabs 245.

Securement

The ground plates 230 may be mounted on housing 20 in any desired manner. In one example, the ground plates 230 includes a plurality of mounting holes or bores 250. Housing 20 may include complementary shaped projections or posts 190 (FIGS. 3, 13) that fit within the mounting holes 250. Upon aligning the mounting holes 250 with the posts 190 and moving a ground plate 230 onto the housing 20, the posts may be deformed to secure the ground plate to the housing.

Manufacture

Assembling connectors in a cost-effective manner while maintaining their desired performance and high reliability may be especially challenging. In one aspect, the terminals 25 may be inserted into the housing 20 from the mating face 13 of the connector and towards the mounting face 14. Such a process may create unique challenges, especially with respect to a connector that includes terminals 25 that are configured to be press-fit into a circuit board or member such as through the use of compliant pins.

When assembling first connector 11, lower ground plate 232 is positioned adjacent the upper surface of the lower housing component 22 and the posts 190 of the lower housing component are aligned with the mounting holes 250 of the lower ground plate. The lower ground plate 232 is moved relative to the lower housing component 22 to mount the lower ground plate onto the lower housing component with the posts 190 positioned within the mounting holes 250. The posts 190 may deformed in any desired manner, such as by staking, to secure the lower ground plate 232 to the lower housing component 22.

Figure 29:
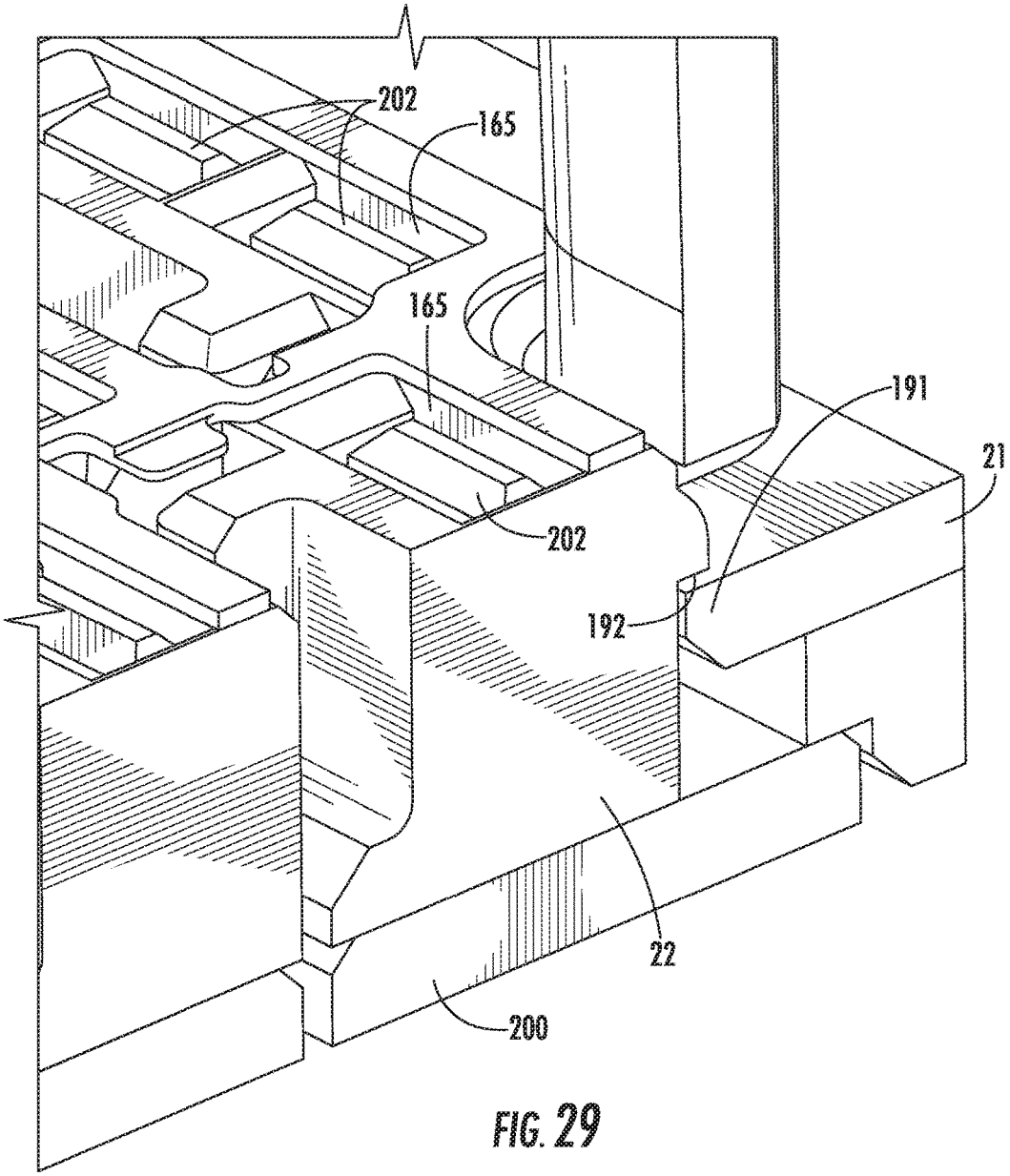
FIG. 29 illustrates an enlarged perspective view of a cross-section of a portion of the assembly of the upper housing component, the lower housing component, and the lock plate.

The upper housing component 21 may then be mounted or secured to the lower housing component 22 in any desired manner. In one example, the upper housing component 21 may include flexible latches 191 (FIG. 29) that deflect upon engagement with latching surfaces 192 on lower housing component 22 to latch the upper housing component to the lower housing component.

Terminals 25 may be inserted into the housing 20 in any desired manner. In one example, a plurality of male terminals 30 may be inserted simultaneously into the housing 20. A plurality of female terminals 70 may be subsequently inserted simultaneously into the housing 20. Finally, a plurality of ground terminals 90 may be inserted simultaneously into the housing 20. In another example, groups 26 of terminals 25 may be simultaneously inserted into the housing 20. In still another example, terminals 25 may be inserted individually into the housing. Regardless of the manner in which the terminals 25 are inserted, the terminals are inserted into the housing 20 from the mating face 13 of the connector towards the mounting face 14.

Figure 30:
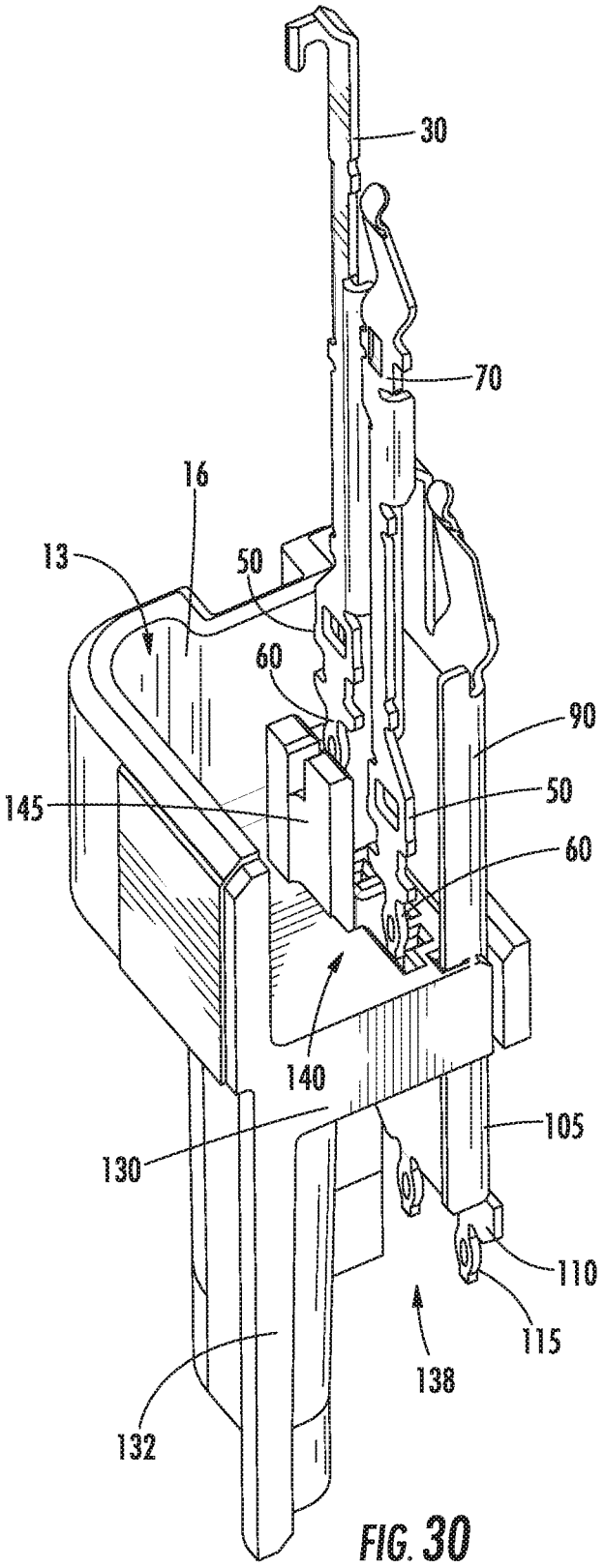
FIG. 30 illustrates an enlarged perspective view of a cross-section of the upper portion of the connector housing of FIG. 15 but with a group of terminals partially inserted therein.

Referring to FIG. 30, when inserting the male terminals 30, the tail section 60 of each male terminal is inserted into a male terminal receiving opening 141 in the upper section 136 of the cavity 135 and the entire terminal is moved towards the mounting face 14 of the connector. As the male terminal 30 moves towards the mounting face 14, the locking section 50 and tail section 60 pass through the slot 142 of the male terminal receiving opening 141 and through the open central section 138 towards one of the signal terminal receiving openings 165 in the lower section 137 of cavity 135. As the male terminal 30 moves downward, the first plate-like projection 41 and the second plate-like projection 43 pass through respective ones of the spaced apart slots 143 and into the open central section 138.

As the male terminal 30 approaches the lower support wall 131 and the lower section 137 of the cavity 135, the locking section 50 and the tail section 60 pass through one of the openings 240 in the lower ground plate 232. The lower ground plate 232 is not depicted in FIGS. 31-42, 44-49 for clarity.

Figure 31:
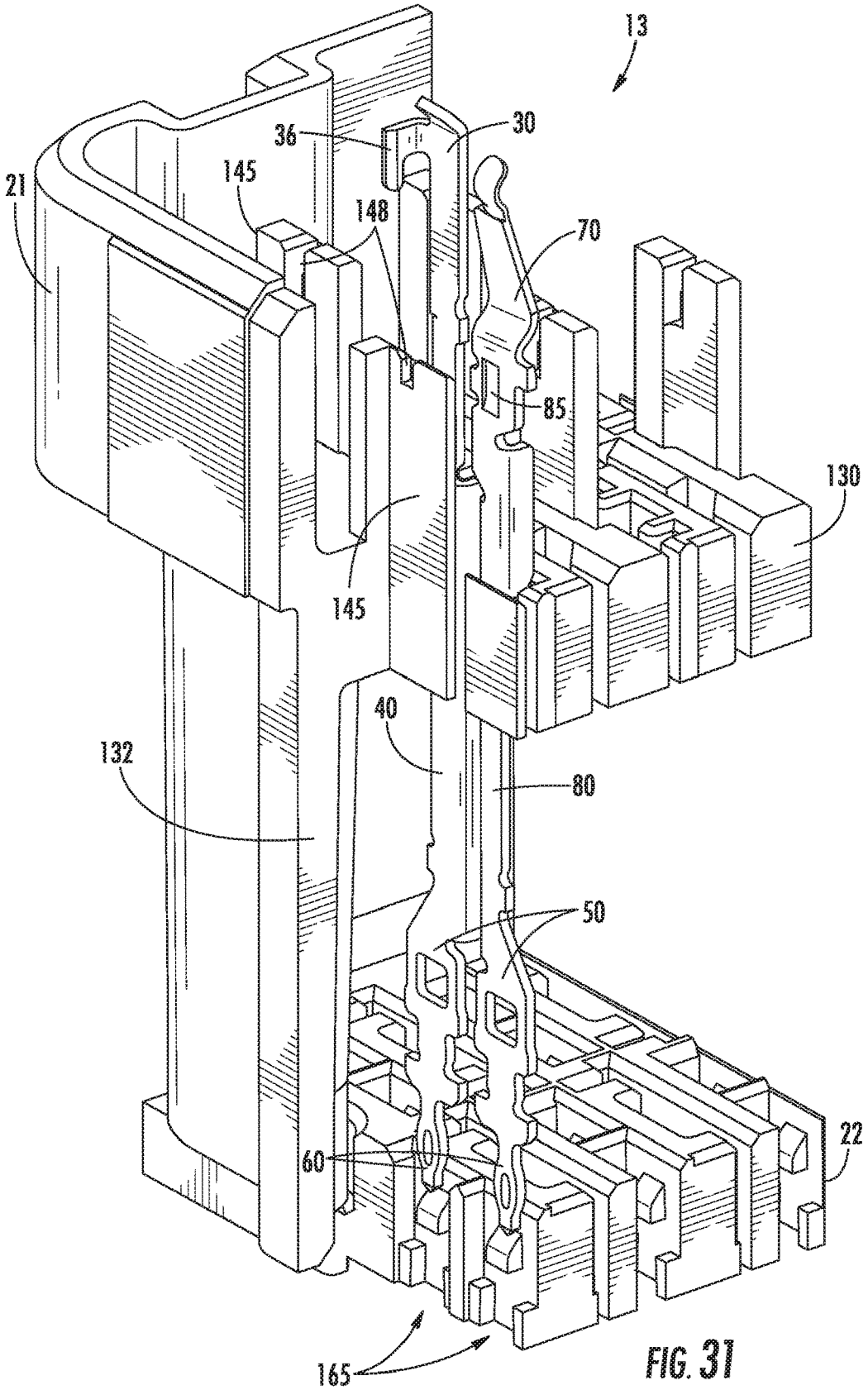
FIG. 31 illustrates a perspective view of a cross-section of a portion of an embodiment of the connector housing similar to FIG. 19 but with a pair of signal terminals beginning to enter signal terminal receiving openings.
Figure 32:
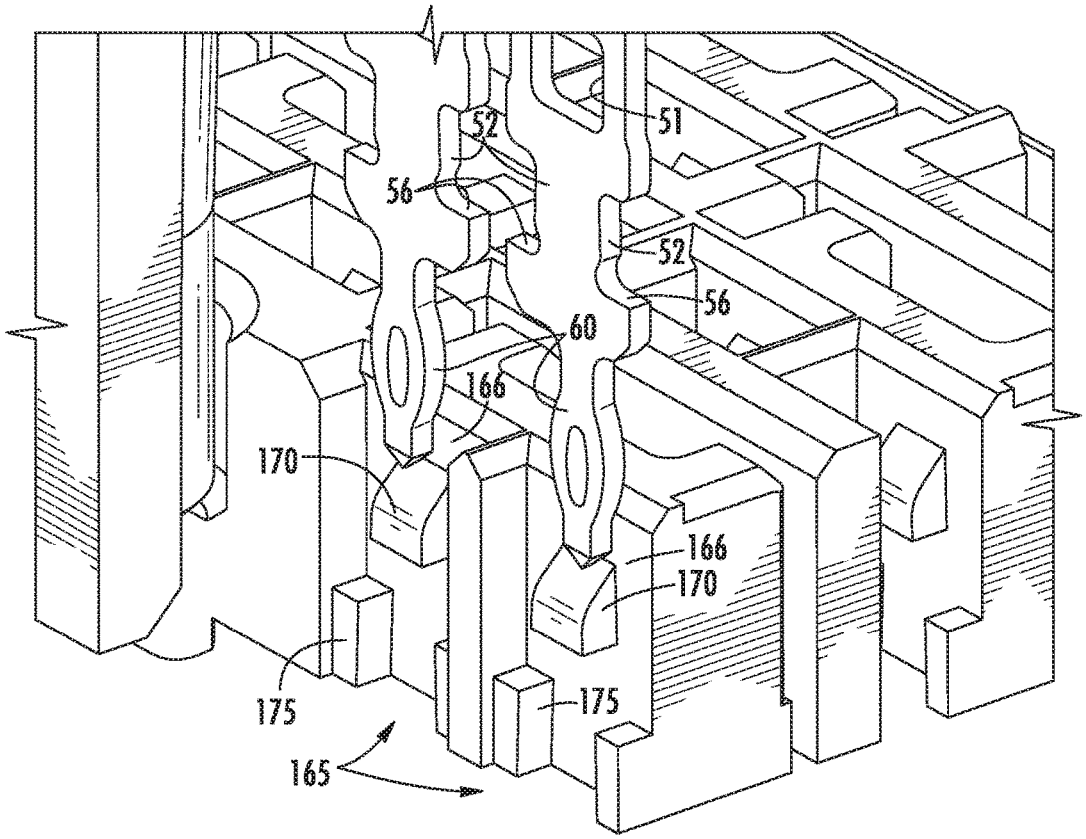
FIG. 32 illustrates an enlarged perspective view of a cross-section of the lower portion of the connector housing and the signal terminals of FIG. 31.
Figure 33:
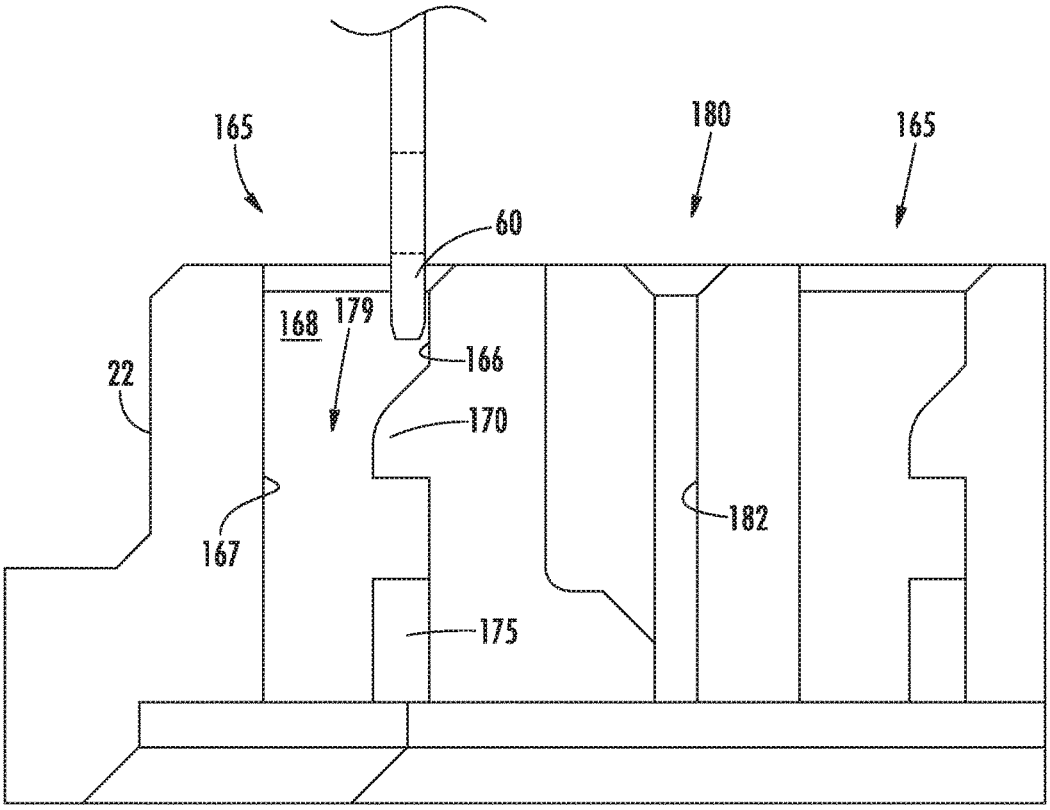
FIG. 33 illustrates a side view of the enlarged cross-section of FIG. 32.
Figure 34:
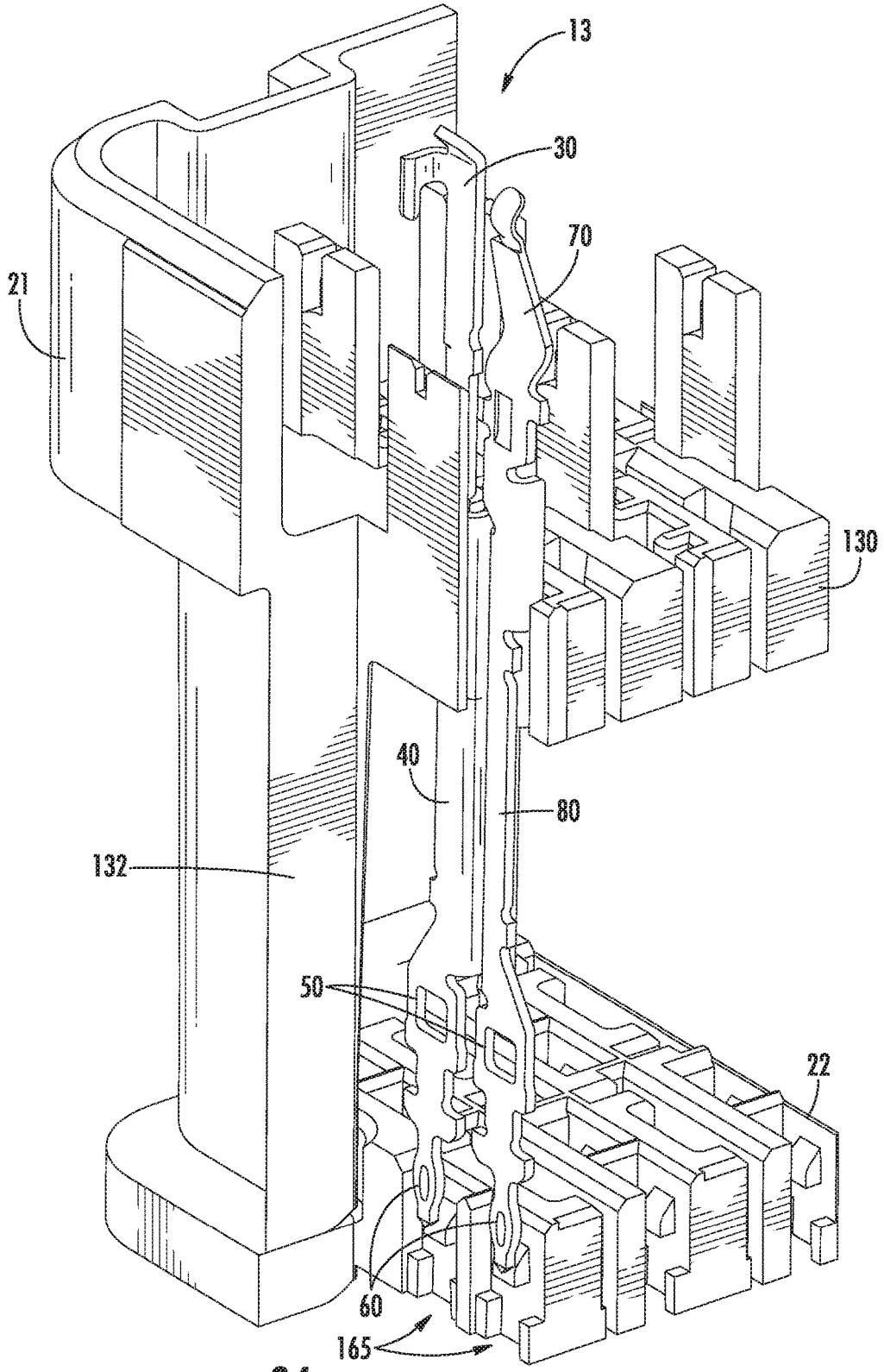
FIG. 34 illustrates a perspective view of a cross-section of a portion of an embodiment of the connector housing similar to FIG. 31 but with the pair of signal terminals inserted farther into the terminal receiving openings.
Figure 35:
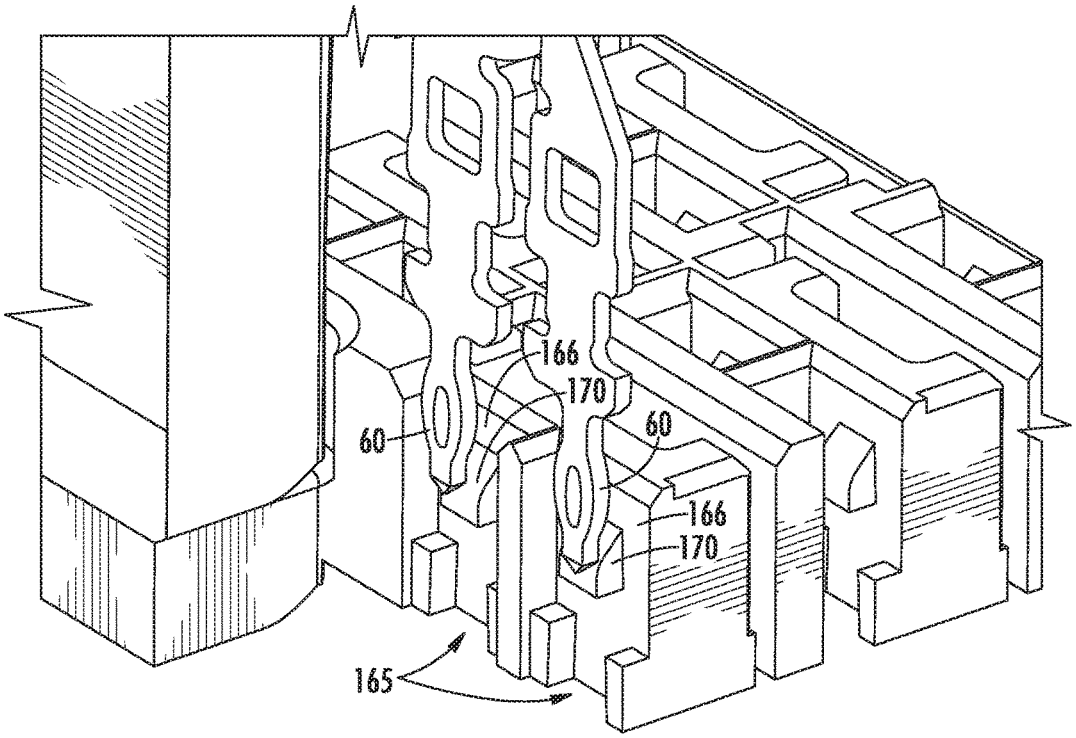
FIG. 35 illustrates an enlarged perspective view of a cross-section of the lower portion of the connector housing and the signal terminals of FIG. 34.
Figure 36:
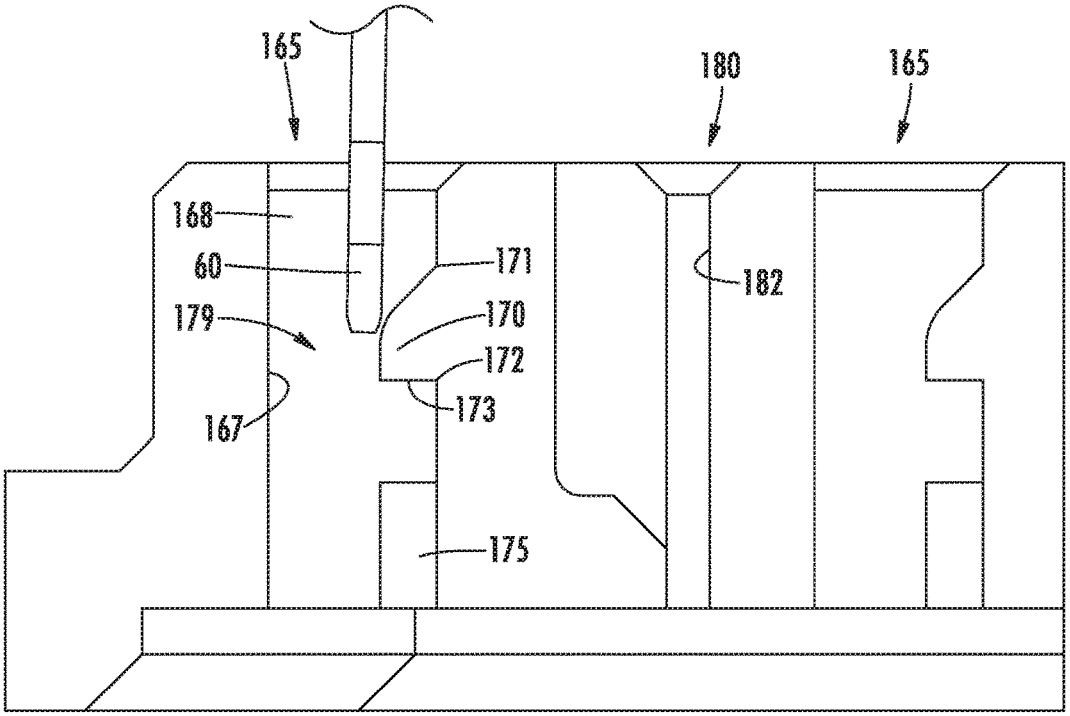
FIG. 36 illustrates a side view of the enlarged cross-section of FIG. 35.

Further insertion of the male terminal 30 causes the tail section 60 to approach and enter one of the signal terminal receiving openings 165 of the lower support wall 131 as depicted in FIGS. 31-33. If the tail section 60 is aligned with the insertion opening 179 (i.e., between the central projection 170 and the end wall 167), the male terminal 30 will continue to move downward towards the mounting face 14. However, as depicted in FIGS. 34-36, if the tail section 60 is not aligned with the insertion opening 179, the tail section will engage the central projection 170 and the taper or slope of the central projection will redirect the tail section towards the opposite wall 167 and into the insertion opening.

Figure 37:
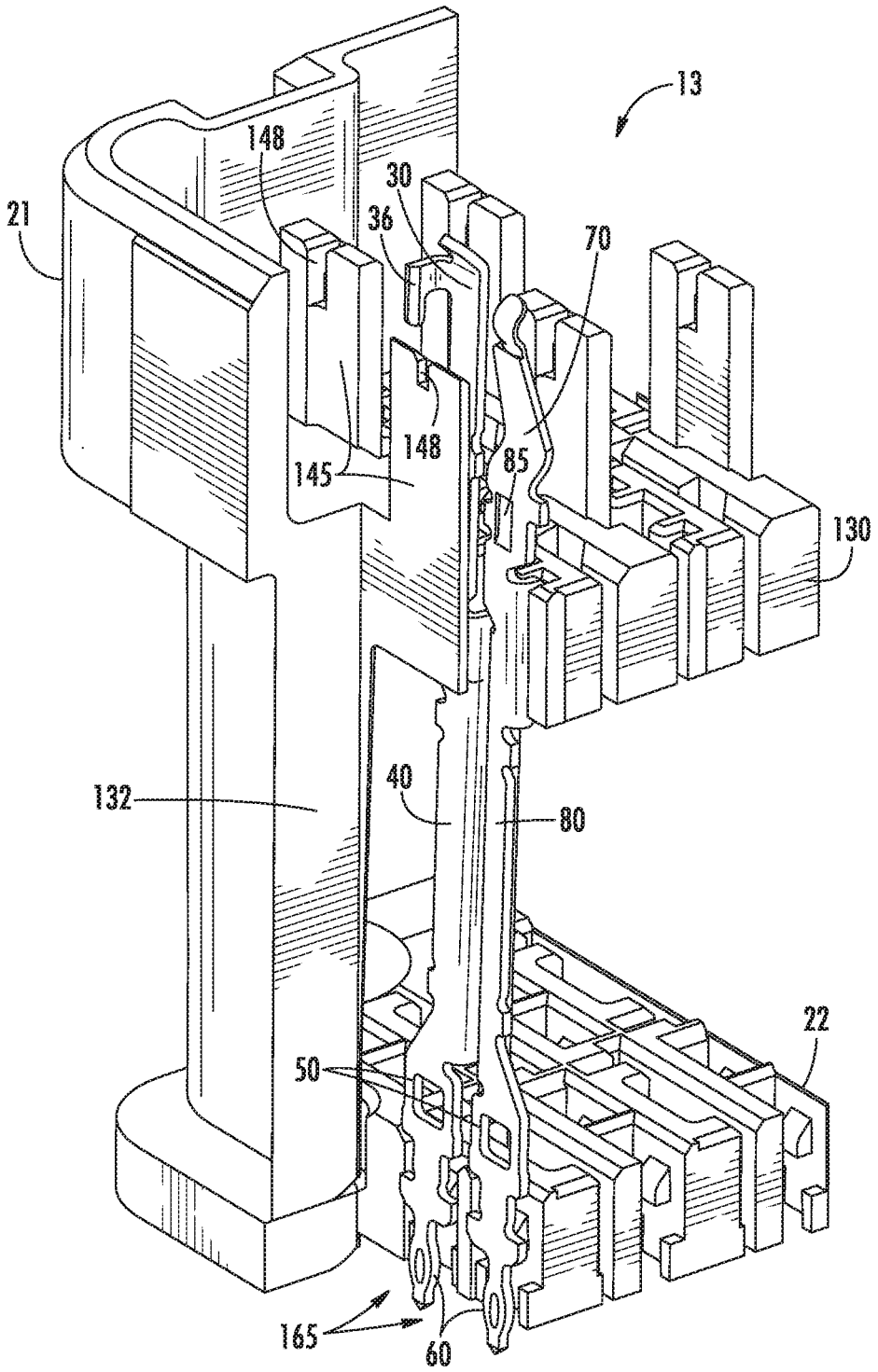
FIG. 37 illustrates a perspective view of a cross-section of a portion of an embodiment of the connector housing similar to FIG. 34 but with the pair of signal terminals inserted even farther into the signal terminal receiving openings.
Figure 38:
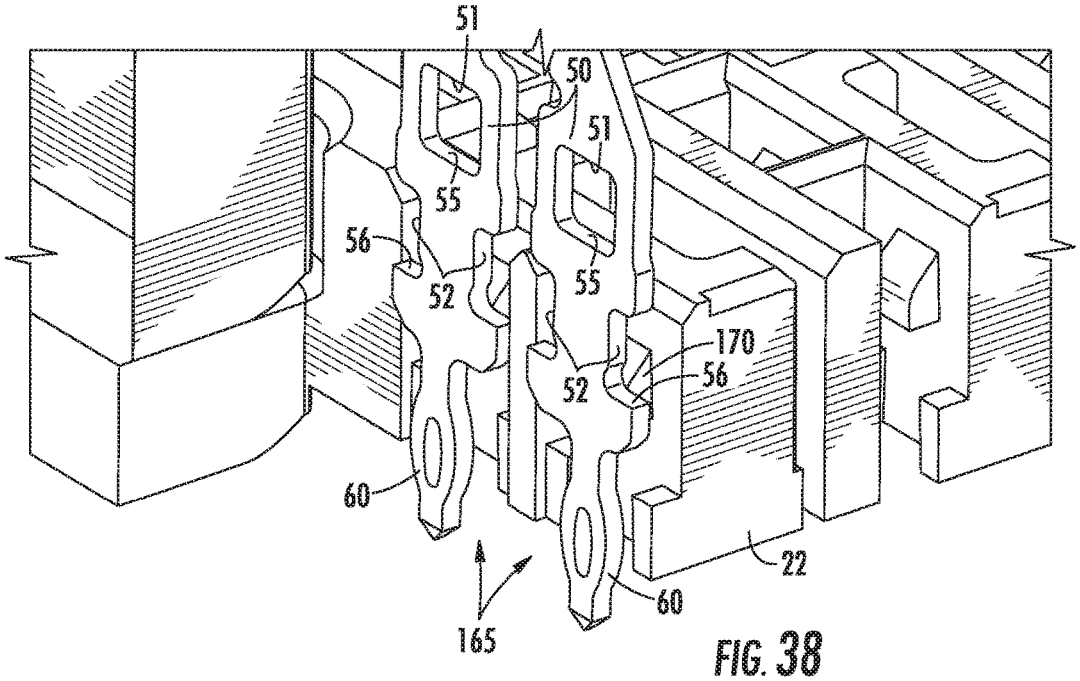
FIG. 38 illustrates an enlarged perspective view of a cross-section of the lower portion of the connector housing and the signal terminals of FIG. 37.
Figure 39:
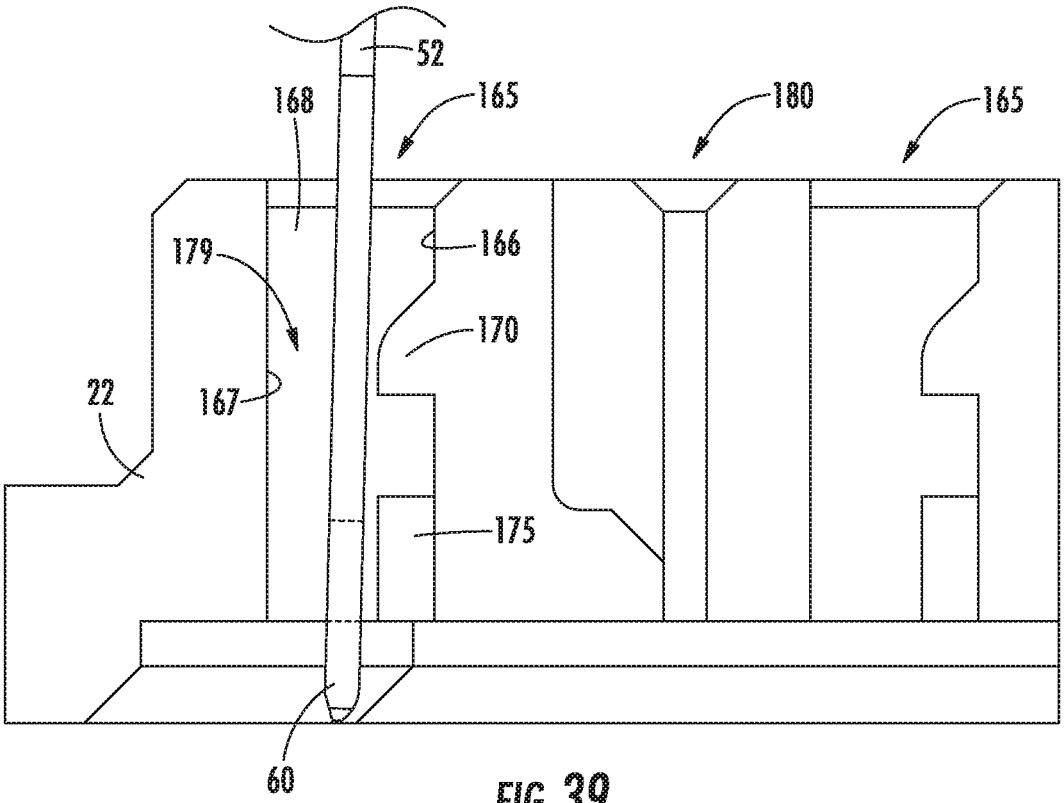
FIG. 39 illustrates a side view of the enlarged cross-section of FIG. 38.
Figure 40:
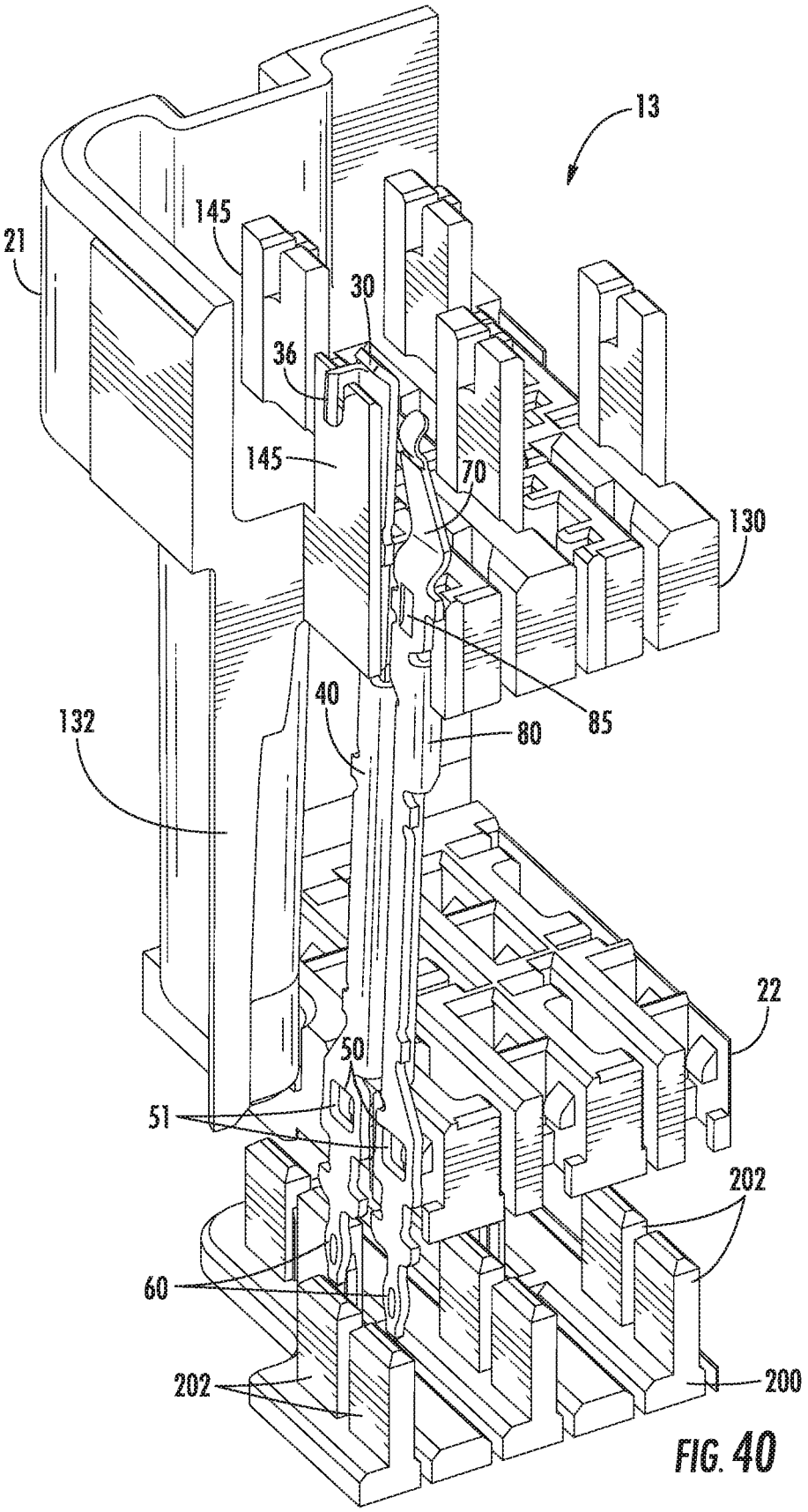
FIG. 40 illustrates a perspective view of a cross-section of a portion of an embodiment of the connector housing similar to FIG. 37 but with the pair of signal terminals fully inserted into the signal terminal receiving openings prior to being locked therein and with the lock plate initially engaging the signal terminals.
Figure 41:
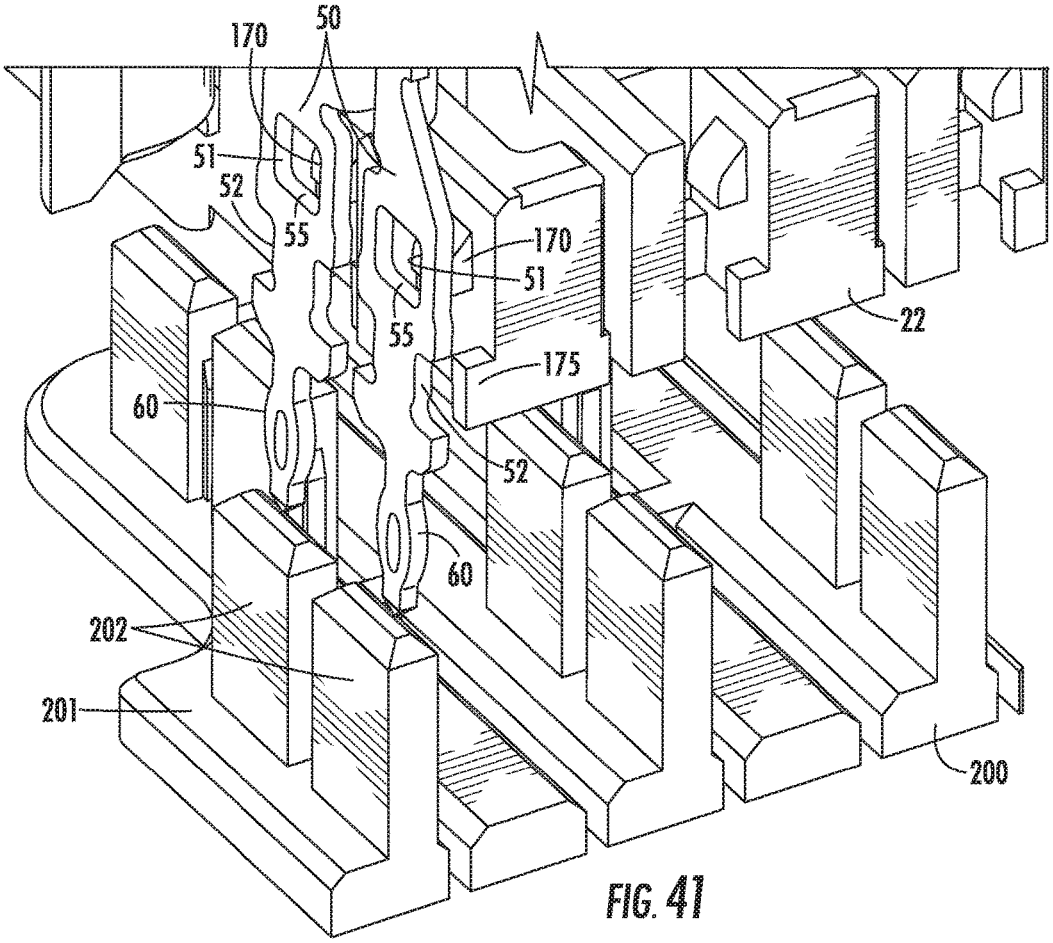
FIG. 41 illustrates an enlarged perspective view of a cross-section of the lower portion of the connector housing, the signal terminals, and the lock plate of FIG. 40.
Figure 42:
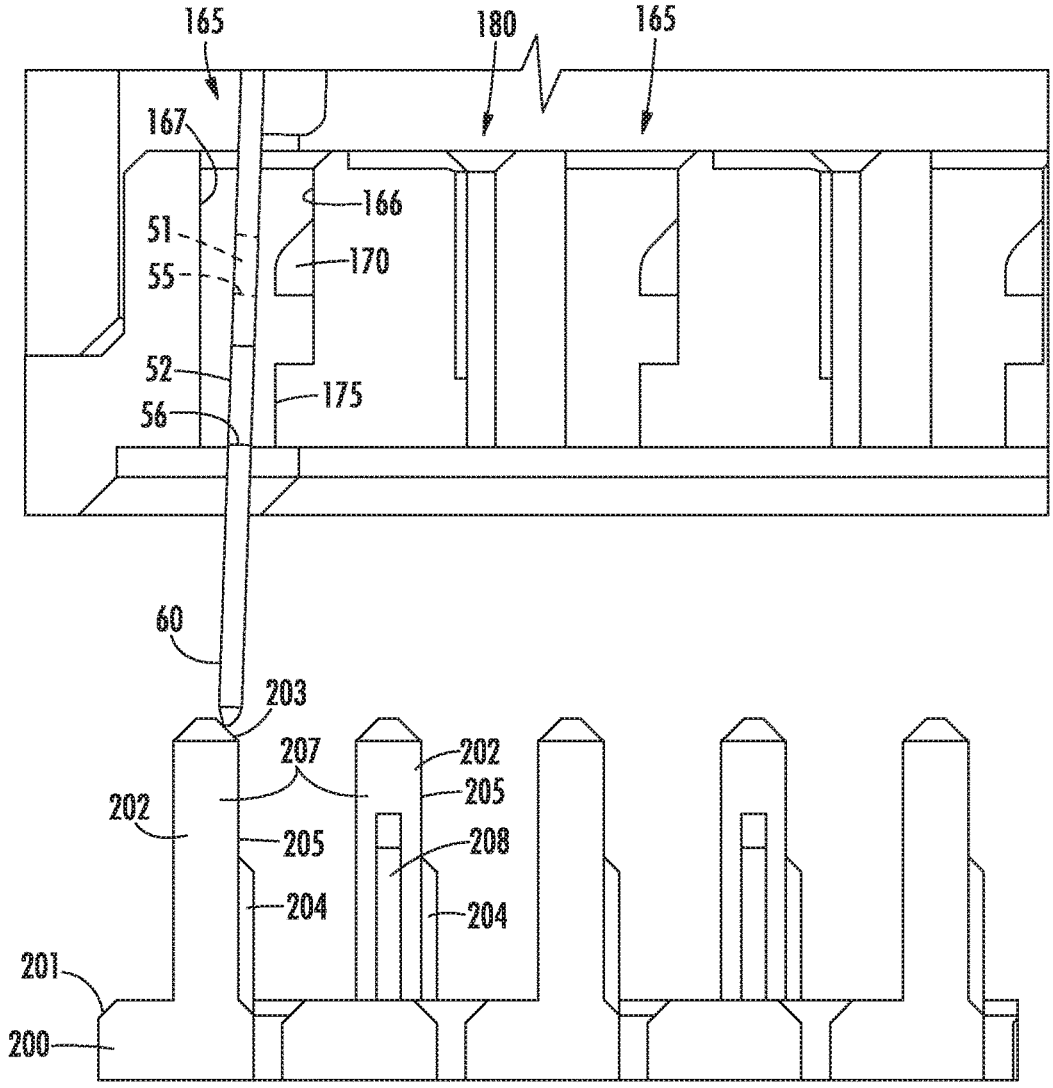
FIG. 42 illustrates a side view of the enlarged cross-section of FIG. 41.

Continued movement of the male terminal 30 towards its fully inserted position causes the portion of the locking section 50 along the central path 54 to slide along the central projection 170 as best seen in FIGS. 37-39. The male terminal 30 continues to move downward towards its fully inserted position along a terminal insertion path until the centrally located opening 51 is aligned with central projection 170 and the rectangular side openings 52 are aligned with the side projections 175 as depicted in FIGS. 40-42. The male terminals 30 are maintained in this position until the terminals are locked in position as described in further detail below.

As the male terminal 30 approaches its fully inserted position, contact positioning projection 35 (e.g., the L-shaped leg 36) slides into the contact positioning slot 148 in the terminal support projection 145 as depicted in FIGS. 17, 40. The interengagement between the L-shaped leg 36 and the contact positioning slot 148 secures the contact section 32 against the terminal support projection 145 with the contact section positioned above the upper support wall 130.

Female terminals 70 are inserted into the housing 20 in a manner similar to the male terminals 30. When inserting the female terminals 70, the tail section 60 of each female terminal is inserted through a female terminal receiving opening 155 in the upper section 136 of the cavity 135 (FIG.

30) and the female terminal is moved towards the mounting face 14 of the connector. As the female terminal 70 moves towards the mounting face 14, the locking section 50 and the tail section 60 pass through the slot 156 of the female terminal receiving opening 155 and through the open central section 138 towards one of the signal terminal receiving openings 165 in the lower support wall 131. As the female terminal 70 moves downward, the first plate-like projection 81 and the second plate-like projection 83 pass through respective ones of the spaced apart slots 157 and into the open central section 138.

As with the male terminal 30 and not depicted in the drawings, movement of the female terminal 70 towards the lower support wall 131 results in the locking section 50 and the tail section 60 passing through the aligned opening 240 in the lower ground plate 232.

As the female terminal 70 approaches its fully inserted position, locking projection 85 may engage slot 156 (FIG. 40) to secure the upper portion of the female terminal within the female terminal receiving opening 155 with the contact section positioned above the upper support wall 130. The interaction of the locking section 50 and tail section 60 of female terminal 70 with the signal terminal receiving opening 165 of the lower section 137 of cavity 135 is identical to that of the male terminal 30 and thus is not repeated herein.

Referring to FIG. 30, ground terminals 90 are inserted into the housing 20 by positioning a ground terminal adjacent the mating face 13 of the housing 20 and aligning the tail section 115 of the ground terminal with one of the U-shaped openings 160 in the upper section 136 of cavity 135. As the ground terminal 90 is moved towards the mounting face 14, first the tail section 115 and then the locking section 110 enter and pass through the slot 162 of the opening 160. Continued movement of the ground terminal 90 towards the mounting face 14 causes the first rail 103 and the second rail 105 to pass through the respective ones of the spaced apart slots 143 and into the open central section 138 of the cavity 135.

Figure 43:
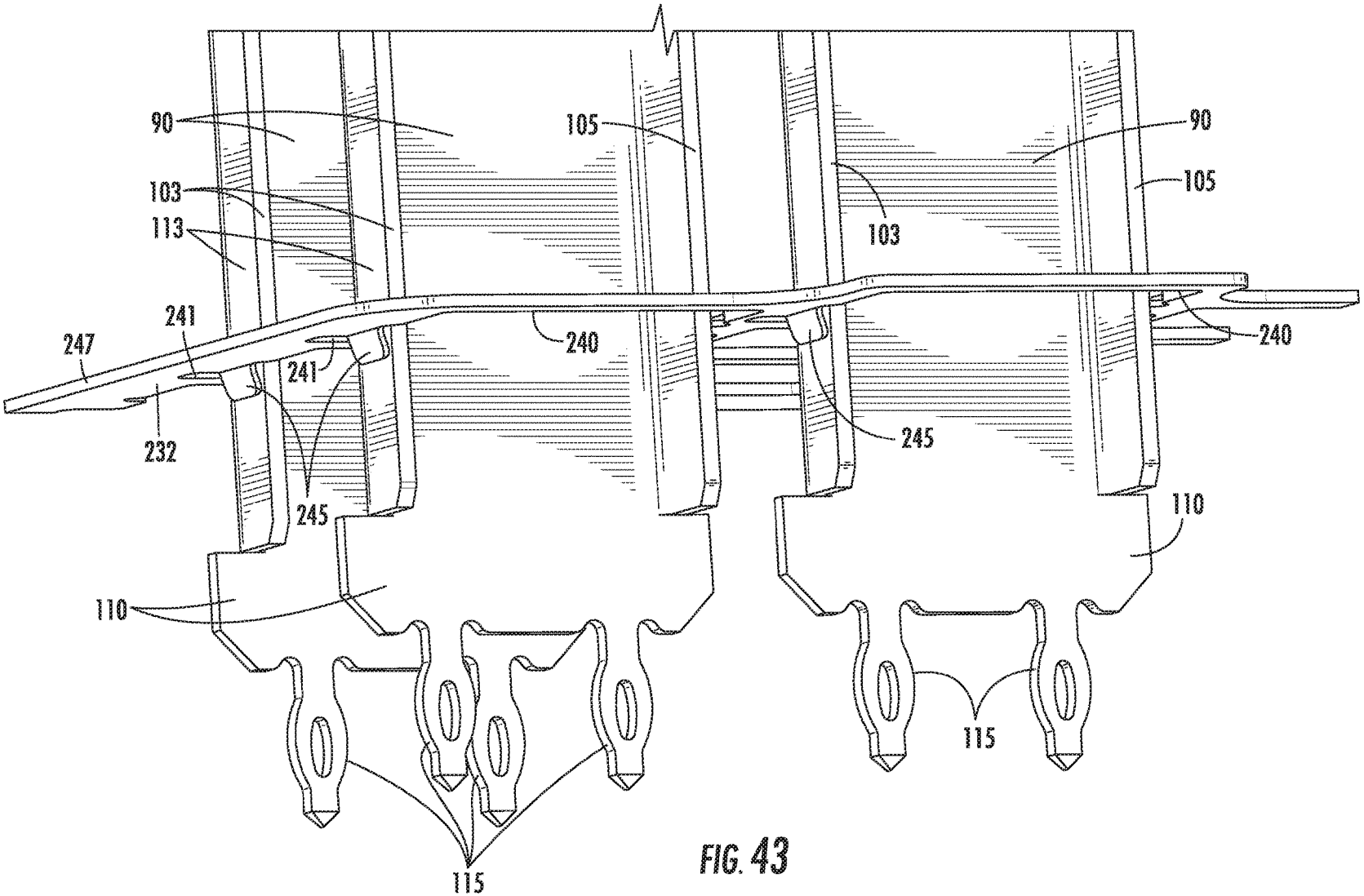
FIG. 43 illustrates an enlarged perspective view of a portion of a plurality of ground terminals interconnected to the lower ground plate with the housing and other terminals.
Figure 44:
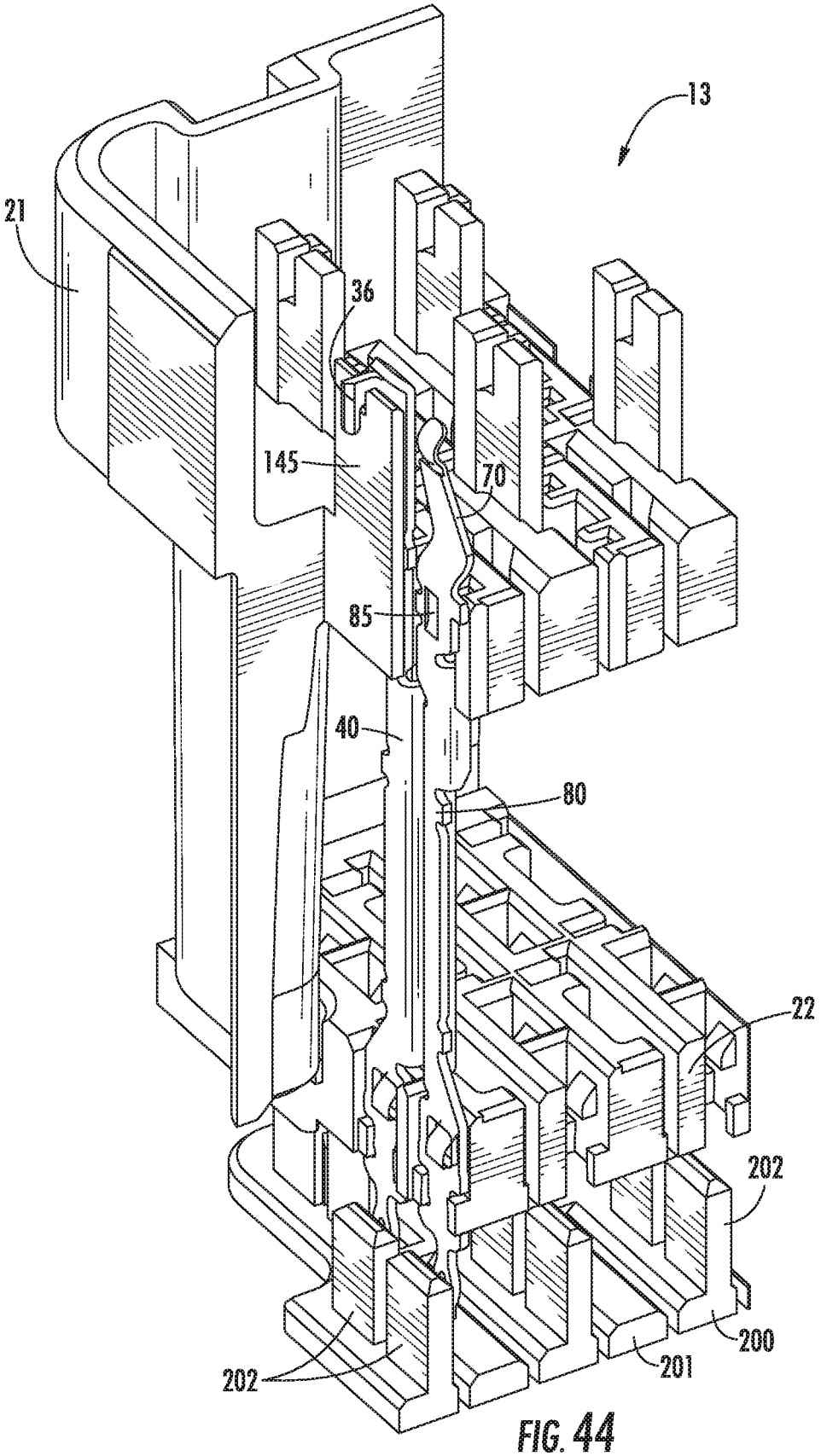
FIG. 44 illustrates a perspective view of a cross-section of a portion of an embodiment of the connector housing and the pair of signal terminals similar to FIG. 40 but with the lock plate further engaging the pair of signal terminals to move the signal terminals against the locking wall.
Figure 45:
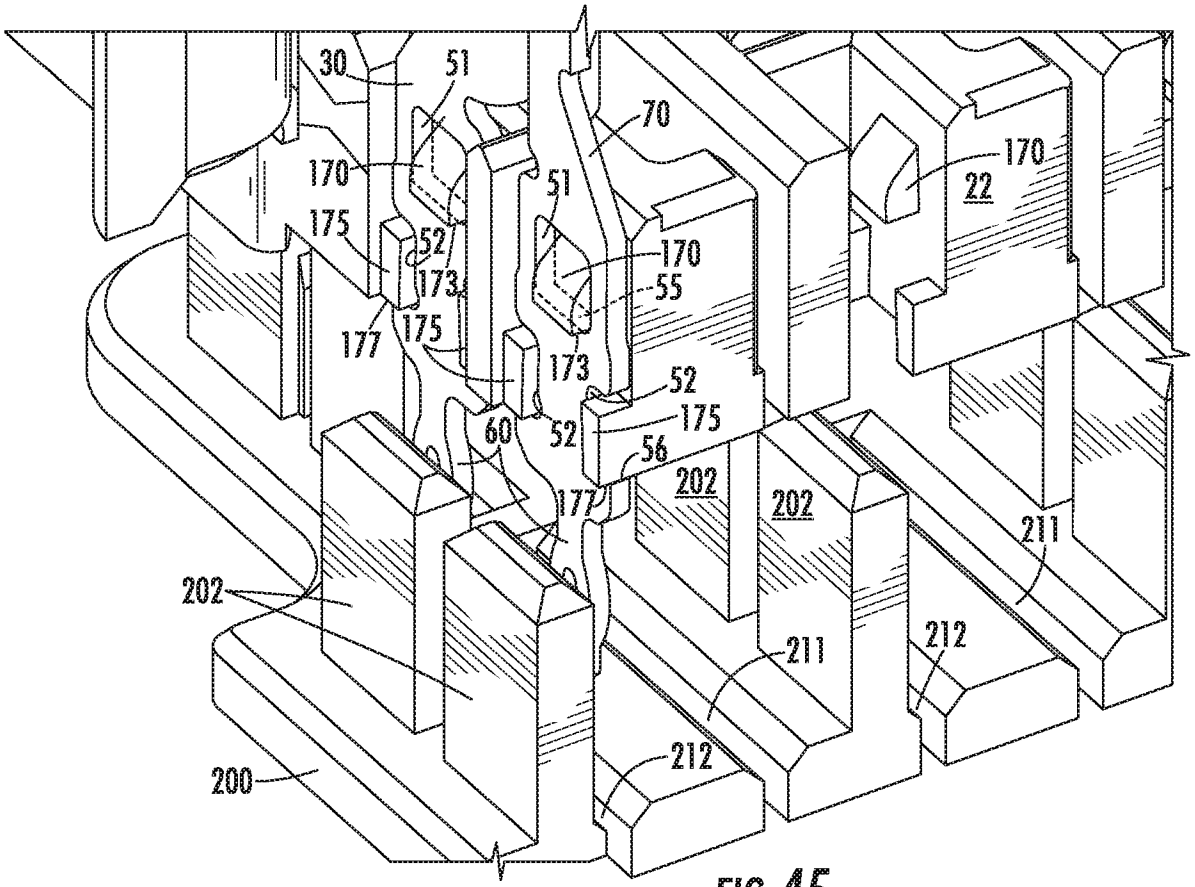
FIG. 45 illustrates an enlarged perspective view of a cross-section of the lower portion of the connector housing, the signal terminals, and the lock plate of FIG. 44.
Figure 46:
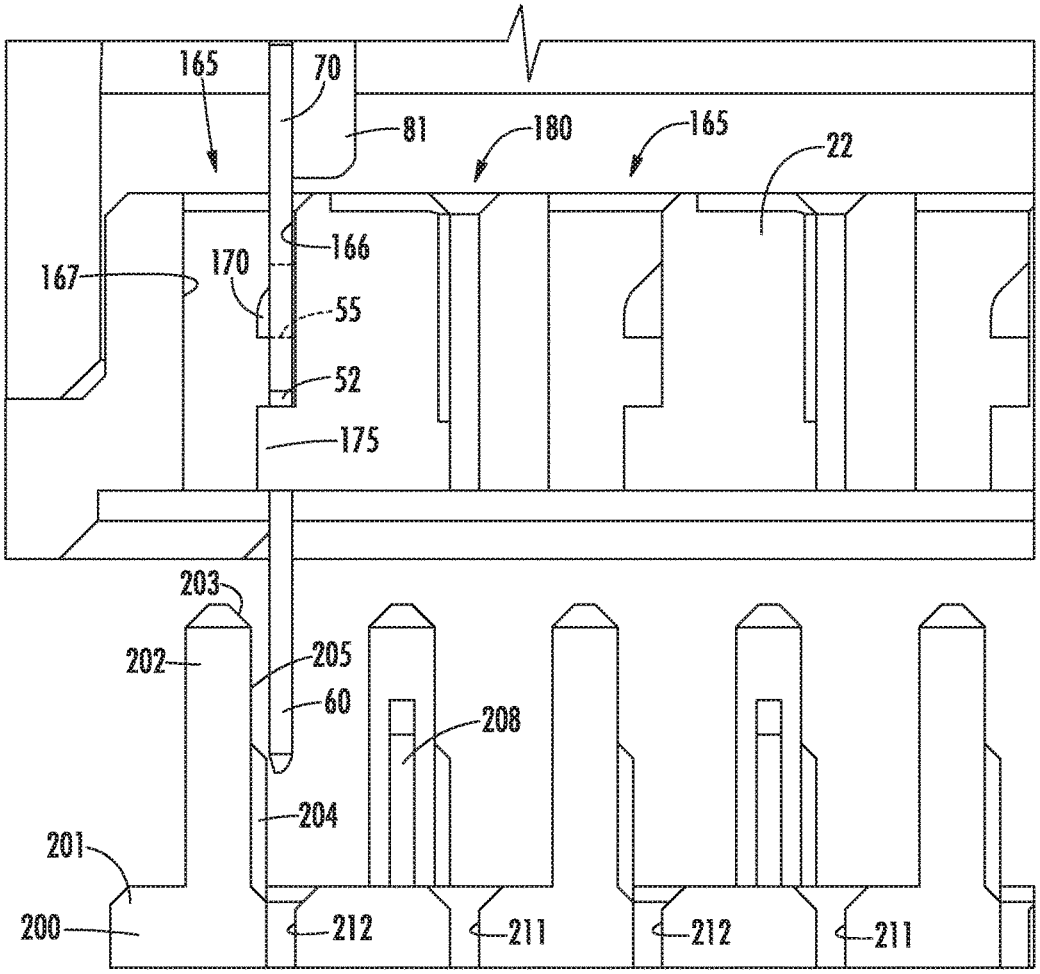
FIG. 46 illustrates a side view of the enlarged cross-section of FIG. 45.

Further movement of the ground terminal 90 towards the tower support wall 131 results in the first rail 103 and the second rail 105 engaging the tabs 245 of the lower ground plate 232. Continued downward movement of the ground terminals 90 (i.e., towards the mounting face 14) causes the tabs 245 to resiliently deflect downward towards mounting face 14 but remain engaged with an outer surface 113 of one of the first rail 103 and the second rail 105 as depicted in FIG. 43. The engagement or contact between the tabs 245 and the first rail 103 and second rail 105 creates an electrical connection between the ground terminal 90 and the lower ground plate 232.

Figure 18:
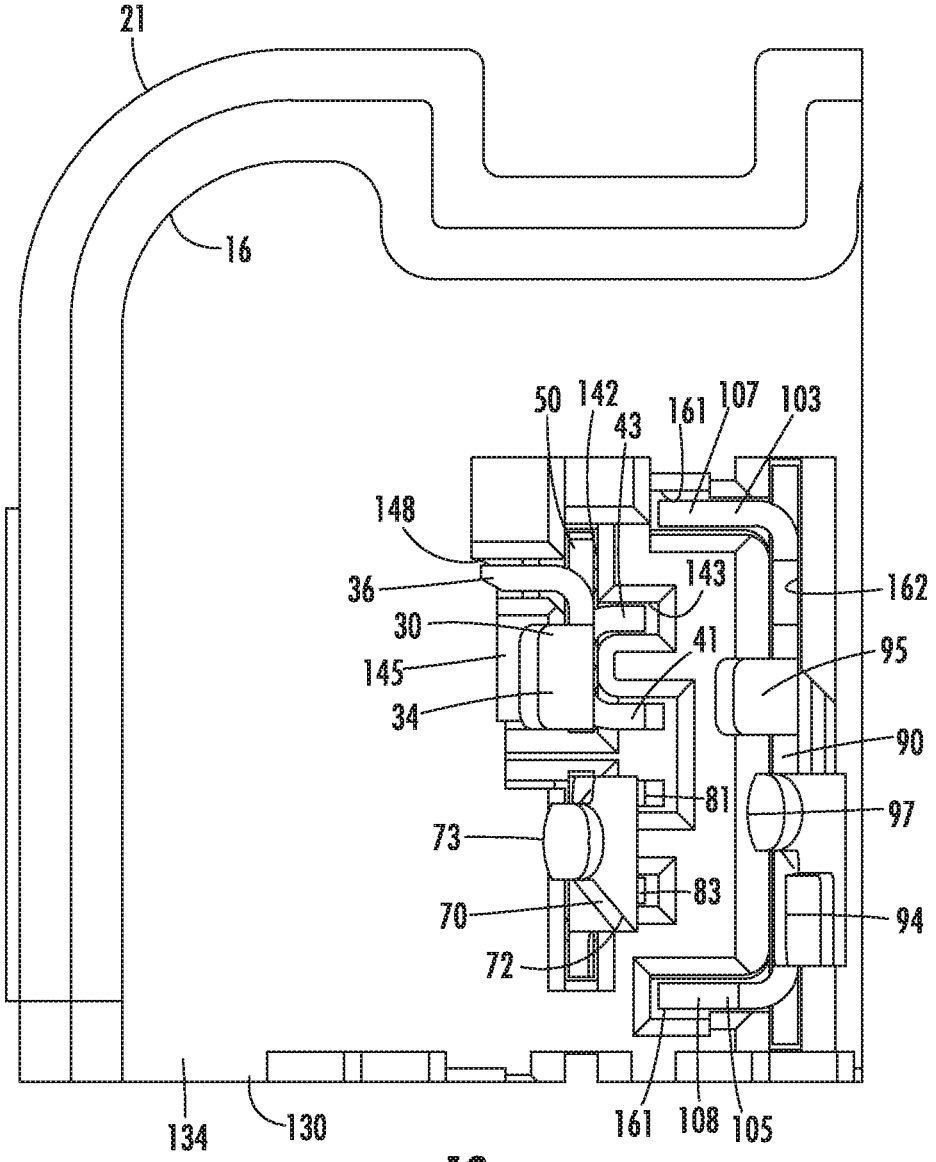
FIG. 18 illustrates a plan view similar to FIG. 16 but with a male terminal, a female terminal, and a ground terminal inserted into the housing.

As the ground terminal 90 approaches its fully inserted position, the upper locking projection 112 of the ground terminal may engage slot 162 to secure the upper portion of the ground terminal within the U-shaped opening 160 with both the male contact section 93 and the female contact section 94 positioned above the upper support wall 130. Referring to FIG. 18, the mating or contact portions of a group 26 of terminals 25 are depicted fully inserted into the upper housing component 21.

Once all of the male terminals 30, female terminals 70, and ground terminals 90 have been inserted into housing 20, the lock plate 200 may be mounted on the lower surface of the lower housing component 22. To do so, referring back to FIGS. 40-42, the signal terminal retention posts 202 are aligned with the insertion openings 179 of the tower section 137 of cavity 135. The lock plate 200 is moved relatively towards to the lower housing component 22 (FIGS. 44-46) so that the signal terminal retention posts 202 eventually enter the insertion openings 179.

Figure 47:
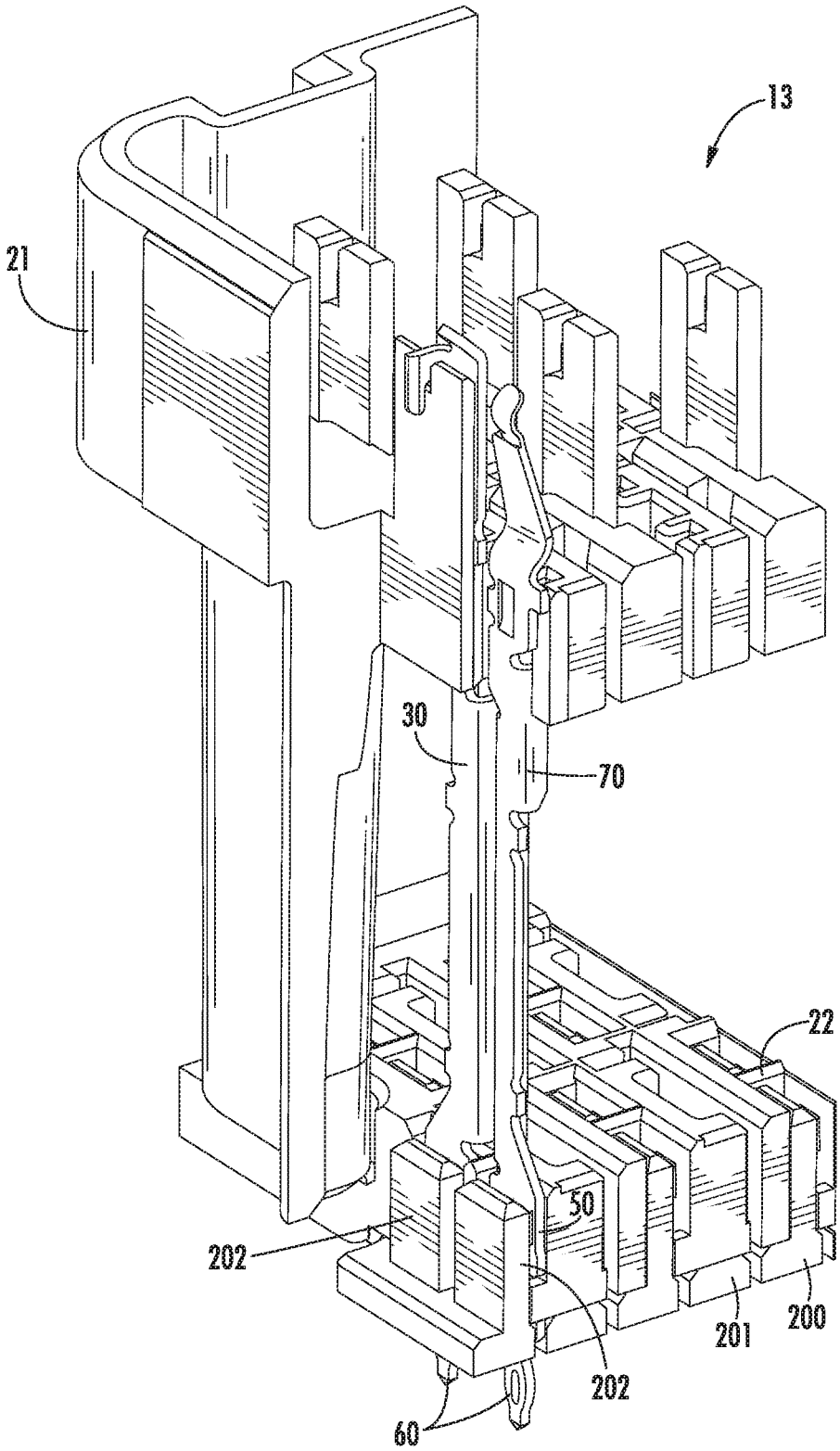
FIG. 47 illustrates a perspective view of a cross-section of a portion of an embodiment of the connector housing and the pair of signal terminals similar to FIG. 44 but with the lock plate fully inserted into the signal terminal receiving openings.
Figure 48:
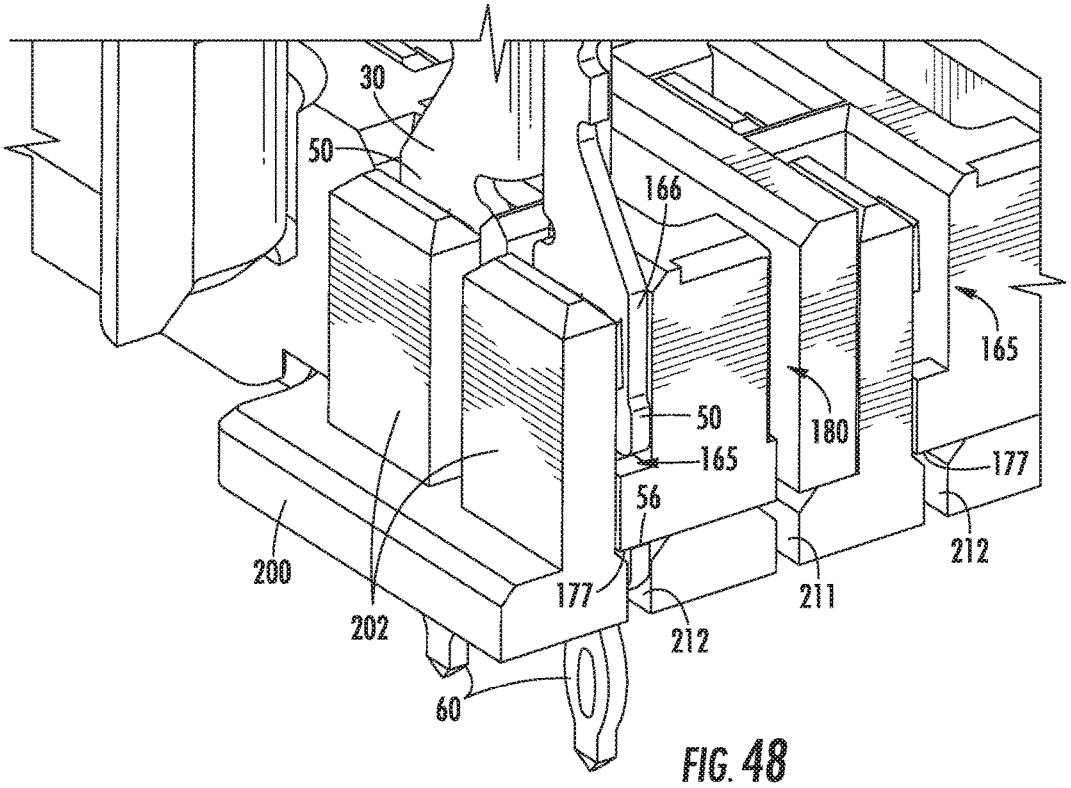
FIG. 48 illustrates an enlarged perspective view of a cross-section of the lower portion of the connector housing, the signal terminals, and the lock plate of FIG. 47.
Figure 49:
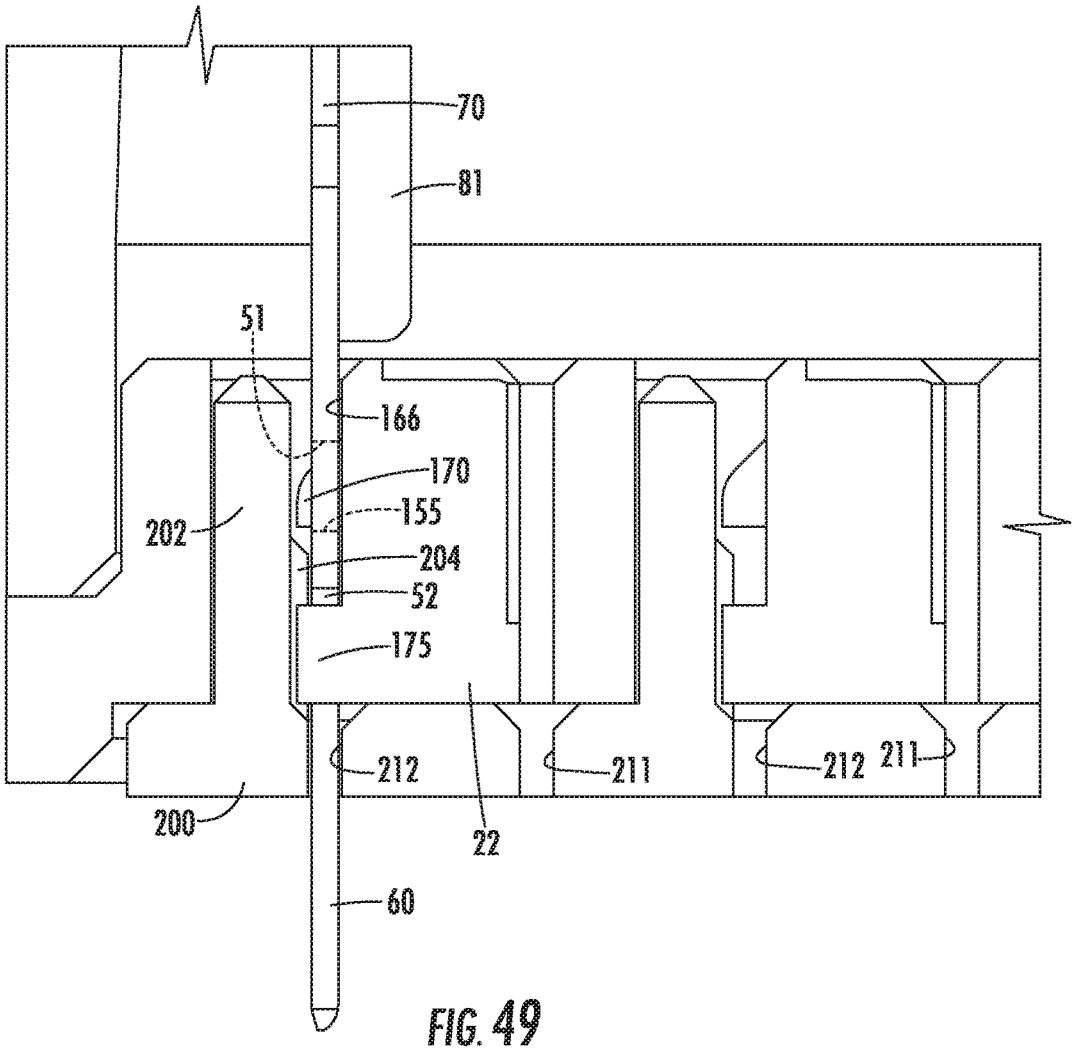
FIG. 49 illustrates a side view of the enlarged cross-section of FIG. 48.

The tapered lead-in surface 203 of each post 202 engages the tail sections 60 of the signal terminals to move the terminals laterally towards the locking wall 166 of each signal terminal receiving opening 165. In doing so, a side wall of each signal terminal retention post 202 further moves the terminals laterally towards the locking wall 166 so that the central projections 170 of the signal terminal receiving openings 165 are positioned within the centrally located openings 51 of the signal terminals and the side projections 175 of the signal terminal receiving openings are positioned within the rectangular side openings 52 of the signal terminals (FIGS. 47-49). In addition, a side surface or wall of the locking section 50 is pressed against the locking wall 166, the locking shoulder 55 engages the lower locking surface 173, and the locking shoulders 56 engage the lower surfaces 177. Upon complete insertion of the lock plate 200, the terminal locking rib 204 of the signal terminal retention posts 202 will also engage the locking section 50 along the central path 54 to prevent movement of the signal terminals.

While inserting the lock plate 200, the tail sections 60 of the signal terminals and the tail sections 115 of the ground terminals 90 pass through the small slots 212 and large slots 211, respectively. Lock plate 200 may be secured to the lower housing component 22 in any desired manner. In one example, lock plate locking ribs 207 extend along the signal terminal retention post 202 and engage the side walls 153 of the signal terminal receiving openings 165 in an interference fit. Other manners of locking the lock plate 200 to the lower housing component 22 are contemplated.

After inserting each of the terminals 25 and locking them in place with lock plate 200, the upper ground plate 231 may be mounted on the housing and terminal assembly. To do so, upper ground plate 231 is positioned adjacent the upper surface 134 of the upper housing component 21 and the posts 190 adjacent the mating face 13 of the upper housing component are aligned with the mounting holes 250 of the upper ground plate. The upper ground plate 231 is moved relative to the upper housing component 21 to mount the upper ground plate onto the upper housing component with the posts 190 positioned within the mounting holes 250.

While mounting the upper ground plate 231 on the upper housing component 21, the contact section 32 of the male terminals 30 will pass through the recesses 236 of the openings 233 of the upper ground plate. The contact section 72 of the female terminals 70 will pass through the recesses 234 of the openings 233 and the contact section 92 of the ground terminals 90 will pass through the recesses 235 of the openings 233.

Figure 50:
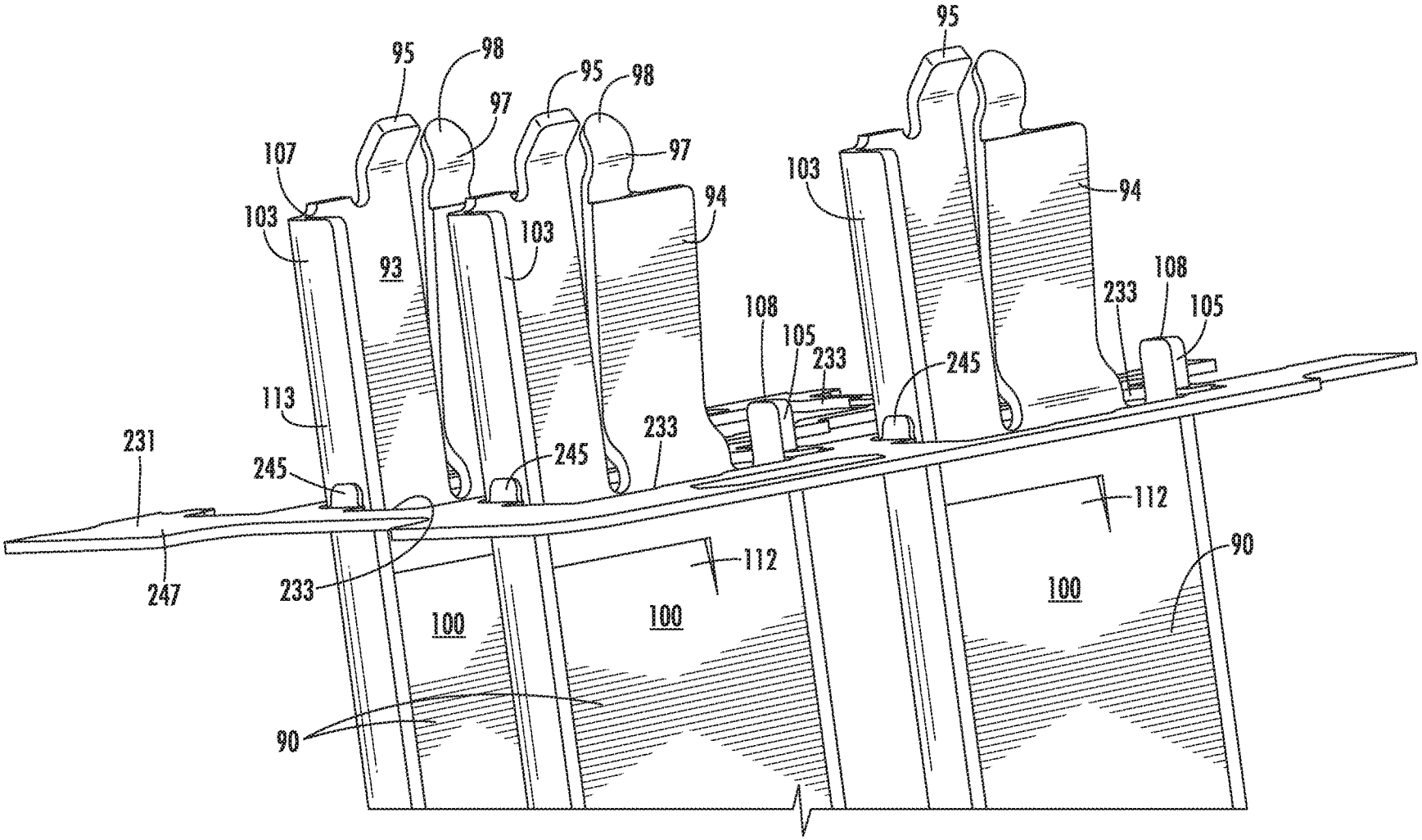
FIG. 50 illustrates an enlarged perspective view of a portion of a plurality of ground terminals interconnected to the upper ground plate with the housing and other terminals removed.

As the upper ground plate 231 moves towards the upper surface 134 of the upper housing component 21, the tabs 245 of the upper ground plate 231 will first engage the first upper surface 107 of the first rail 103 and then the second upper surface 108 of the second rail 105. As the tabs 245 engage the rails 103, 105, the tabs will resiliently deflect upward toward the mating face 13 and remain engaged with the outer surface 113 of the rails. FIG. 50 illustrates a portion of a plurality of ground terminals 90 electrically and mechanically interconnected to a plate 231. FIG. 51 illustrates a plurality of ground terminals 90 electrically and mechanically interconnected to a portion of the upper ground plate 231 and a portion of the lower ground plate 232.

Once the upper ground plate 231 is mounted on the upper housing component 21, the posts 190 may be deformed in any desired manner, such as by staking, to secure the upper ground plate 231 to the upper housing component 21.

Connector Mounting

To mount either a first connector 11 or a second connector 12 on a circuit board or member, a tool (not shown) may be configured to engage some or all of the ground terminals 90 to transmit the insertion force from the tool and press the tail sections 60 of the signal terminals and the tail section 115 of the ground terminals 90 into the circuit board.

Figure 52:
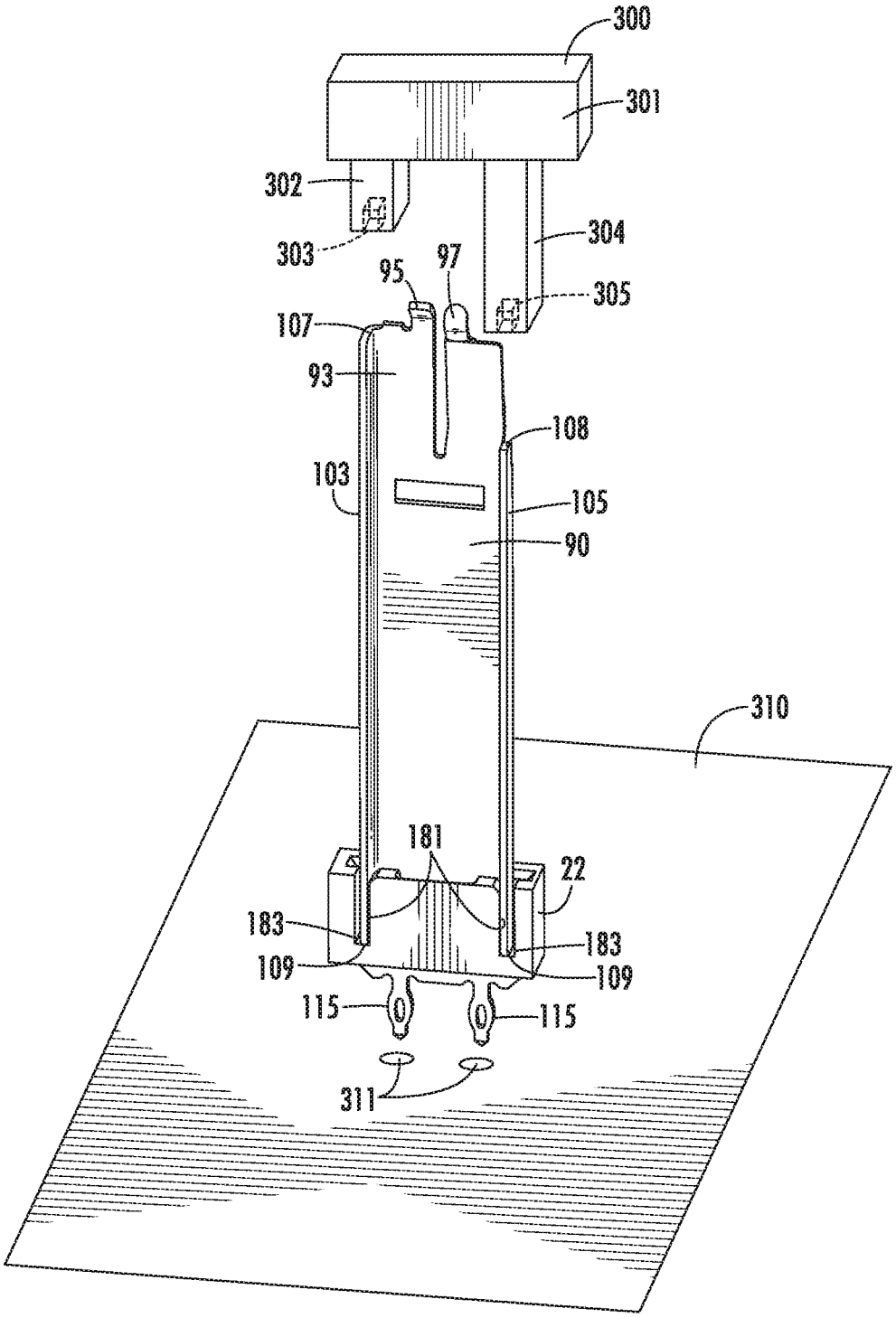
FIG. 52 illustrates a perspective view of a diagrammatic illustration of a tool aligned to engage a ground terminal prior to insertion of the ground terminal into a circuit board.
Figure 53:
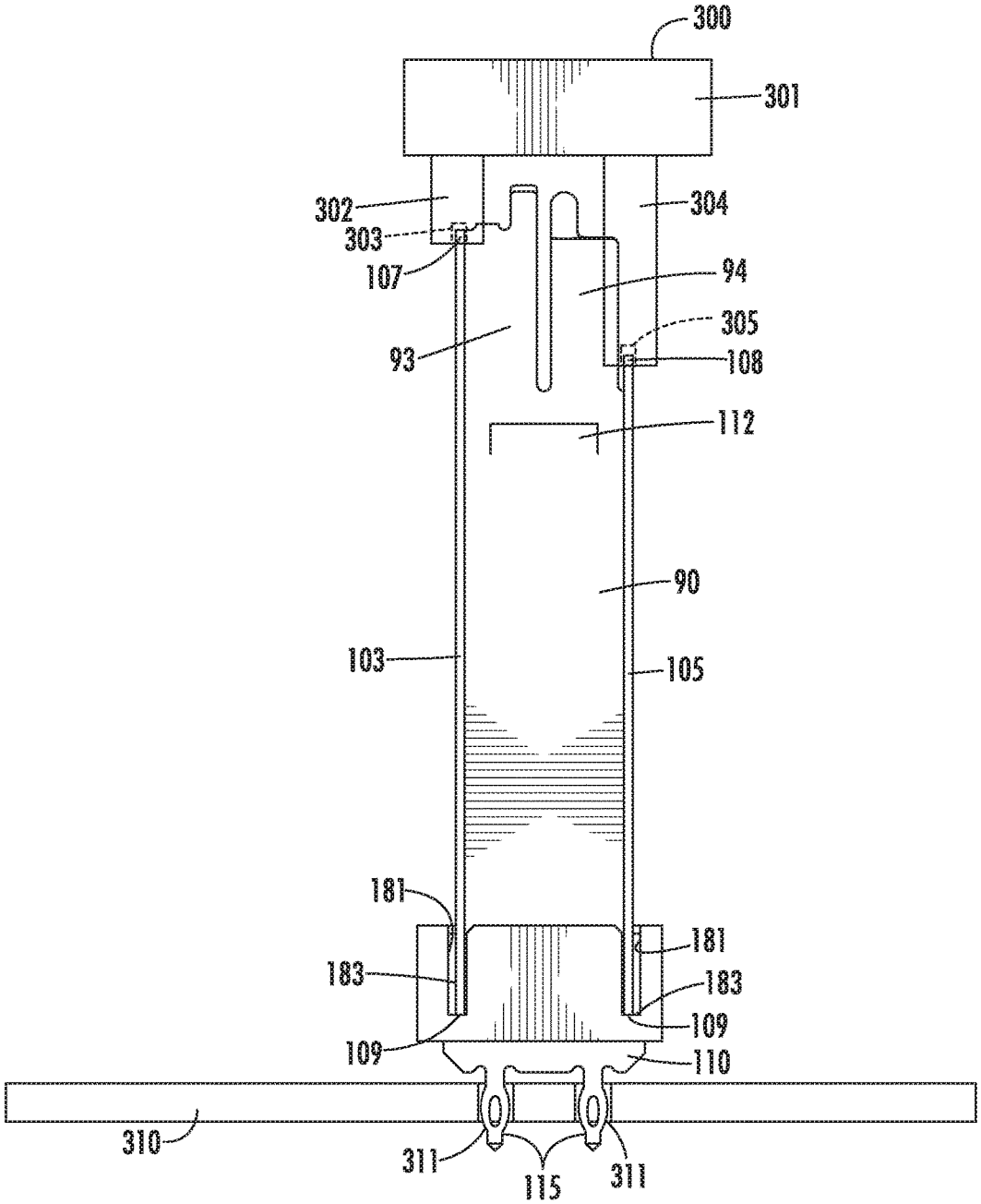
FIG. 53 illustrates a side view of the diagrammatic illustration of FIG. 52 after the tool has been used to insert the ground terminal into the circuit board.

Referring to FIGS. 52-53 as an illustration of a portion of such a concept, a tool 300 is depicted engaging a single ground terminal 90 that is mounted on a portion of the lower housing component 22. In practice, each connector would include a plurality of ground terminals 90 and the tool would be configured to engage some or all of the ground terminals.

Tool 300 is provided with a base 301 and a pair of ground terminal engagement legs. A first engagement legs 302 is relatively short and may include an opening 303 configured to engage the first upper surface 107 of the first rail 103 of a ground terminal 90. The second engagement leg 304 is relatively long and may include an opening 305 configured to engage the second upper surface 108 of the second rail 105 of a ground terminal 90. The first engagement leg 302 and the second engagement leg 304 have different lengths to compensate for the different lengths of the first rail 103 and the second rail 105. In other words, since the first upper surface 107 of the first rail 103 is closer to the mating face 13 of the first connector 11 than the second upper surface 108 of the second rail 105, the engagement legs have different lengths so that they contact the ground terminal 90 simultaneously and in an unskewed manner. The engagement legs may have a sufficient length so that the base 301 is spaced from and does not directly contact or engage the male contact section 93 and the female contact section 94.

To carry out the connector mounting process, a connector such as first connector 11 or second connector 12 is positioned adjacent a circuit board 310 with the tail sections 60 of the signal terminals and tail sections 115 of the ground terminals aligned with the desired or appropriate holes 311 in the circuit board (FIG. 52). The tool 300 is moved towards the ground terminal 300 until the opening 303 in the first leg 302 receives the first upper surface 107 of the first rail 103 and the opening 305 in the second leg 304 receives the second upper surface 108 of the second rail 105. Applying a force to the first upper surface 107 and the second upper surface 108 of the ground terminals 90 will directly press the tail sections 115 of the ground terminals into holes in the circuit board (FIG. 53).

While the tool 300 engages the ground terminal 90 and presses it into the circuit board 310, the lower surfaces 109 of the first and second rails 103, 105 engage the lower surfaces 183 of recesses 181 of the lower housing component 22. As a result, some of the insertion force applied to the ground terminals 90 is thus transferred to the lower housing component 22 through the engagement between the lower surfaces 109 of the first and second rails 103, 105 and the lower surfaces 183 of recesses 181.

Since each of the signal terminals is locked within the lower housing component 22, a portion of the insertion force applied to the lower housing component by the lower surfaces 109 of the ground terminals 90 is transferred to the signal terminals. More specifically and referring to FIG. 49, the insertion force is transferred from the lower housing component 22 to the signal terminals through the engagement of the central projections 170 and the side projections 175 of the signal terminal receiving openings 165 with the centrally located openings 51 and the rectangular side openings 52 of the signal terminals, respectively. The insertion force applied to the first upper surface 107 and the second upper surface 108 of the ground terminals 90 is thus used to insert the tail sections 60 of the signal terminals and the tail sections 115 of the ground terminals into the circuit board and thus mount the connector to the circuit board.

If desired, the insertion tool may also engage the housing 20. In some instances, the insertion tool may engage the housing primarily to support and guide the insertion of the connector onto the circuit board in a straight or unskewed manner.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in alt possible variations thereof is encompassed by the disclosure unless otherwise indicated herein or otherwise clearly contradicted by context.

The invention claimed is:

1. A connector comprising:

a housing having a mating face for mating with a mating component and a mounting face for interconnection to a circuit member, the housing having a plurality of terminal receiving cavities extending through an upper surface, a terminal support projection associated with each terminal receiving cavity and extending from the upper surface towards the mating face, each terminal support projection including a support surface and a contact positioning slot offset laterally from the support surface; and a plurality of terminals, each terminal being mounted in one of the terminal receiving cavities, each terminal including a contact section generally adjacent a first end for engaging a mating terminal and a tail section at a second end, opposite the first end, for interconnection to a circuit member, the contact section being positioned along the support surface of the terminal support projection, and a contact positioning projection extending from the contact section and positioned within the contact positioning slot of the housing to retain the contact section adjacent the support surface.

2. The connector of claim 1, wherein the contact positioning projection is a generally L-shaped member.

3. The connector of claim 2, wherein the contact section includes a generally planar contact surface for engaging a mating terminal and the L-shaped member is generally perpendicular to a plane of the generally planar contact surface.

4. The connector of claim 3, wherein the terminal is formed from sheet metal material having a thickness and the L-shaped member has a lateral width generally equal to the thickness of the sheet metal material.

5. The connector of claim 3, wherein the L-shaped member is generally planar and a plane of the L-shaped member is generally perpendicular to the plane of the generally planar contact surface.

6. The connector of claim 2, wherein the generally L-shaped member opens towards the second end of the terminal.

7. The connector of claim 1, wherein the housing further includes a plurality of second terminal receiving cavities extending through the upper surface, one of the second terminal receiving cavities being positioned adjacent each first terminal receiving cavity, and a plurality of second terminals, each second terminal being mounted in one of the second terminal receiving cavities, each second terminal including a deflectable contact section generally adjacent a first end for engaging a mating terminal and a second tail section at a second end, opposite the first end, for interconnection to the circuit member.

8. The connector of claim 1, wherein the terminals are formed from sheet metal material less than 0.01 inches thick.

9. The connector of claim 1, wherein the terminals are formed from sheet metal material having a thickness of approximately 0.005 inches.

10. A connector comprising:

a housing having a mating face for mating with a mating component and a mounting face for interconnection to a circuit member, the housing having a plurality of groups of terminal receiving cavities extending through an upper surface, each group of terminal receiving cavities including a first terminal receiving cavity and an adjacent second terminal receiving cavity, the first terminal receiving cavity having a cross-section with a first elongated slot, the second terminal receiving cavity having a cross-section with a second elongated slot, the first elongated slot and the second elongated slot being generally parallel, each first terminal receiving cavity including a terminal support projection extending from the upper surface towards the mating face, each terminal support projection including a support surface and a contact positioning slot offset laterally from the support surface; and a plurality of first terminals, each terminal being mounted in one of the first terminal receiving cavities, each first terminal including a first contact section generally adjacent a first end for engaging a mating terminal and a tail section at a second end, opposite the first end, for interconnection to a circuit member, the first contact section being positioned along the support surface of the terminal support projection, and a first contact positioning projection extending from the first contact section and positioned within the contact positioning slot of the housing to retain the first contact section against the support surface; and a plurality of second terminals, each second terminal being mounted in one of the second terminal receiving cavities, each second terminal including a deflectable second contact section generally adjacent a first end for engaging a mating terminal and a second tail section at a second end, opposite the first end, for interconnection to the circuit member.

11. The connector of claim 10, wherein the first elongated slot and the second elongated slot are generally aligned.

12. The connector of claim 10, further including a third terminal receiving cavity having a cross-section with a third elongated slot, the first elongated slot, the second elongated slot, and the third elongated slot being generally parallel, and a plurality of third terminals, each being positioned in one of the third terminal receiving cavities.

13. The connector of claim 12, wherein the first elongated slot and the second elongated slot are generally aligned and the third elongated slot is offset from the first elongated slot and the second elongated slot in a direction generally perpendicular to a line through the first elongated slot and the second elongated slot.

14. The connector of claim 12, wherein the first elongated slot and the second elongated slot define an axial distance along a line through the first elongated slot and the second elongated slot, and the third elongated slot is at least as long as the axial distance.

15. A connector comprising:

a housing having a mating face for mating with a mating component and a mounting face for interconnection to a circuit member;

the housing including a plurality of terminal receiving cavities, each terminal receiving cavity being configured to receive a terminal in an insertion direction extending generally from the mating face towards the mounting face, each terminal receiving cavity having a terminal locking section, the terminal locking section including a locking wall and a locking projection, the locking projection having a locking surface facing towards the mounting face and generally transverse to the insertion direction, the terminal locking section having an insertion opening with a transverse width partially defined by the locking projection;

a plurality of electrically conductive terminals, each terminal being positioned in one of the terminal receiving cavities, each terminal having a contact section for engaging a mating terminal of the mating component, a tail section for engaging the circuit member, and a locking section, the locking section including a locking shoulder extending generally perpendicularly to the insertion direction, the locking shoulder engaging the locking surface of the locking projection to retain the locking section of the terminal within the terminal locking section of the terminal receiving cavity, and the locking section having a thickness less than the transverse width of the insertion opening of the terminal locking section; and a plurality of locking members, each locking member being positioned within the terminal locking section of each terminal receiving cavity, the locking member being generally parallel to and spaced from the locking wall, the locking section of each terminal being positioned between the locking wall of the terminal locking section and the locking member.

16. The connector of claim 15, wherein the locking projection extends from the locking wall.

17. The connector of claim 16, wherein the locking projection tapers from a first surface closer to the mating face towards the locking surface wherein the locking surface extends farther from the locking wall than the first surface.

18. The connector of claim 16, wherein the locking section includes an opening and the locking shoulder is along an edge of the opening, wherein the opening is along a longitudinal centerline of the terminal, and wherein each terminal further includes a side opening along each lateral side edge and the terminal locking section further includes a pair of laterally spaced apart side projections with one side projection extending into each of the side openings.

19. The connector of claim 15, wherein the locking section includes a generally planar side surface and the generally planar side surface is positioned adjacent the locking wall, and wherein the side surface is pressed against the locking wall.

20. The connector of claim 15, further including a lock plate with the plurality of locking members extending from the lock plate, wherein the lock plate includes a generally planar base and the locking members extend from the base in a direction generally towards the mating face, and wherein the lock plate includes a plurality of slots, a portion of the tail sections of the terminals being positioned in the slots.

* * * * *